US009720349B2

(12) United States Patent
Yamaoka et al.

(10) Patent No.: US 9,720,349 B2
(45) Date of Patent: Aug. 1, 2017

(54) DEVELOPER SUPPLY KIT, DEVELOPER SUPPLYING DEVICE AND IMAGE FORMING APPARATUS

(71) Applicant: CANON KABUSHIKI KAISHA, Tokyo (JP)

(72) Inventors: Masato Yamaoka, Kashiwa (JP); Hiroyuki Fujikawa, Yokohama (JP); Kunihiko Nakamura, Gotemba (JP); Yusuke Yamada, Toride (JP); Emi Watanabe, Suntou-gun (JP); Nobuo Nakajima, Higashimatsuyama (JP); Katsuya Murakami, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/856,912

(22) Filed: Sep. 17, 2015

(65) Prior Publication Data

US 2016/0011540 A1 Jan. 14, 2016

Related U.S. Application Data

(63) Continuation of application No. PCT/JP2013/060404, filed on Mar. 29, 2013.

(30) Foreign Application Priority Data

Mar. 19, 2013 (JP) ..... 2013-056446

(51) Int. Cl.
*G03G 15/08* (2006.01)
*G03G 15/01* (2006.01)

(52) U.S. Cl.
CPC ..... *G03G 15/087* (2013.01); *G03G 15/01* (2013.01); *G03G 15/0872* (2013.01); *G03G 15/0877* (2013.01); *G03G 15/0874* (2013.01)

(58) Field of Classification Search
USPC ..... 399/260
See application file for complete search history.

(56) References Cited

U.S. PATENT DOCUMENTS 5,675,893 A 10/1997 Yamada et al.
5,907,750 A 5/1999 Yamada et al.
(Continued)

FOREIGN PATENT DOCUMENTS

JP H0-4143781 A 5/1992
JP H0-6130812 A 5/1994
(Continued)

OTHER PUBLICATIONS

Written Opinion of the International Searching Authority and International Search Report in International Patent Application No. PCT/JP2013/060404.

*Primary Examiner* — Clayton E Laballe
*Assistant Examiner* — Linda B Smith
(74) *Attorney, Agent, or Firm* — Fitzpatrick, Cella, Harper & Scinto

(57) ABSTRACT

A developer supply kit detachably mountable to a developer supplying apparatus comprising a developer supply container and a developer accommodated therein, wherein the developer supply container includes, a developer accommodating portion accommodating the developer, a discharge opening for discharging the developer accommodated in the developer accommodating portion, a drive receiving portion to which a driving force is inputted from the developer supplying apparatus, and a pump portion operable so that an internal pressure of the developer accommodating portion alternately and repetitively changes between a pressure lower than a ambient pressure and a pressure higher than the ambient pressure, by the driving force received by the drive receiving portion, wherein the developer accommodated in
(Continued)

the developer supply container includes toner containing binder resin material and a coloring material, the developer satisfies, $$10 \leq E \text{ (mJ)} \leq 80,$$

$$0.4 \leq Ea \text{ (mJ)} \leq 2.0,$$

where E is total energy when it is not aerated, and Ea is total energy when it is aerated.

4 Claims, 27 Drawing Sheets

(56) References Cited

U.S. PATENT DOCUMENTS

| | | | | |
|---|---|---|---|---|
| 5,991,571 | A | 11/1999 | Yamada et al. | |
| 6,004,710 | A | 12/1999 | Takagi et al. | |
| 6,049,685 | A | 4/2000 | Murakami et al. | |
| 6,128,453 | A | 10/2000 | Ban et al. | |
| 6,278,853 | B1 | 8/2001 | Ban et al. | |
| 6,541,172 | B2 | 4/2003 | Nagasaka et al. | |
| 6,656,652 | B2 | 12/2003 | Ishii et al. | |
| RE38,737 | E | 5/2005 | Ban et al. | |
| 6,922,540 | B2 | 7/2005 | Yoshikawa et al. | |
| 6,978,107 | B2 | 12/2005 | Nagashima et al. | |
| 7,116,929 | B2 | 10/2006 | Yamada | |
| 7,150,953 | B2 * | 12/2006 | Yamazaki | G03G 9/0821 430/108.3 |
| 7,160,659 | B2 | 1/2007 | Uesugi et al. | |
| 7,242,893 | B2 | 7/2007 | Murakami et al. | |
| 7,738,818 | B2 | 6/2010 | Murakami et al. | |
| 7,742,724 | B2 | 6/2010 | Tazawa et al. | |
| 8,000,614 | B2 | 8/2011 | Okino et al. | |
| 2008/0090164 | A1 * | 4/2008 | Takeda | G03G 9/0819 430/108.6 |
| 2012/0014722 | A1 | 1/2012 | Okino et al. | |
| 2013/0209140 | A1 | 8/2013 | Murakami et al. | |

FOREIGN PATENT DOCUMENTS

| | | | |
|---|---|---|---|
| JP | 2010256894 | A | 11/2010 |
| WO | 2010-256894 | A | 11/2010 |
| WO | 2012043875 | A1 | 4/2012 |

* cited by examiner (a)

(b)

(a)

(b)

(c)

(a)

(b)

(a)

(b)

DEVELOPER SUPPLY KIT, DEVELOPER SUPPLYING DEVICE AND IMAGE FORMING APPARATUS

FIELD OF THE INVENTION

The present invention relates to a developer supply kit detachably mountable to a developer replenishing apparatus, a developer supplying device usable with the same and an image forming apparatus using the same. The developer supply kit is used with an image forming apparatus such as a copying machine, a facsimile machine, a printer or a complex machine having functions of a plurality of such machines.

BACKGROUND ART

Conventionally, an image forming apparatus of an electrophotographic type such as a copying machine uses a developer of fine particles. In such an image forming apparatus, the developer is consumed with image forming operations, and therefore, the developer supplied from the developer supply container in response to consumption thereof resulting from image forming operation.

Such a developer supply kit as a developer supply container is disclosed in Japanese Laid-open Patent Application 2010-256894, for example.

The apparatus disclosed in Japanese Laid-open Patent Application 2010-256894 employs a system in which the developer is discharged using a bellow pump provided in the developer supply container. More particularly, the bellow pump is expanded to provide a pressure lower than the ambient pressure in the developer supply container, so that the air is taken into the developer supply container to fluidize the developer. In addition, the bellow pump is contracted to provide a pressure higher than the ambient pressure in the developer supply container, so that the developer is pushed out by the pressure difference between the inside and the outside of the developer supply container, thus discharging the developer. By repeating the two steps alternately, the developer is stably discharged.

SUMMARY OF THE INVENTION

Problem to be Solved by the Invention

As described above, with the apparatus disclosed in Japanese Laid-open Patent Application 2010-256894, the developer can be stably discharged out of the developer supply container. However, for the purpose of further image formation stability of the image forming apparatus, higher supply accuracy is desired for the developer supply container.

Accordingly, it is an object of the present invention to provide a developer supply kit, a developer supplying device and an image forming apparatus with which the supply accuracy of the developer from the developer supply container to the image forming apparatus is higher.

The present invention provides a developer supply kit detachably mountable to a developer supplying apparatus comprising a developer supply container and a developer accommodated therein, wherein said developer supply container includes a developer accommodating portion accommodating the developer, a discharge opening for discharging the developer accommodated in said developer accommodating portion, a drive receiving portion to which a driving force is inputted from said developer supplying apparatus, and a pump portion operable so that an internal pressure of said developer accommodating portion alternately and repetitively changes between a pressure lower than a ambient pressure and a pressure higher than the ambient pressure, by the driving force received by said drive receiving portion, wherein said developer accommodated in said developer supply container includes toner containing binder resin material and a coloring material, said developer satisfies, $$10 \leq E \text{ (mJ)} \leq 80,$$

$$0.4 \leq Ea \text{ (mJ)} \leq 2.0,$$

where E is total energy when it is not aerated, and Ea is total energy when it is aerated.

Effects of the Invention

According to the present invention, the developer can be discharged from the developer supply container with the precision, and an image density variation can be suppressed even when a great number of prints are produced with high printing ratio.

Figure 8:
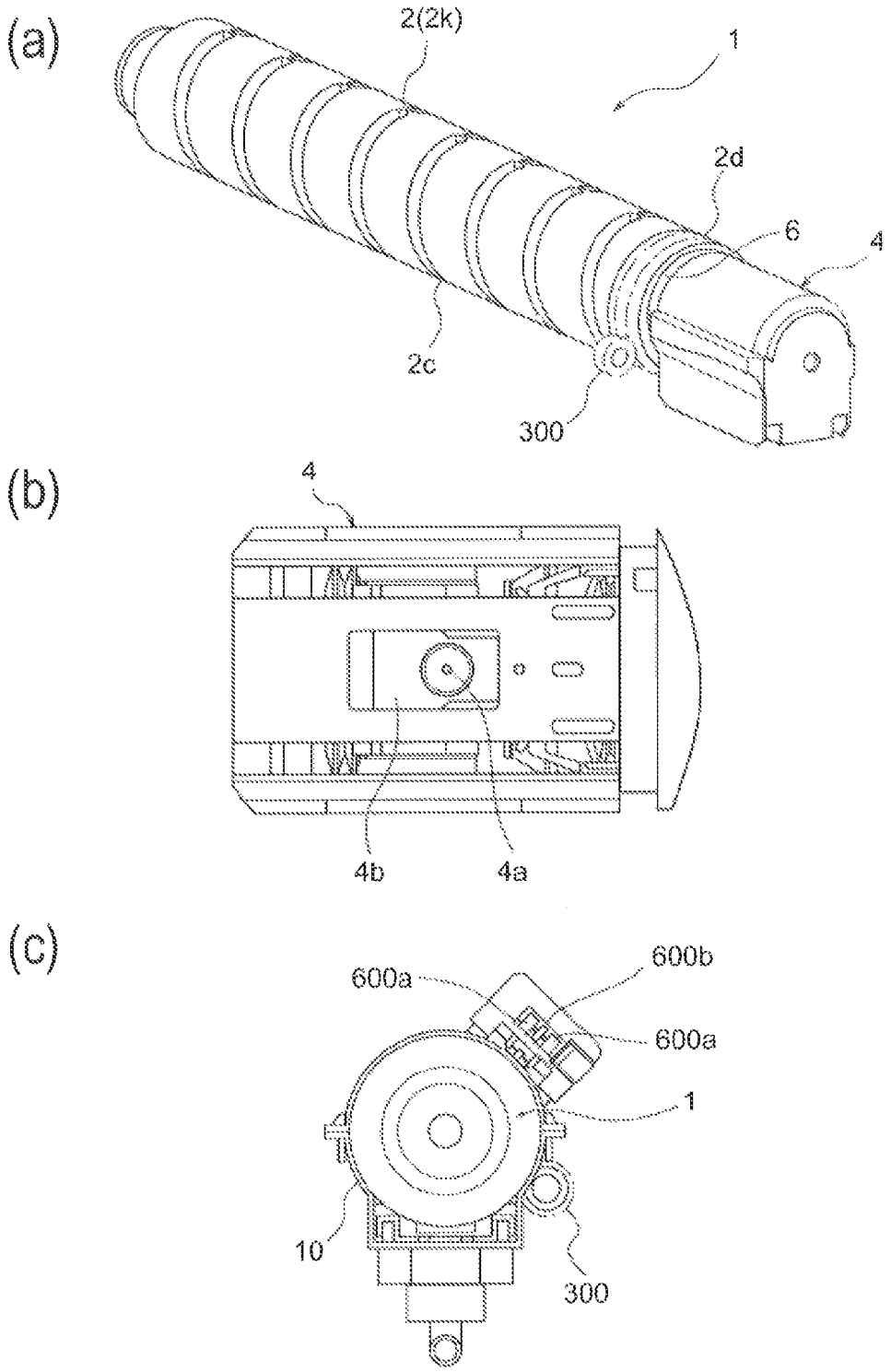

Part (a) of FIG. 8 is a perspective view illustrating the developer supply container according to Embodiment 1 of the present invention, (b) is a partial enlarged view illustrating a state around a discharge opening, and (c) is a front view illustrating a state in which the developer supply container is mounted to the mounting portion of the developer supplying apparatus.

Figure 9:
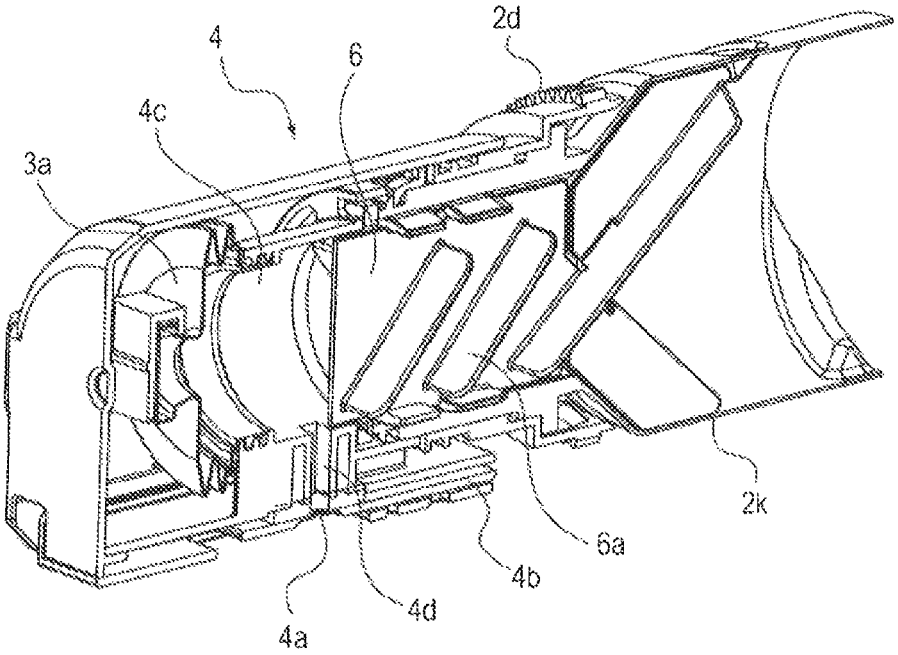

FIG. 9 is a sectional perspective view of the developer supply container.

Figure 10:
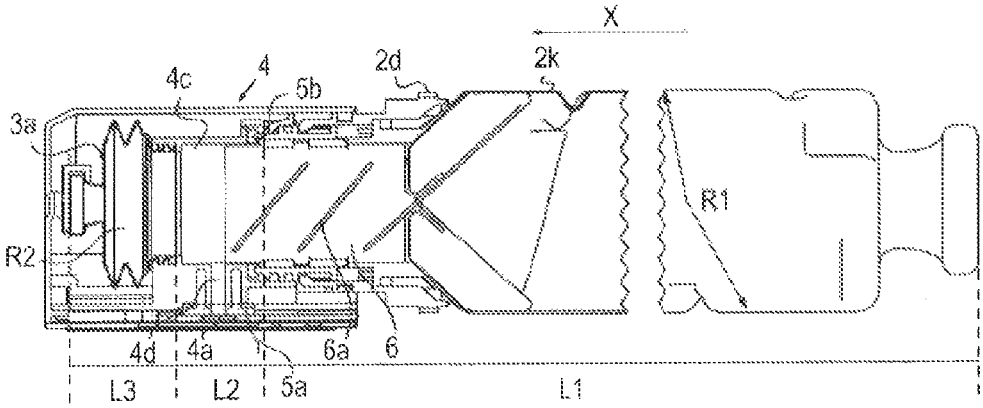
Figure 10:
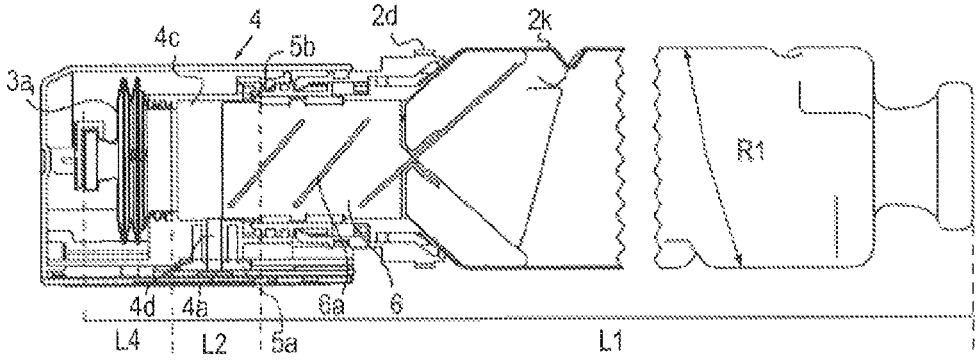

Part (a) of FIG. 10 is a partially sectional view in a state in which the pump portion is expanded to the maximum usable limit, and (b) is a partially sectional view in a state in which the pump portion is contracted to the maximum usable limit.

Figure 11:
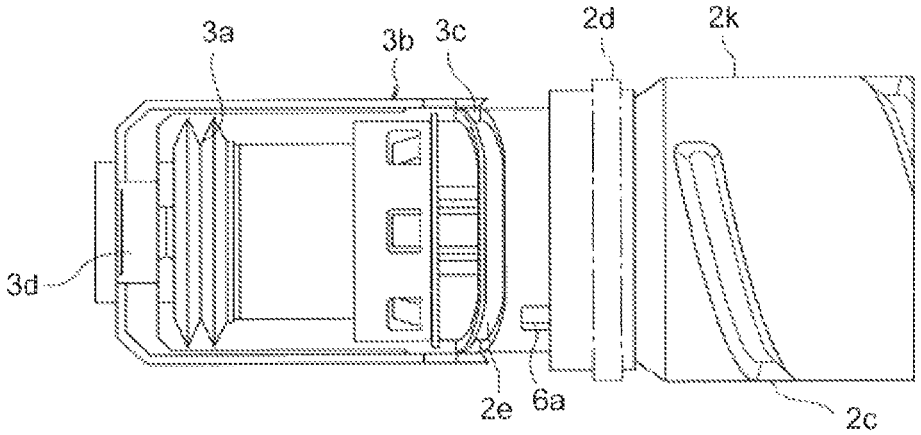
Figure 11:
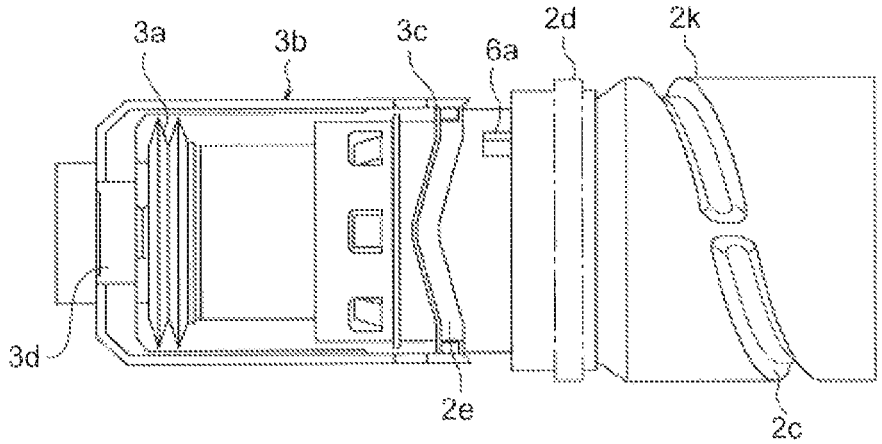
Figure 11:
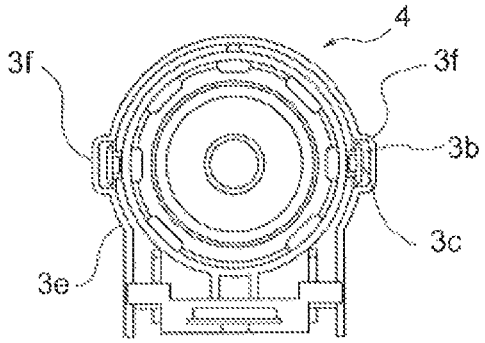

Part (a) of FIG. 11 is a partial view in a state in which the pump portion is expanded to the maximum usable limit, (b) is a partial view in a state in which the pump portion is contracted to the maximum usable limit, and (c) is a partial view of the pump portion.

Figure 12:
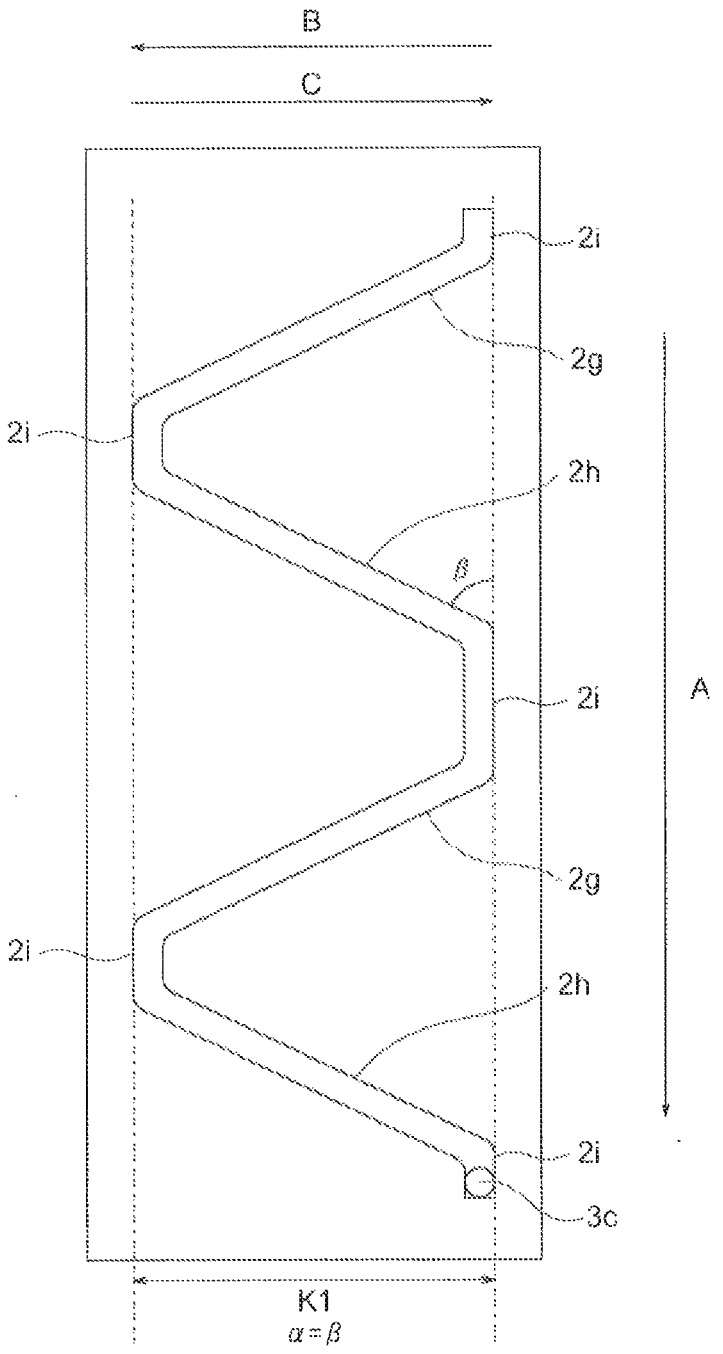

FIG. 12 is an extended elevation illustrating a cam groove configuration of the developer supply container.

Figure 13:
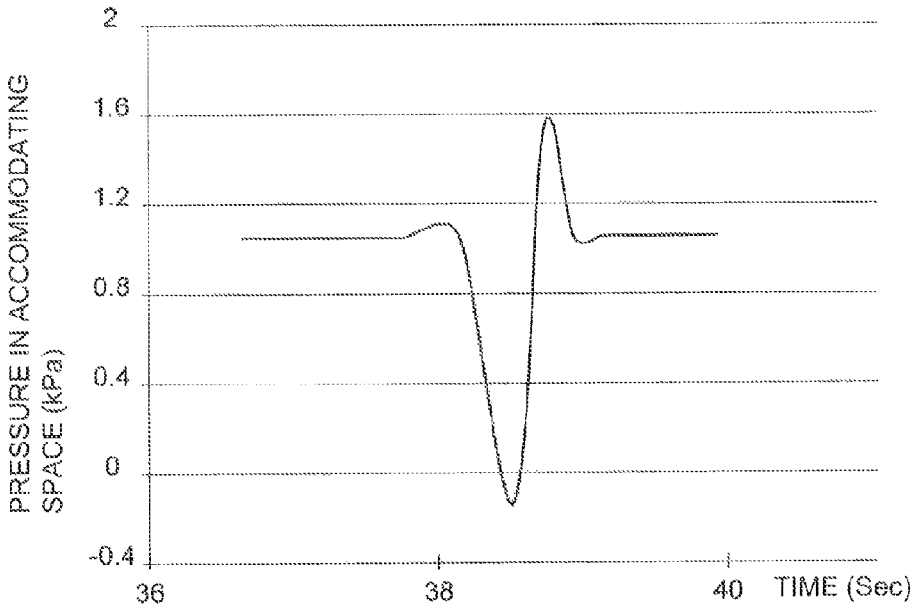

FIG. 13 illustrates a change of an internal pressure of the developer supply container.

Figure 14:
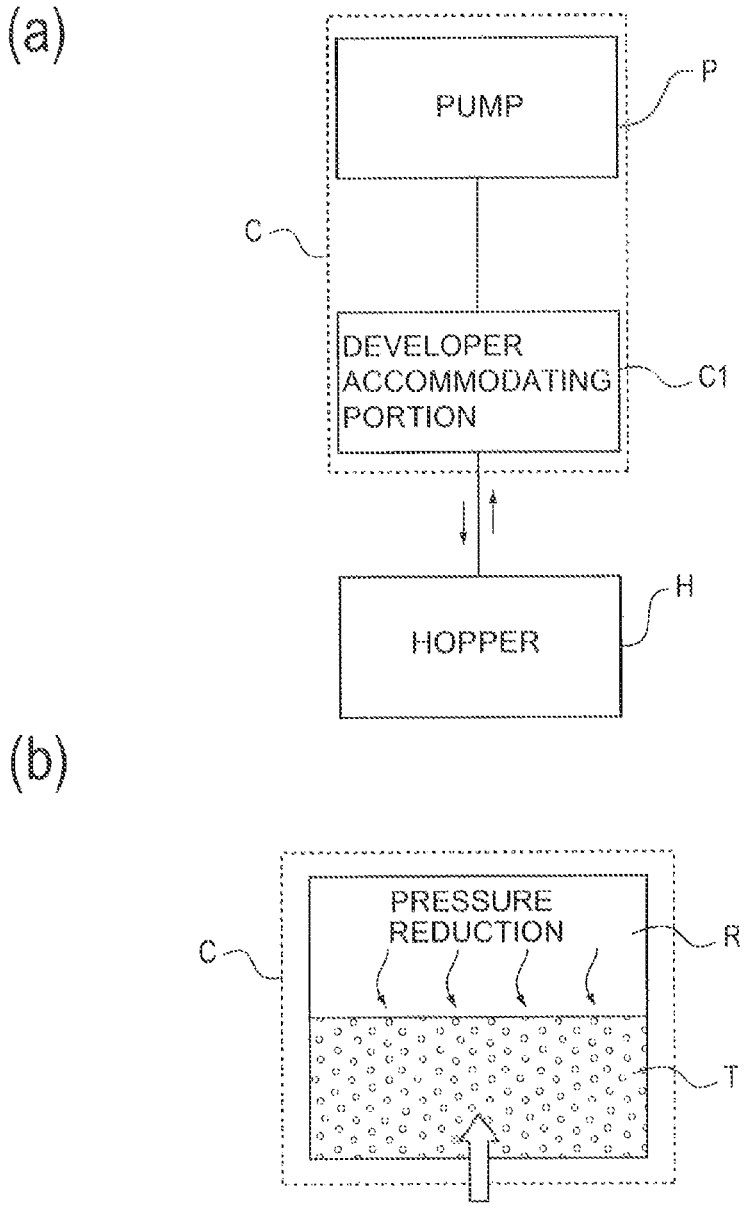

Part (a) of FIG. 14 is a block diagram illustrating a developer supplying system (first embodiment) used in a verification experiment, and (b) is a schematic illustration of a phenomenon-inside the developer supply container.

Figure 15:
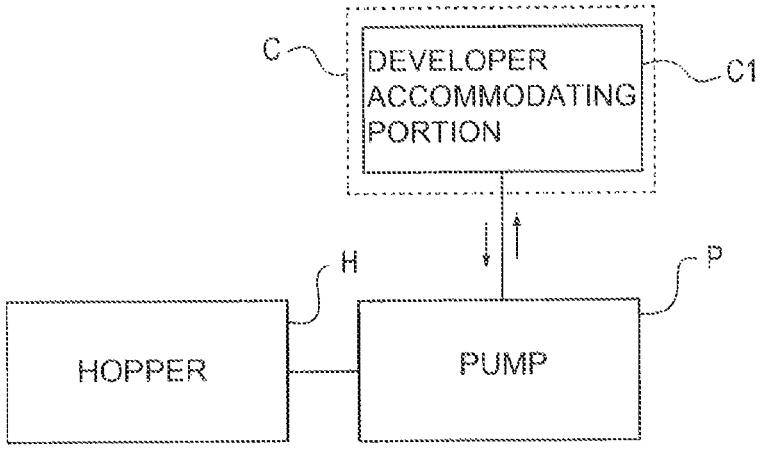
Figure 15:
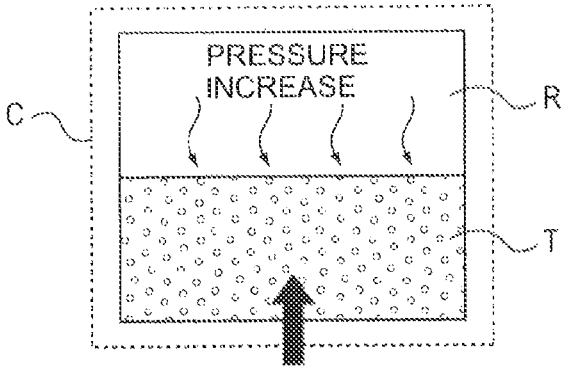

Part (a) of FIG. 15 is a block diagram of a developer supplying system (comparison example the used in the verification experiment, and (b) is a schematic illustration of a phenomenon-inside the developer supply container.

Figure 16:
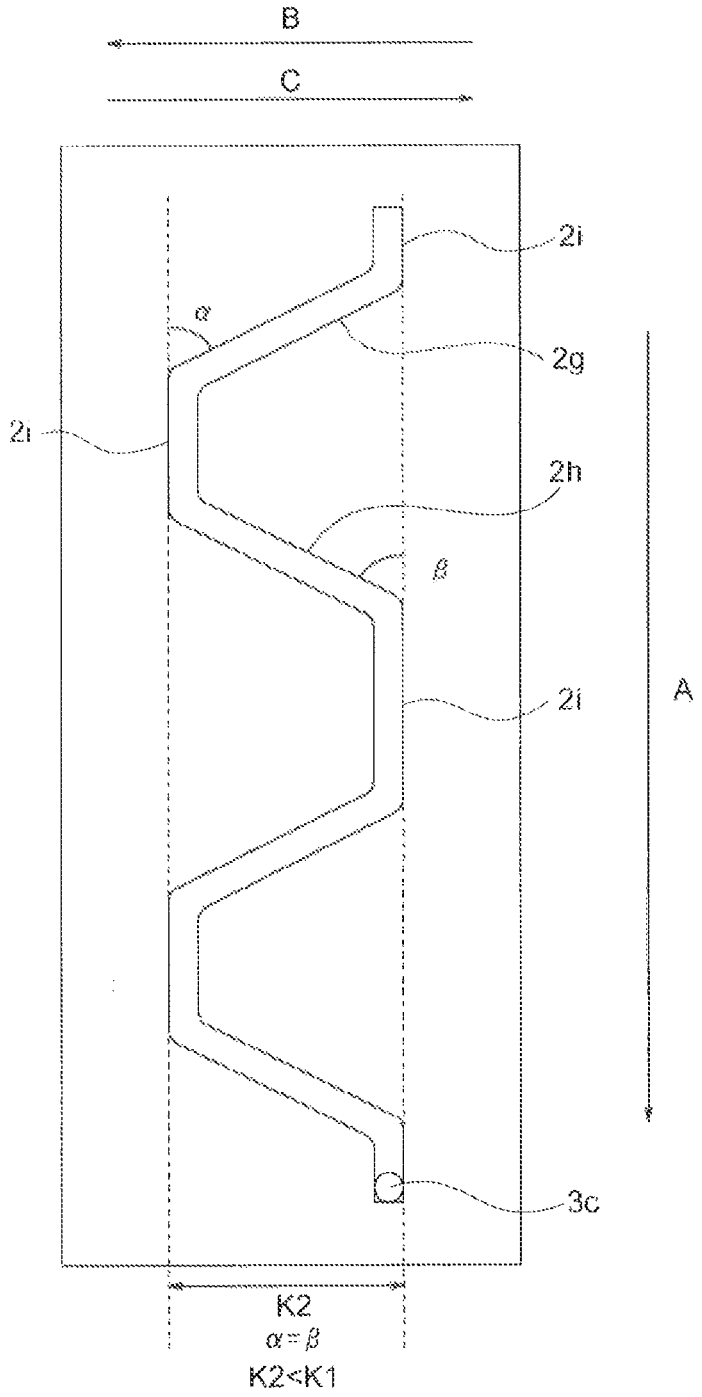

FIG. 16 is an extended elevation of an example of the cam groove configuration of the developer supply container.

Figure 17:
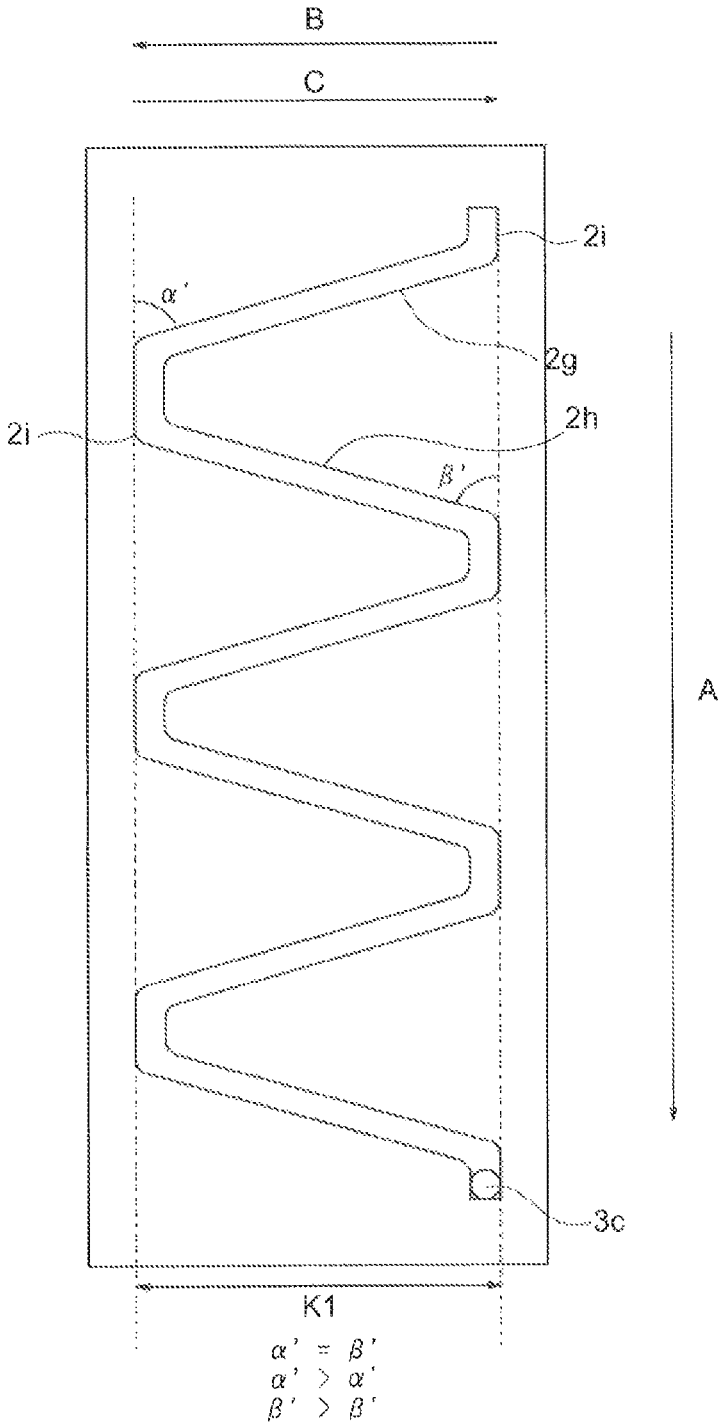

FIG. 17 is an extended elevation of an example of the cam groove configuration of the developer supply container.

Figure 18:
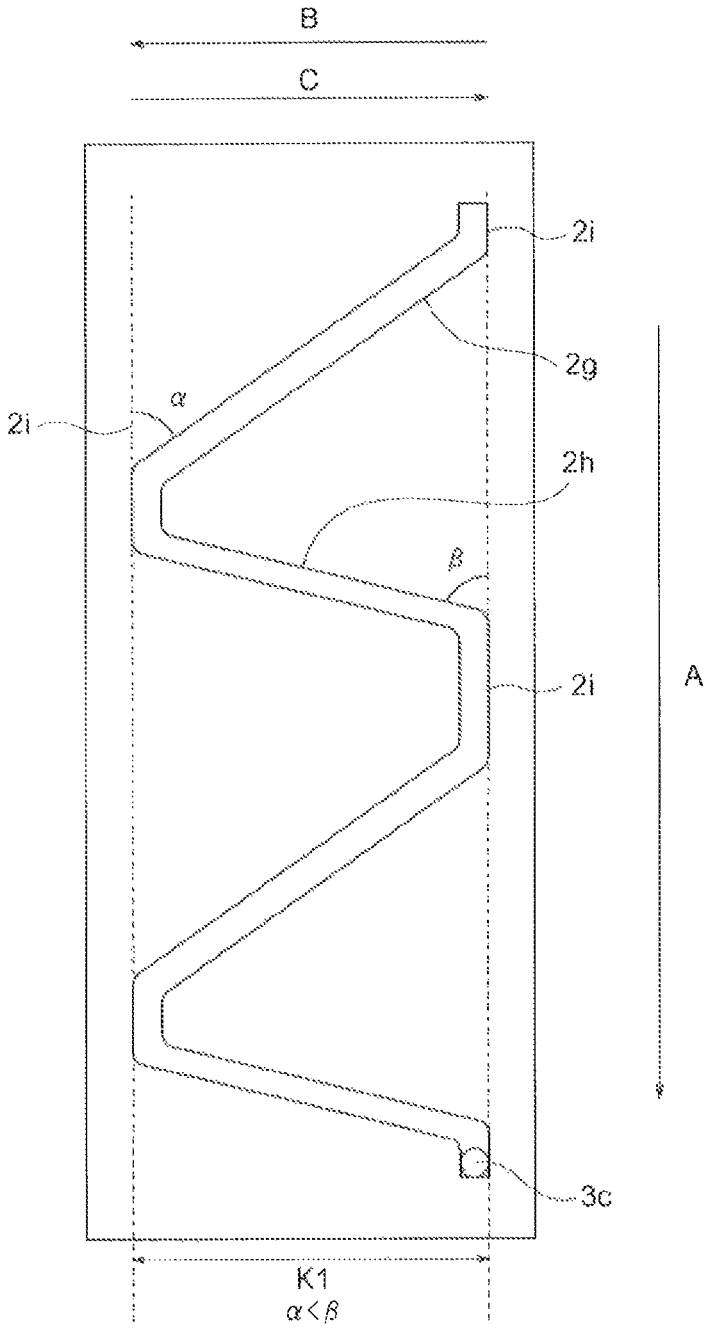

FIG. 18 is an extended elevation of an example of the cam groove configuration of the developer supply container.

Figure 19:
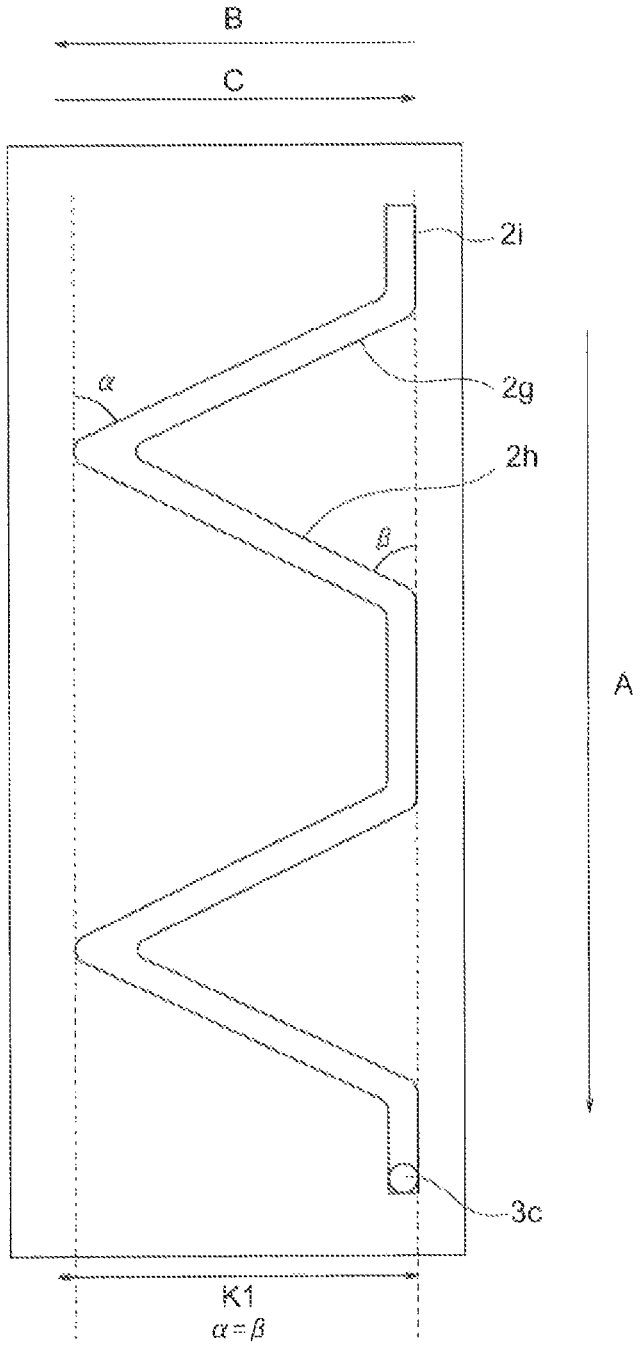

FIG. 19 is an extended elevation of an example of the cam groove configuration of the developer supply container.

Figure 20:
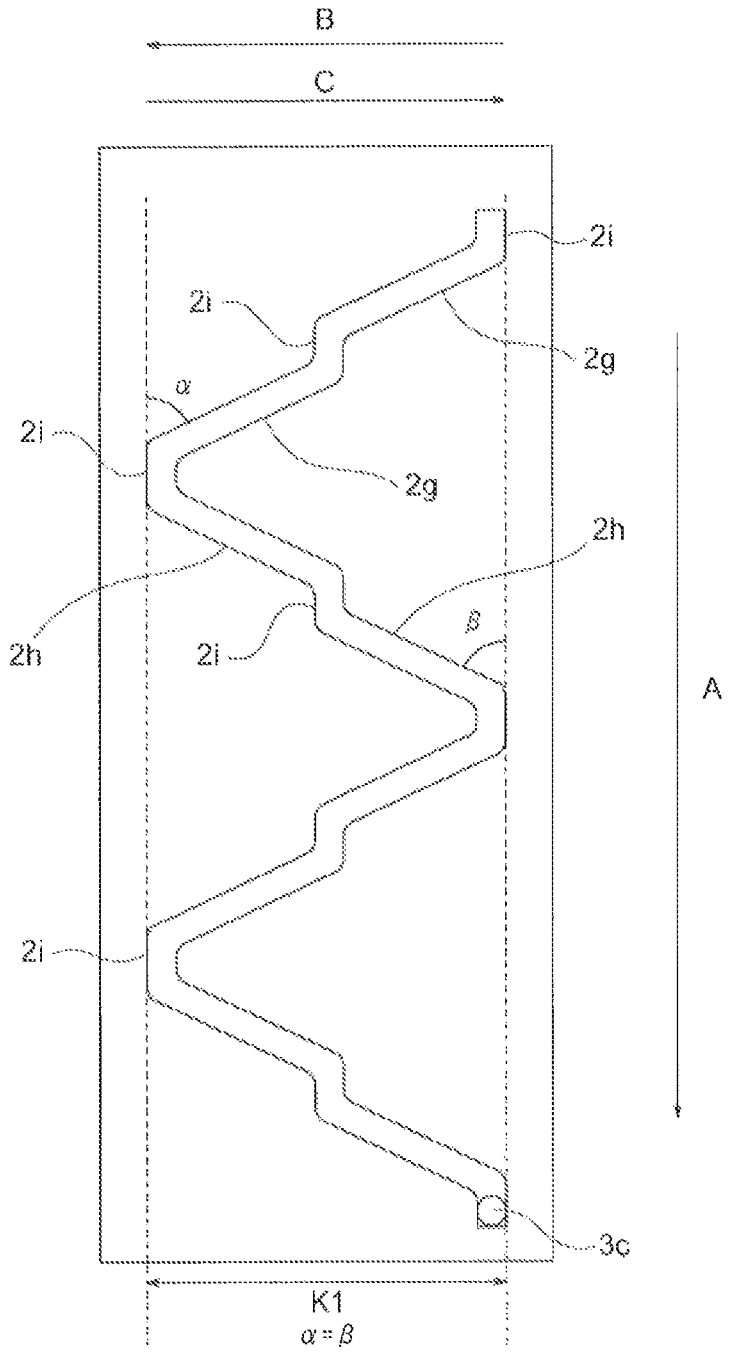

FIG. 20 is an extended elevation of an example of the cam groove configuration of the developer supply container.

Figure 21:
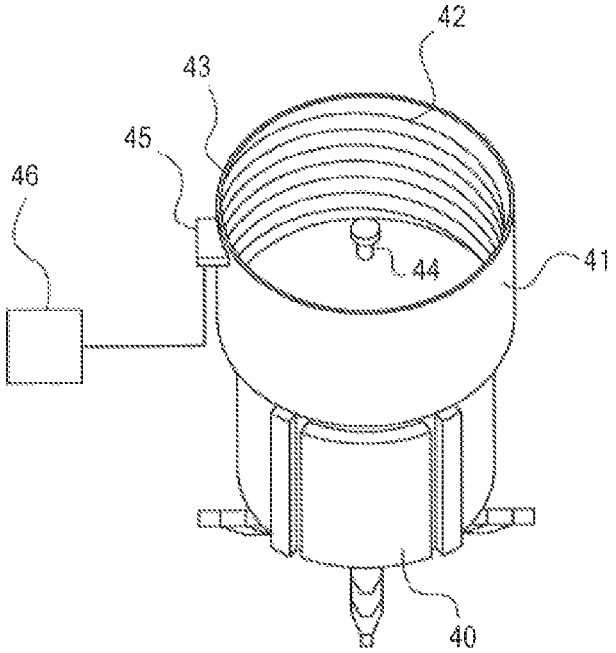

FIG. 21 illustrates a parts feeder used in measurement of a transportation property index of the developer.

Figure 22:
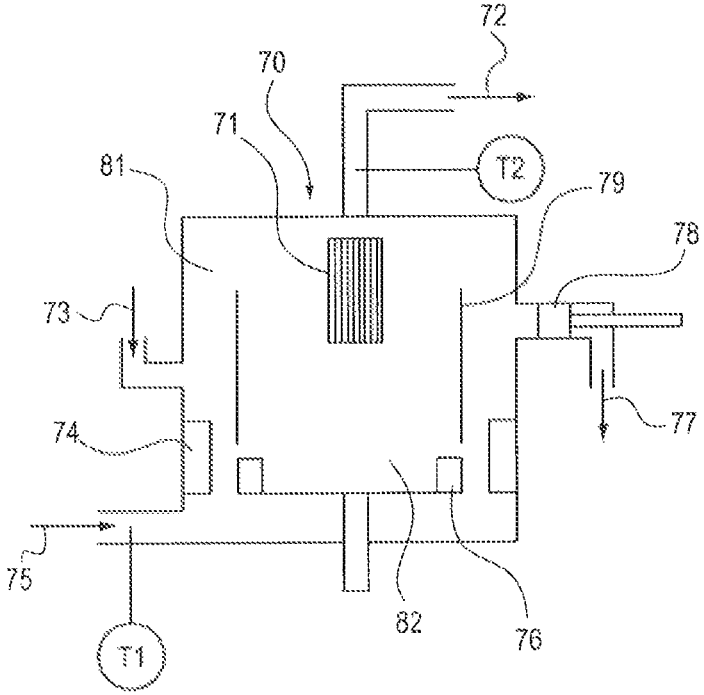

FIG. 22 is an illustration of a surface improvement treatment device.

Figure 23:
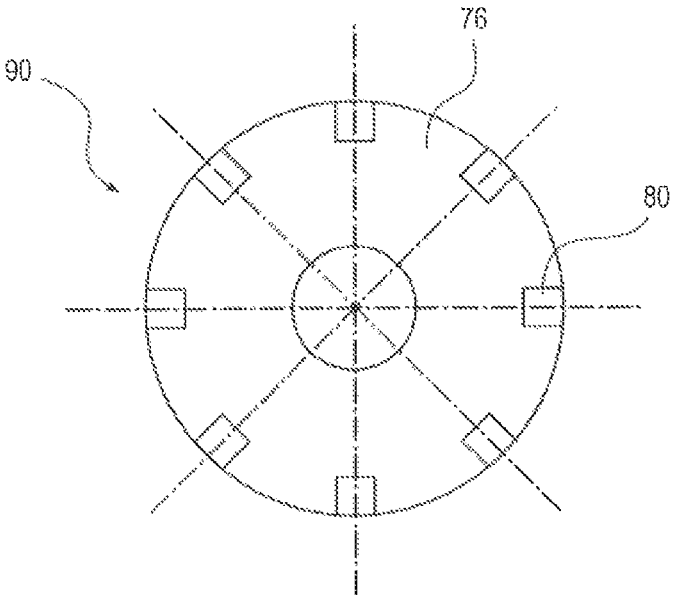

FIG. 23 is a partial enlarged view of the device of FIG. 22.

Figure 24:
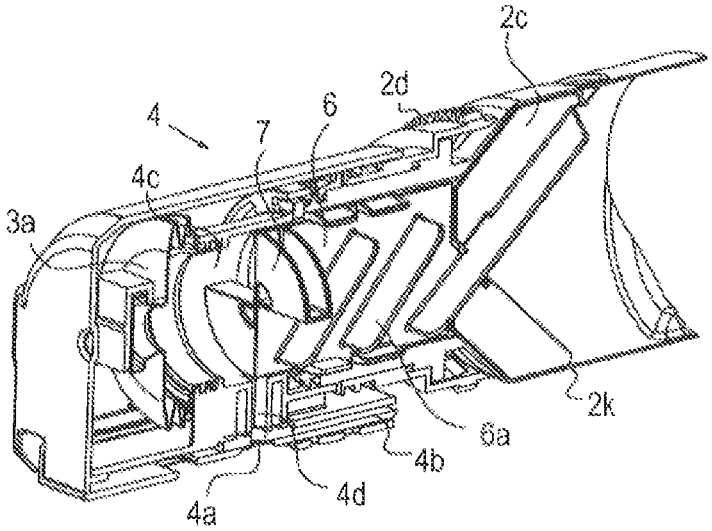

FIG. 24 is a sectional perspective view of a developer supply container according to a second embodiment of the present invention.

Figure 25:
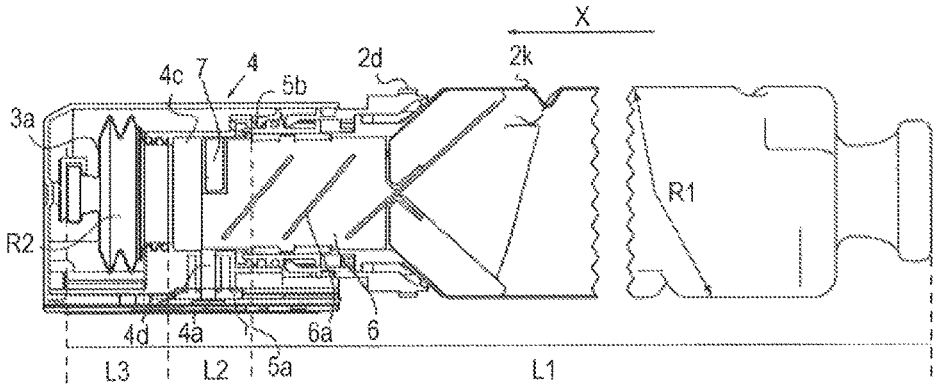

FIG. 25 is a partially sectional view in the state that the pump portion is expanded to a maximum usable limit in the second embodiment.

Figure 26:
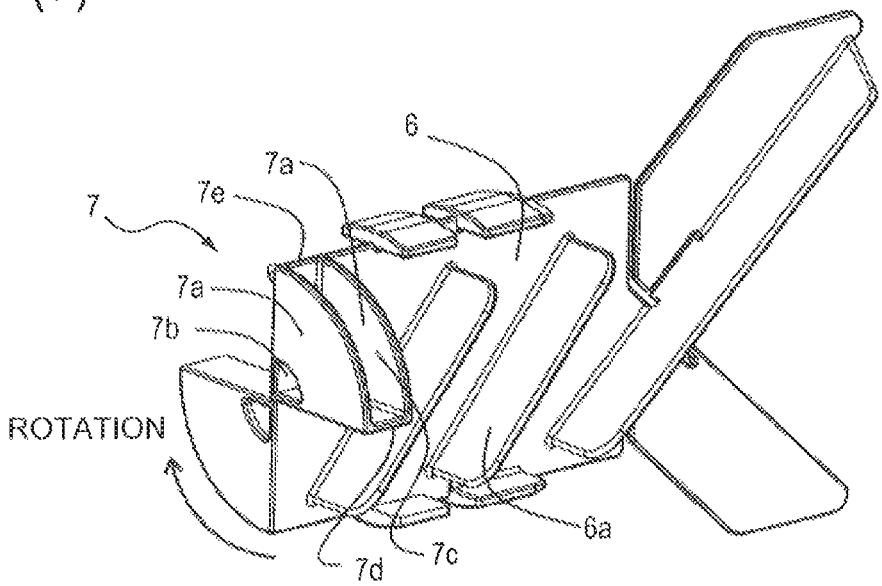
Figure 26:
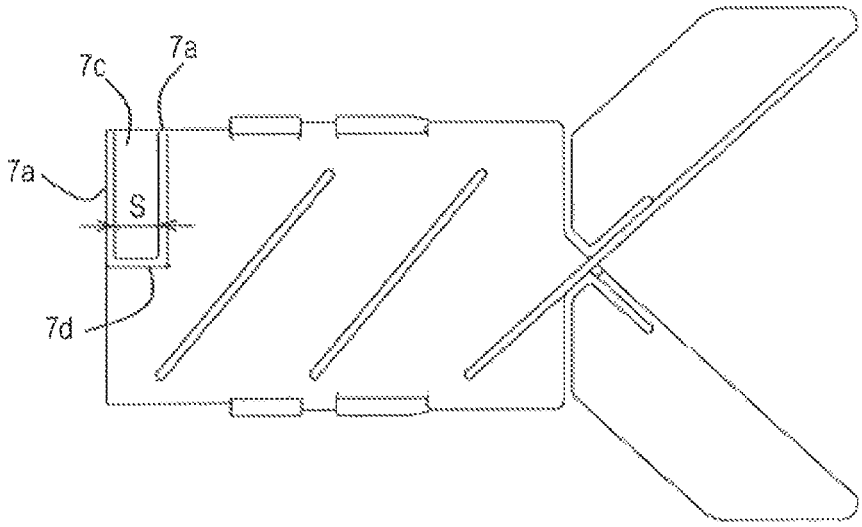

Part (a) of FIG. 26 is a perspective view of an entirety of a partition wall in the second embodiment, and (b) is a side view of the partition wall.

Figure 27:
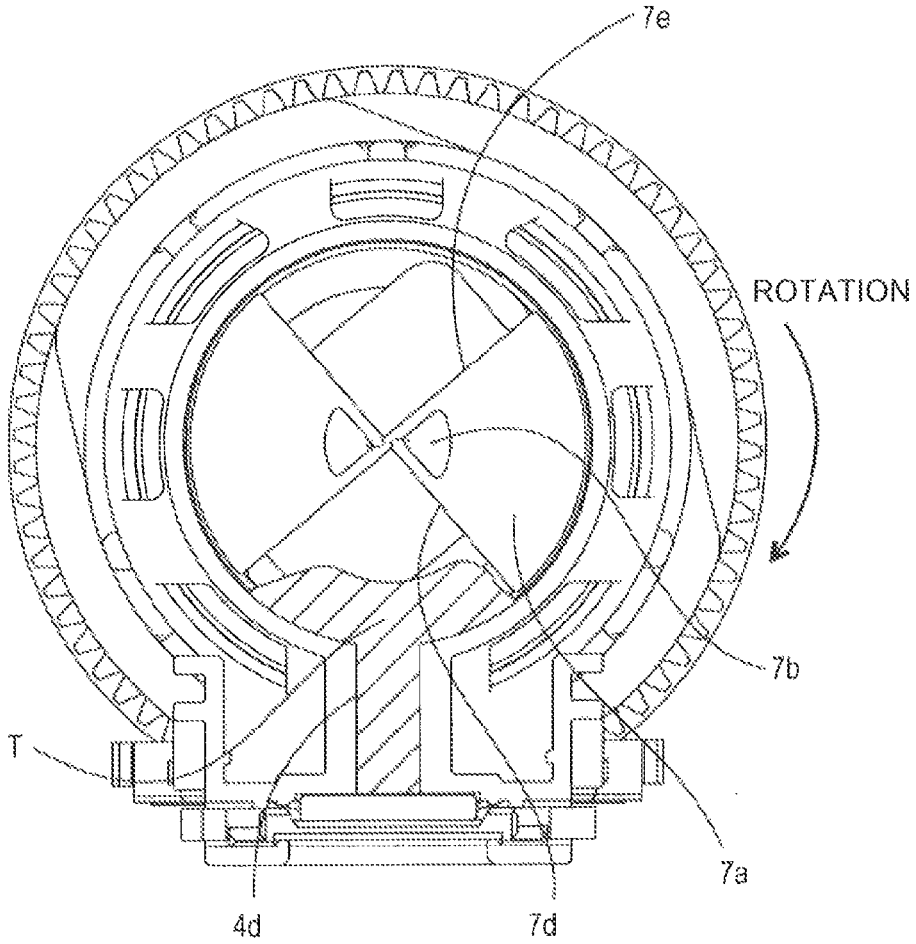

FIG. 27 is a sectional view of a discharging portion of the pump portion in the operation rest stroke, in Embodiment 1.

Figure 28:
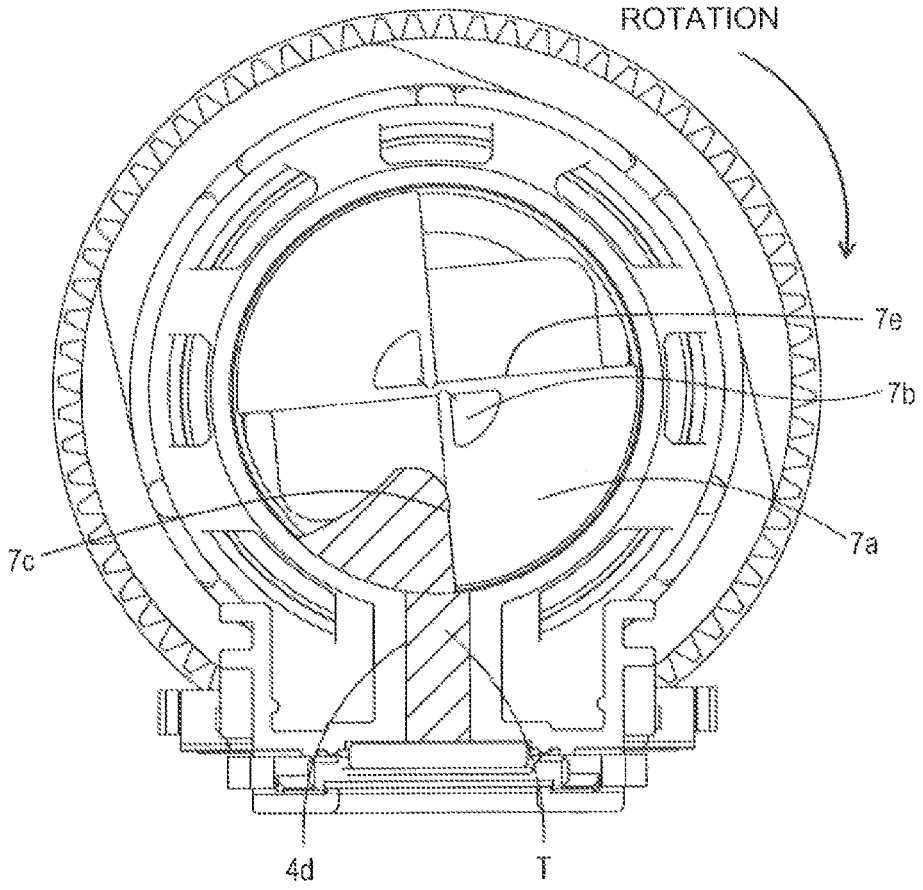

FIG. 28 is a sectional view of the discharging portion in the suction operation in Embodiment 1.

Figure 29:
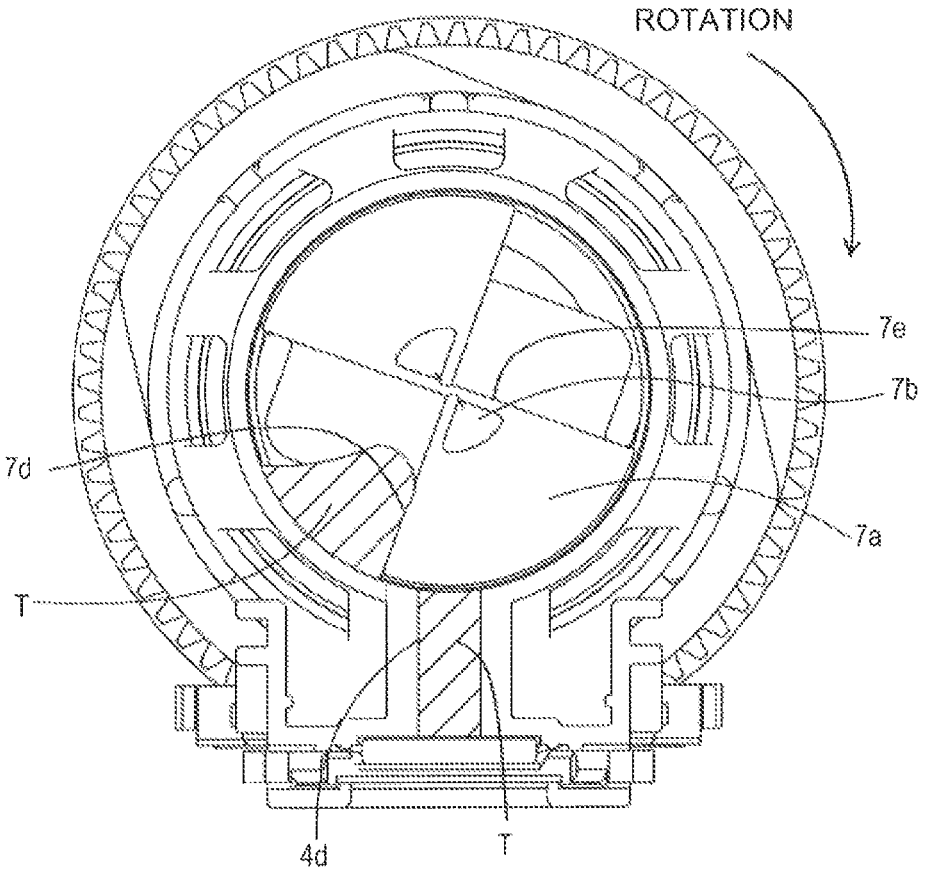

FIG. 29 is a sectional view of the discharging portion in the discharging operation in Embodiment 1.

Figure 30:
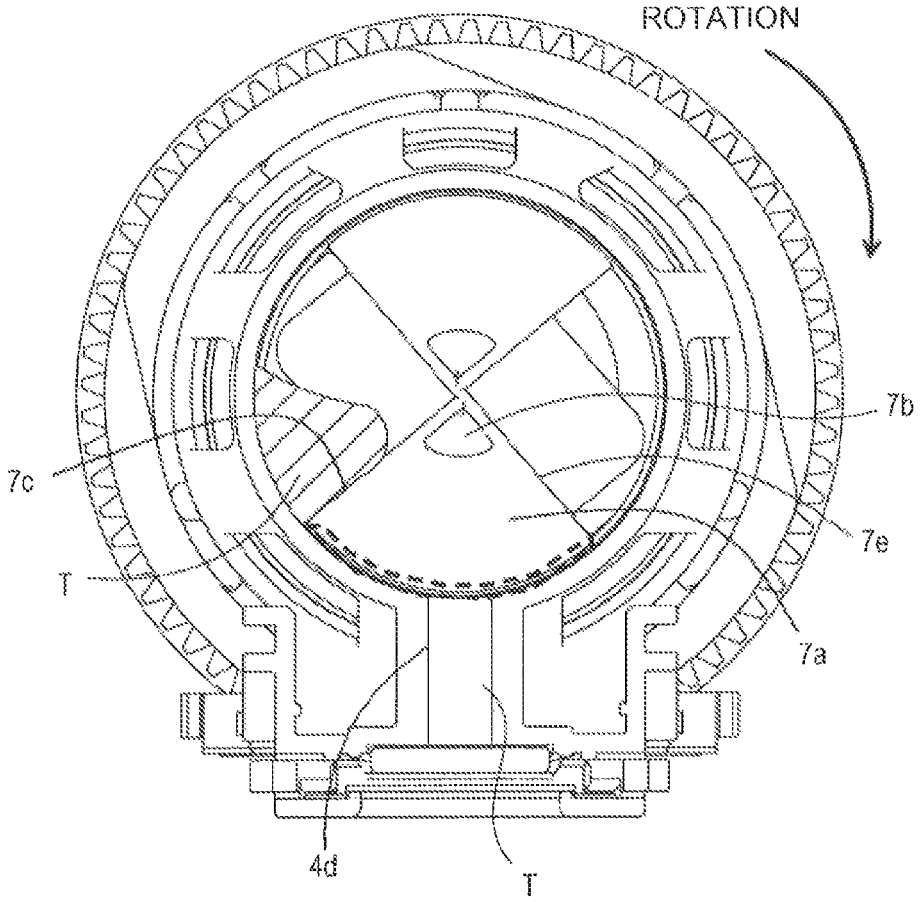

FIG. 30 is a sectional view of the discharging portion after the other developer is discharged, in Embodiment 1.

DESCRIPTION OF THE EMBODIMENTS

First Embodiment

In this embodiment, a container for accommodating a developer is called "developer supply container", and the developer supply container actually containing the developer is called "developer supply kit".

First, basic structures of an image forming apparatus will be described, and then, a developer supplying system, that is, a developer replenishing apparatus, and then a developer supply container and a developer supply kit in the image forming apparatus will be described.

(Image Forming Apparatus)

Figure 1:
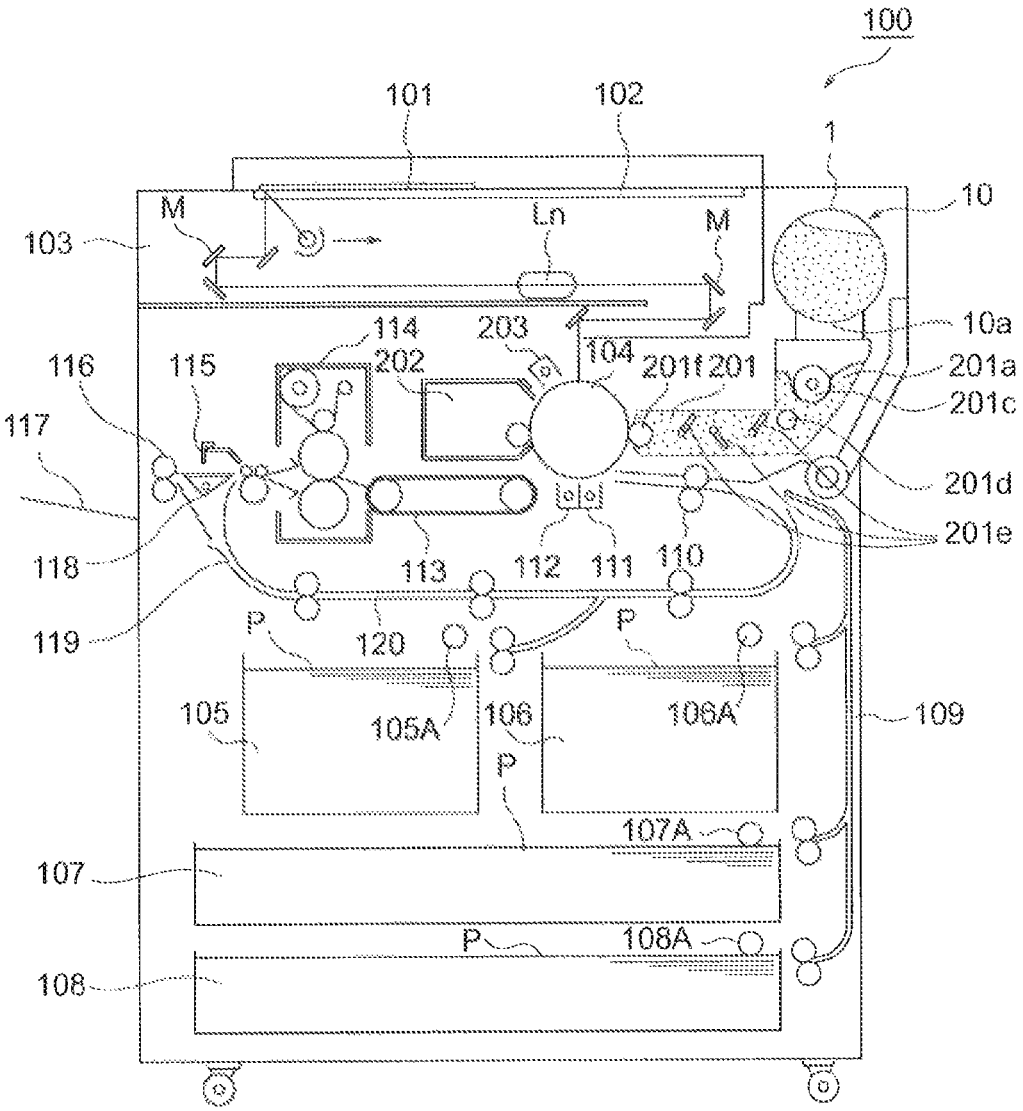
FIG. 1 is a sectional view illustrating a general arrangement of an image forming apparatus.

Referring to FIG. 1, the description will be made as to structures of a copying machine (electrophotographic image forming apparatus) employing an electrophotographic type process as an example of an image forming apparatus using a developer replenishing apparatus to which a developer supply kit (so-called toner cartridge) is detachably mountable.

In the Figure, designated by 100 is a main assembly of the copying machine (main assembly of the image forming apparatus or main assembly of the apparatus). Designated by 101 is an original which is placed on an original supporting platen glass 102. A light image corresponding to image information of the original is imaged on an electrophotographic photosensitive member 104 (photosensitive member) by way of a plurality of mirrors M of an optical portion 103 and a lens Ln, so that an electrostatic latent image is formed. The electrostatic latent image is visualized with toner (one component magnetic toner) as a developer (dry powder) by a dry type developing device (one component developing device) 201*a*.

In this embodiment, the one component magnetic toner is used as the developer to be supplied from a developer supply container 1, but the present invention is not limited to the example and includes other examples which will be described hereinafter.

Specifically, in the case that a one component developing device using the one component non-magnetic toner is employed, the one component non-magnetic toner is supplied as the developer. In addition, in the case that a two component developing device using a two component developer containing mixed magnetic carrier and non-magnetic toner is employed, the non-magnetic toner is supplied as the developer. In such a case, both of the non-magnetic toner and the magnetic carrier may be supplied as the developer.

Designated by 105-108 are cassettes accommodating recording materials (sheets) S. Of the sheet S stacked in the cassettes 105-108, an optimum cassette is selected on the basis of a sheet size of the original 101 or information inputted by the operator (user) from a liquid crystal operating portion of the copying machine. The recording material is not limited to a sheet of paper, but OHP sheet or another material can be used as desired.

One sheet S supplied by a separation and feeding device 105A-108A is fed to registration rollers 110 along a feeding portion 109, and is fed at timing synchronized with rotation of a photosensitive member 104 and with scanning of an optical portion 103.

Designated by 111, 112 are a transfer charger and a separation charger. An image of the developer formed on the photosensitive member 104 is transferred onto the sheet S by a transfer charger 111. Then, the sheet S carrying the developed image (toner image) transferred thereonto is separated from the photosensitive member 104 by the separation charger 112.

Thereafter, the sheet S fed by the feeding portion 113 is subjected to heat and pressure in a fixing portion 114 so that the developed image on the sheet is fixed, and then passes through a discharging/reversing portion 115, in the case of one-sided copy mode, and subsequently the sheet S is discharged to a discharging tray 117 by discharging rollers 116.

In the case of a duplex copy mode, the sheet S enters the discharging/reversing portion 115 and a part thereof is ejected once to an outside of the apparatus by the discharging roller 116. The trailing end thereof passes through a flapper 118, and a flapper 118 is controlled when it is still nipped by the discharging rollers 116, and the discharging rollers 116 are rotated reversely, so that the sheet S is refed into the apparatus. Then, the sheet S is fed to the registration rollers 110 by way of re-feeding portions 119, 120, and then conveyed along the path similarly to the case of the one-sided copy mode and is discharged to the discharging tray 117.

In the main assembly of the apparatus 100, around the photosensitive member 104, there are provided image forming process equipment (process means) such as a developing device 201*a* as the developing means a cleaner portion 202 as a cleaning means, a primary charger 203 as charging means. The developing device 201*a* develops the electrostatic latent image formed on the photosensitive member 104 by the optical portion 103 in accordance with image information of the 101, by depositing the developer (toner) onto the latent image.

The primary charger 203 functions to uniformly charge the surface of the photosensitive member 104 so that an intended electrostatic image is formed on the photosensitive member 104. In addition, the cleanup portion 202 is to remove the developer remaining on the photosensitive member 104.

(Developer Supplying Apparatus)

Figure 2:
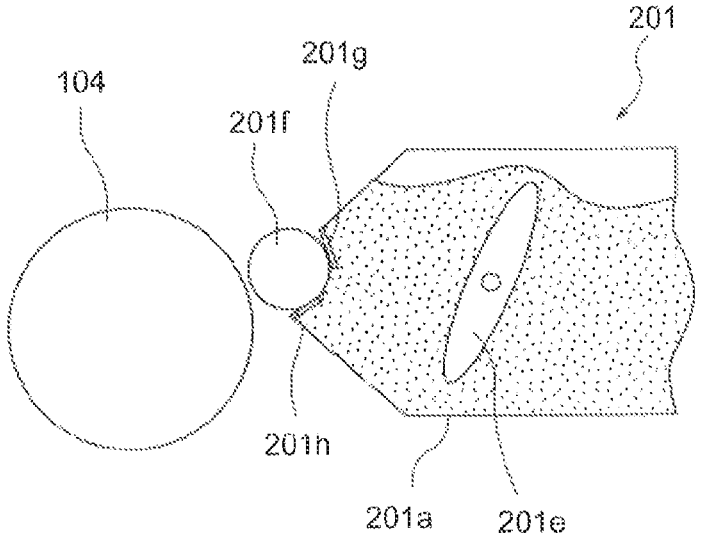
FIG. 2 is a partially sectional view of a developer supplying apparatus.
Figure 3:
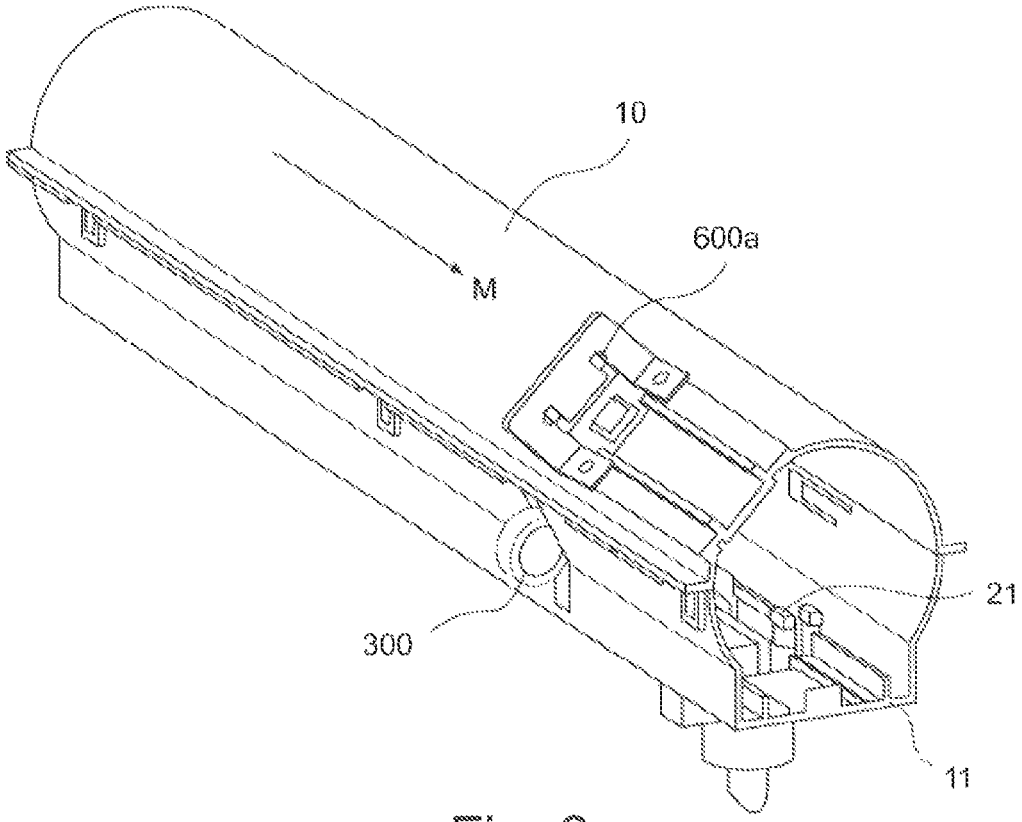
FIG. 3 is a perspective view of a mounting portion.
Figure 4:
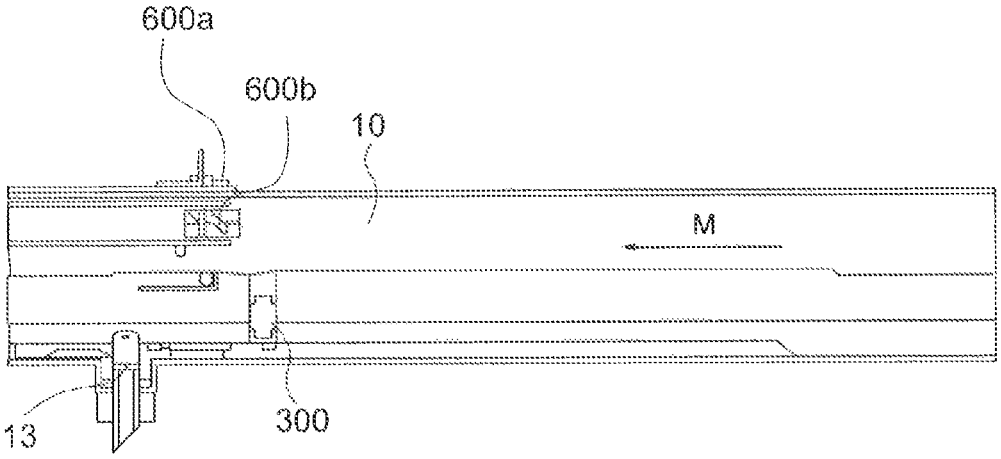
FIG. 4 is a sectional view of the mounting portion.

Referring to FIGS. 1-6, a developer replenishing apparatus 201 which is a constituent-element of the developer supplying system will be described. FIG. 2 is a partially sectional view of the developer supplying apparatus. FIG. 3 is a perspective view of a mounting portion, and FIG. 4 is a sectional view of the mounting portion.

Figure 5:
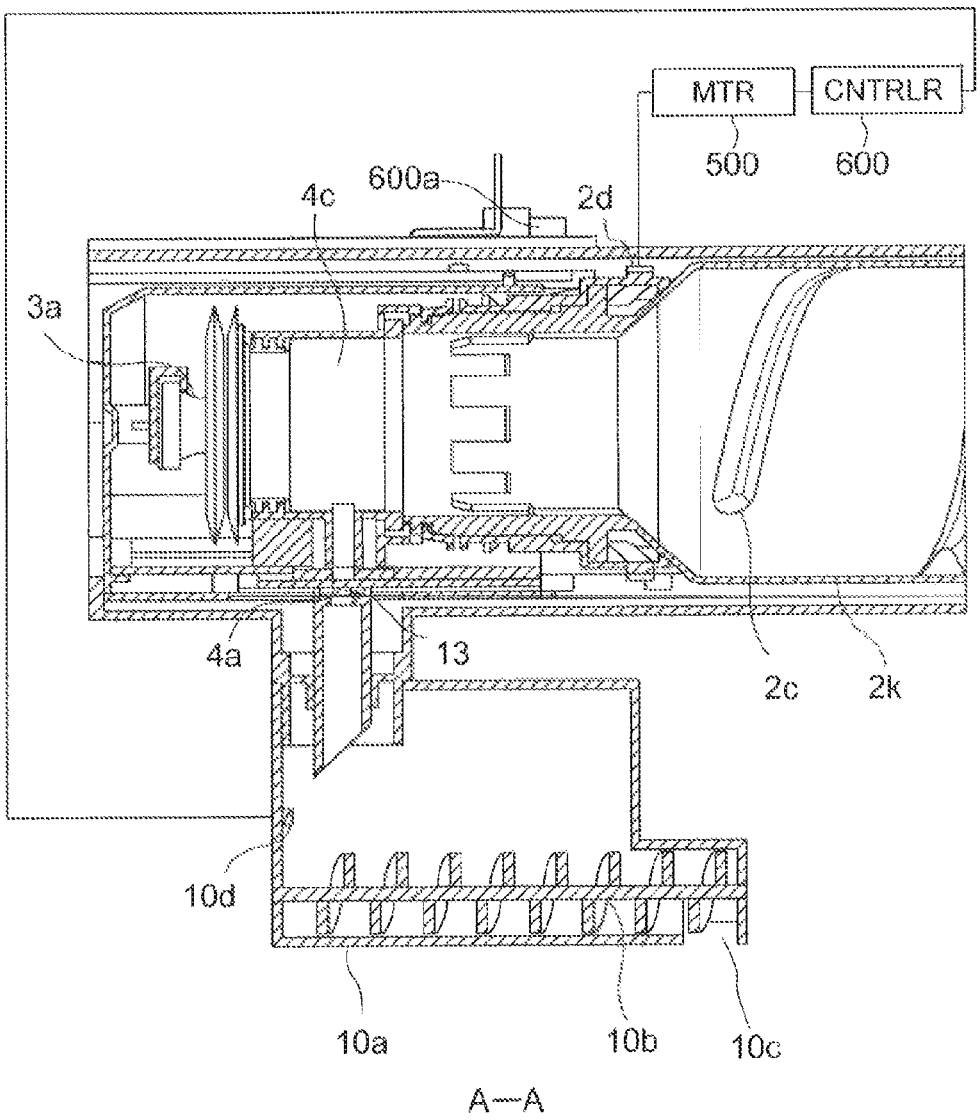
FIG. 5 is an enlarged sectional view illustrating a developer supply container and the developer replenishing apparatus.
Figure 6:
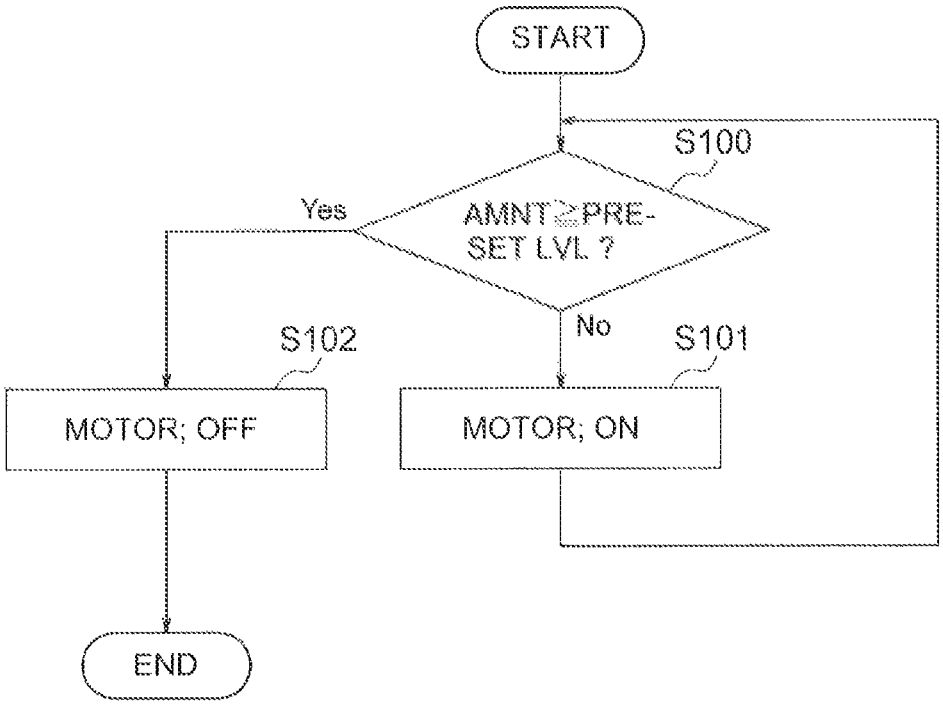
FIG. 6 is a flow chart illustrating a flow of a developer supply operation.

FIG. 5 is partly enlarged sectional views of a control system, the developer supply container 1 and the developer replenishing apparatus 201. FIG. 6 is a flow chart illustrating a flow of developer supply operation by the control system.

As shown in FIG. 1, the developer replenishing apparatus 201 comprises the mounting portion (mounting space) 10, to which the developer supply container 1 is mounted demountably, a hopper 10*a* for storing temporarily the developer discharged from the developer supply container 1, and the developing device 201*a* 999 and the9. As shown in FIG. 4, the developer supply container 1 is mountable in a direction indicated by an arrow M to the mounting portion 10. Thus, a longitudinal direction (rotational axis direction) of the developer supply container 1 is substantially the same as the direction of arrow M. The direction of arrow M is substantially parallel with a direction indicated by X of part (a) of FIG. 10 which will be described hereinafter. In addition, a dismounting direction of the developer supply container 1 from the mounting portion 10 is opposite the direction (inserting direction) of the arrow M.

As shown in FIGS. 1 and 2, the developing device 201*a* comprises a developing roller 201*f*, a stirring member 201*c*, and feeding members 201*d* and 201*e*. The developer supplied from the developer supply container 1 is stirred by the stirring member 201*c*, is fed to the developing roller 201*f* by the magnet roller 201*d* and the feeding member 201*e*, and is supplied to the photosensitive member 104 by the developing roller 201*f*.

A developing blade 201 *g* for regulating an amount of developer coating on the roller is provided relative to the developing roller 201*f*, and a leakage preventing sheet 201*h* is provided contacted to the developing roller 201*f* to prevent leakage of the developer between the developing device 201*a* and the developing roller 201*f*.

As shown in FIG. 3, the mounting portion 10 is provided with a rotating direction regulating portion (holding mechanism) 11 for limiting movement of the flange portion 4 in the rotational moving direction by abutting to a flange portion 4 (FIG. 8) of the developer supply container 1 when the developer supply container 1 is mounted.

Furthermore, the mounting portion 10 is provided with a developer receiving port (developer reception hole) 13 for receiving the developer discharged from the developer supply container 1, and the developer receiving port is brought into fluid communication with a discharge opening (discharging port) 4*a* (FIG. 8) of the developer supply container 1 which will be described hereinafter, when the developer supply container 1 is mounted thereto. The developer is supplied from the discharge opening 4*a* of the developer supply container 1 to the developing device 201*a* through the developer receiving port 13. In this embodiment, a diameter ϕ of the developer receiving port 13 is approx. 3 mm (pin hole), for the purpose of preventing as much as possible the contamination by the developer in the mounting portion 10. The diameter of the developer receiving port may be any if the developer can be discharged through the discharge opening 4*a*.

As shown in FIG. 5, the hopper 10*a* comprises a feeding screw 10*b* for feeding the developer to the developing device 201*a* an opening 10*c* in fluid communication with the developing device 201*a* and a developer sensor 10*d* for detecting an amount of the developer accommodated in the hopper 10*a*.

As shown in FIG. 3, the mounting portion 10 is provided with a driving gear 300 functioning as a driving mechanism (driver). The driving gear 300 receives a rotational force from a driving motor 500 (unshown) through a driving gear train, and functions to apply a rotational force to the developer supply container 1 which is set in the mounting portion 10.

As shown in FIG. 5, the driving motor 500 is controlled by a control device CPU (unshown). As shown in FIG. 5, the control device 600 controls the operation of the driving motor 500 on the basis of information indicative of a developer remainder inputted from the developer sensor 10*d*.

In this embodiment, the driving gear 300 is rotatable unidirectionally to simplify the control for the driving motor 500. The control device 600 controls only ON (operation) and OFF (non-operation) of the driving motor 500. This simplifies the driving mechanism for the developer replenishing apparatus 201 as compared with a structure in which forward and backward driving forces are provided by periodically rotating the driving motor 500 (driving gear 300) in the forward direction and backward direction.

(Mounting/Dismounting Method of Developer Supply Container)

The description will be made as to mounting/dismounting method of the developer supply container 1.

First, the operator opens an exchange cover (unshown) and inserts and mounts the developer supply container 1 to a mounting portion 10 of the developer replenishing apparatus 201*ay* the mounting operation, the flange portion 4 of the developer supply container 1 is held and fixed in the developer replenishing apparatus 201.

Thereafter, the operator closes the exchange cover to complete the mounting step. Thereafter, the control device 600 controls the driving motor 500, by which the driving gear 300 rotates at proper timing.

On the other hand, when the developer supply container 1 becomes empty, the operator opens the exchange cover and takes the developer supply container 1 out of the mounting portion 10. The operator inserts and mounts a new developer supply container 1 prepared beforehand and closes the exchange cover, by which the exchanging operation from the removal to the remounting of the developer supply container 1 is completed.

(Developer Supply Control by Developer Replenishing Apparatus)

Referring to a flow chart of FIG. 6, a developer supply control by the developer replenishing apparatus 201 will be described. The developer supply control is executed by controlling various equipment by the control device (CPU) 600.

In this embodiment, the control device 600 controls the operation/non-operation of the driving motor 500 in accordance with an output of the developer sensor 10*d* by which the developer is not accommodated in the hopper 10*a* beyond a predetermined amount.

More particularly, first, the developer sensor 10*d* checks the accommodated developer amount in the hopper 10*a*

(S100). When the accommodated developer amount detected by the developer sensor 10*d* is discriminated as being less than a predetermined amount, that is, when no developer is detected by the developer sensor 10*d*, the driving motor 500 is actuated to execute a developer supplying operation for a predetermined time period (S101).

The accommodated developer amount detected with developer sensor 10*d* is discrimination ed as having reached the predetermined amount, that is, when the developer is detected by the developer sensor 10*d*, as a result of the developer supplying operation, the driving motor 500 is deactuated to stop the developer supplying operation (S102). By the stop of the supplying operation, a series of developer supplying steps is completed.

Such developer supplying steps are carried out repeatedly whenever the accommodated developer amount in the hopper 10*a* becomes less than a predetermined amount as a result of consumption of the developer by the image forming operations.

The structure may be such that the developer discharged from the developer supply container 1 is stored temporarily in the hopper 10*a*, and then is supplied into the developing device 201*a*. More specifically, the following structure of the developer replenishing apparatus 201 can be employed.

Figure 7:
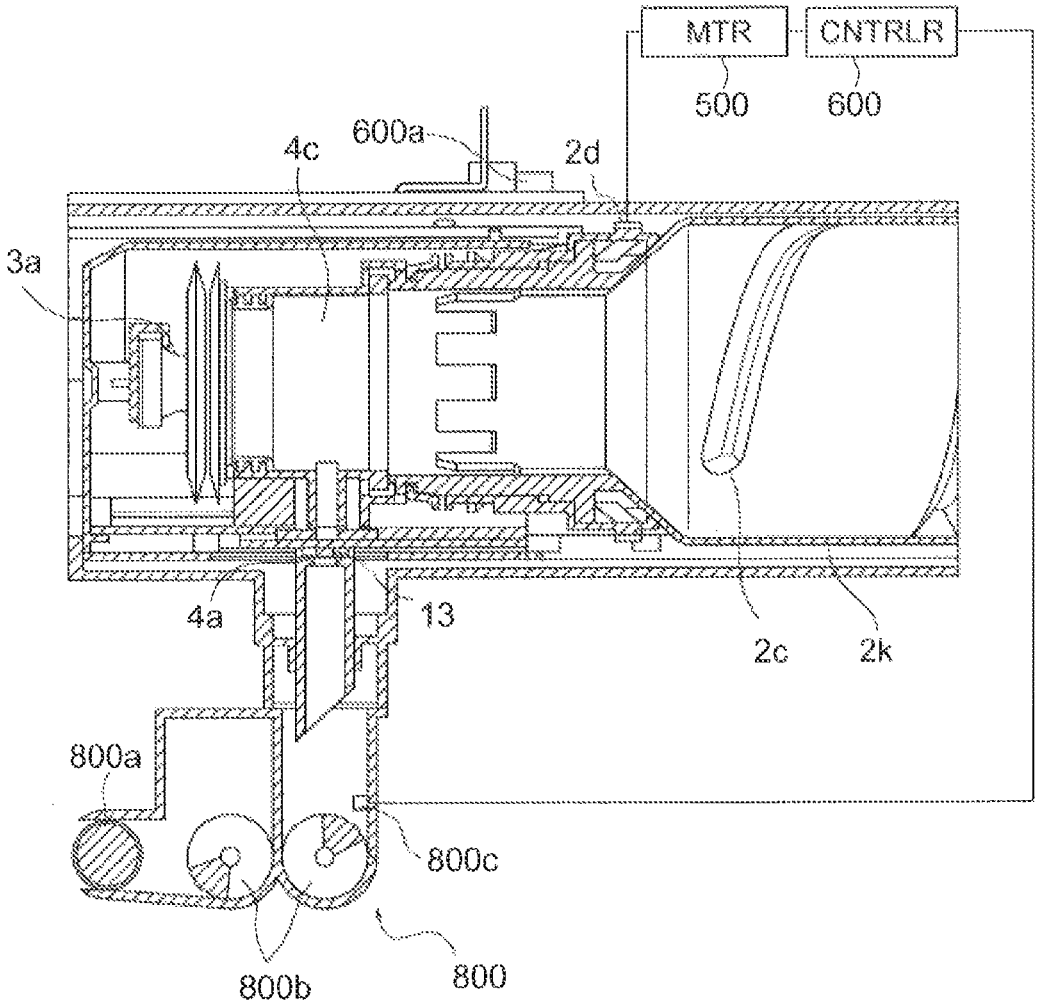
FIG. 7 is an enlarged sectional view of a modified example of the developer replenishing apparatus.

As shown in FIG. 7, the above-described hopper 10*a* is omitted, and the developer is supplied directly into the developing device 201*a* from the developer supply container 1. FIG. 7 shows an example using a two component developing device 800 as a developer replenishing apparatus 201. The developing device 800 comprises a stirring chamber into which the developer is supplied, and a developer chamber for supplying the developer to the developing sleeve 800*a*, wherein the stirring chamber and the developer chamber are provided with stirring screws 800*b* rotatable in such directions that the developer is fed in the opposite directions from each other. The stirring chamber and the developer chamber are communicated with each other in the opposite longitudinal end portions, and the two component developer are circulated the two chambers. The stirring chamber is provided with a magnetometric sensor 800*c* for detecting a toner content of the developer, and on the basis of the detection result of the magnetometric sensor 800*c*, the control device 600 controls the operation of the driving motor 500. In such a case, the developer supplied from the developer supply container is non-magnetic toner or non-magnetic toner plus magnetic carrier.

In this embodiment, as will be described hereinafter, the developer in the developer supply container 1 is hardly discharged through the discharge opening 4*a* only by the gravitation, but the developer is discharged by a volume changing operation of a pump portion 3*b*, and therefore, variation in the discharge amount can be suppressed. Therefore, the developer supply container 1 which will be described hereinafter is usable for the example of FIG. 5 lacking the hopper 10*a*, and the supply of the developer into the developing chamber is stable with such a structure.

(Developer Supply Container)

Referring to FIGS. 8, 9 and 10, the structure of the developer supply container 1 which is a constituent-element of the developer supplying system will be described. Part (a) of FIG. 8 is a perspective view illustrating the developer supply container according to Embodiment 1 of the present invention, (b) is a partial enlarged view illustrating a state around a discharge opening, and (c) is a front view illustrating a state in which the developer supply container is mounted to the mounting portion of the developer supplying apparatus. FIG. 9 is a perspective view of a section of the developer supply container. Part (a) of FIG. 10 is a partially sectional view in a state in which the pump portion 3*a* is expanded to the maximum usable limit, and (b) is a partially sectional view in a state in which the pump portion 3*a* is contracted to the maximum usable limit.

As shown in part (a) of FIG. 8, the developer supply container 1 includes a developer accommodating portion 2 (container body) having a hollow cylindrical inside space for accommodating the developer. In this embodiment, a cylindrical portion 2*k*, the discharging portion 4*c* and the pump portion 3*b* (FIG. 7) function as the developer accommodating portion 2. Furthermore, the developer supply container 1 is provided with a flange portion 4 (non-rotatable portion) at one end of the developer accommodating portion 2 with respect to the longitudinal direction (developer feeding direction). The cylindrical portion 2 is rotatable relative to the flange portion 4. A cross-sectional configuration of the cylindrical portion 2*k* may be non-circular as long as the non-circular shape does not adversely affect the rotating operation in the developer supplying step. For example, it may be oval configuration, polygonal configuration or the like.

In this embodiment, as shown in part (a) of FIG. 10, a total length L1 of the cylindrical portion 2*k* functioning as the developer accommodating chamber is approx. 460 mm, and an outer diameter R1 is approx. 60 mm. A length L2 of the range in which the discharging portion 4*c* functioning as the developer discharging chamber is approx. 21 mm. A total length L3 of the pump portion 3*b* (in the state that it is most expanded in the expansible range in use) is approx. 29 mm, and a total length L4 of the pump portion 3*a* (in the state that it is most contracted in the expansible range in use) is approx. 24, as shown in part (b) of FIG. 10.

As shown in FIGS. 7, 8, in this example, in the state that the developer supply container 1 is mounted to the developer replenishing apparatus 201, the cylindrical portion 2*k* and the discharging portion 4*c* are substantially on line along a horizontal direction. That is, the cylindrical portion 2*k* has a sufficiently long length in the horizontal direction as compared with the length in the vertical direction, and one end part with respect to the horizontal direction is connected with the discharging portion 4*c*. For this reason, an amount of the developer existing above the discharge opening 4*a* which will be described hereinafter can be made smaller as compared with the case in which the cylindrical portion 2*k* is above the discharging portion 4*c* in the state that the developer supply container 1 is mounted to the developer replenishing apparatus 201. Therefore, the developer in the neighborhood of the discharge opening 4*a* is less compressed, thus accomplishing smooth suction and discharging operation.

(Material of Developer Supply Container)

In this embodiment, as will be described hereinafter, the developer is discharged through the discharge opening 4*a* by changing an internal volume of the developer supply container 1 by the pump portion 3*a*. Therefore, the material of the developer supply container 1 is preferably such that it provides an enough rigidity to avoid collision or extreme expansion against the volume change.

In addition, in this embodiment, the developer supply container 1 is in fluid communication with an outside only through the discharge opening 4*a*, and is sealed except for the discharge opening 4*a*. Such a hermetical property as is enough to maintain a stabilized discharging performance in the discharging operation of the developer through the discharge opening 4*a* is provided by the decrease and increase of the volume of developer supply container 1 by the pump portion 3*a*.

Under the circumstances, this embodiment employs polystyrene resin material as the materials of the developer accommodating portion 2 and the discharging portion 4*c* and employs polypropylene resin material as the material of the pump portion 3*a*.

As for the material for the developer accommodating portion 2 and the discharging portion 4*c*, other resin materials such as ABS (acrylonitrile, butadiene, styrene copolymer resin material), polyester, polyethylene, polypropylene, for example are usable if they have enough durability against the volume change. Alternatively, they may be metal.

As for the material of the pump portion 3*a*, any material is usable if it is expansible and contractable enough to change the internal pressure of the developer supply container 1 by the volume change. The examples includes thin formed ABS (acrylonitrile, butadiene, styrene copolymer resin material), polystyrene, polyester, polyethylene materials. Alternatively, other expandable-and-contractable materials such as rubber are usable.

They may be integrally molded of the same material through an injection molding method, a blow molding method or the like if the thicknesses are properly adjusted for the pump portion 3*a*, developer accommodating portion 2 and the discharging portion 3*h*, respectively.

In the following, the description will be made as to the structures of the flange portion 4, the cylindrical portion 2*k*, the pump portion 3*a*, the drive receiving mechanism 2*d*, a drive converting mechanism 2*e* (cam groove).

(Flange Portion)

As shown in FIG. 9, the flange portion 4 is provided with a hollow discharging portion (developer discharging chamber) 4*c* for temporarily storing the developer having been fed from the cylindrical portion 2*k* (in the developer accommodating chamber). A bottom portion of the discharging portion 4*c* is provided with the small discharge opening 4*a* for permitting discharge of the developer to the outside of the developer supply container 1, that is, for supplying the developer into the developer replenishing apparatus 201. The size of the discharge opening 4*a* will be described hereinafter.

The flange portion 4 is provided with a shutter 4*b* for opening and closing the discharge opening 4*a*. The shutter 4*b* is provided at a position such that when the developer supply container 1 is mounted to the mounting portion 10, it is abutted to an abutting portion 21 (see FIG. 3) provided in the mounting portion 10. Therefore, the shutter 4*b* slides relative to the developer supply container 1 in the rotational axis direction (opposite from the arrow M direction) of the cylindrical 2*k* with the mounting operation of the developer supply container 1 to the mounting portion 10. As a result, the discharge opening 4*a* is exposed through the shutter 4*b*, thus completing the unsealing operation.

At this time, the discharge opening 4*a* is positionally aligned with the developer receiving port 13 of the mounting portion 10, and therefore, they are brought into fluid communication with each other, thus enabling the developer supply from the developer supply container 1.

The flange portion 4 is constructed such that when the developer supply container 1 is mounted to the mounting portion 10 of the developer replenishing apparatus 201, it is stationary substantially.

More particularly, a rotation regulating portion 11 shown in FIG. 3 is provided so that the flange portion 4 does not rotate in the rotational direction of the cylindrical portion 2*k*.

Therefore, in the state that the developer supply container 1 is mounted to the developer replenishing apparatus 201, the discharging portion 3*h* provided in the flange portion 3 is prevented substantially in the movement of the cylindrical portion 2*k* in the rotational moving direction (movement within the play is permitted).

On the other hand, the cylindrical portion 2*k* is not limited in the rotational moving direction by the developer replenishing apparatus 201, and therefore, is rotatable in the developer supplying step.

In addition, as shown in as shown in part (a) of FIG. 10, a partition wall 6 in the form of a plate is provided to feed the developer fed from the cylindrical portion 2*k* by a helical projection (feeding portion) 2*c* to the discharging portion 4*c*. The partition wall 6 divides a part region of the developer accommodating portion 2 into substantially two parts, and integrally rotatable with the cylindrical portion 2*k*. The partition wall 6 is provided on each of the sides thereof with a plurality of inclination projection 6*a* inclined relative to the rotational axis direction of the developer supply container 1. The inclined projection 6*a* is connected with an entrance portion of the discharging portion 4*c*. Therefore, the developer fed by the feeding portion 2*c* is scooped up by the plate-like feeding member 6 in interrelation with the rotation of the cylindrical portion 2*k*. Thereafter, with the further rotation of the cylindrical portion 2*k*, the developer slides down on the surface of the partition wall 6 by the gravity, and sooner or later, the developer is transferred to the discharging portion 4*c* by the inclined projections 6*a*. The inclined projections 6*a* are provided on each of the sides of the partition wall 6 so that the developer in the developer accommodating portion is fed into the discharging portion 4*c* for each half of the full-turn of the cylindrical portion 2*k*.

(Discharge Opening of Flange Portion)

In this embodiment, the size of the discharge opening 4*a* of the developer supply container 1 is so selected that in the orientation of the developer supply container 1 for supplying the developer into the developer replenishing apparatus 201, the developer is not discharged to a sufficient extent, only by the gravitation. The developer may be mainly one-component magnetic toner, one-component non-magnetic toner, two-non-magnetic toner or two component magnetic carrier. The opening size of the discharge opening 4*a* is so small that the discharging of the developer from the developer supply container is insufficient only by the gravitation, and therefore, the opening is called pin hole hereinafter. In other words, the size of the opening is determined such that the discharge opening 4*a* is substantially clogged. This is expectedly advantageous in the following points.

(1) the developer does not easily leak through the discharge opening 4*a*.

(2) excessive discharging of the developer at time of opening of the discharge opening 4*a* can be suppressed.

(3) the discharging of the developer can rely dominantly on the discharging operation by the pump portion 3*a*.

By reducing the size of the discharge opening 4*a*, the following effects are provided, too.

By supplying the developer into the image forming apparatus, the developer or deposited on the peripheral portions of the discharge opening 4*a* of the developer supply container 1 and the developer receiving port 13. Therefore, with the increase of the size of the discharge opening 4*a*, the circumferential length of the edge of the opening increases with the result of an enlargement of the area in which the developer is deposited, thus increasing the contamination. Thus, it is effective to reduce the size of the discharge opening 4*a* to suppress the contamination.

In this embodiment, the size of the discharge opening 4*a* of the developer supply container 1 is not more than ϕ4 mm (12.6 mm^2 in area). By employing the fine hole (pin hole), the amount of the developer and deposited on the discharge opening 4*a* of the developer supply container 1 and in the image forming apparatus in the supply of the developer into the image forming apparatus is reduced.

On the other hand, the lower limit value of the size of the discharge opening 4*a* is preferably such that the developer to be supplied from the developer supply container 1 (one component magnetic toner, one component non-magnetic toner, two component non-magnetic toner or two component magnetic carrier) can at least pass therethrough. More particularly, the discharge opening is preferably larger than a particle size of the developer (volume average particle size in the case of toner, number average particle size in the case of carrier) contained in the developer supply container 1. For example, in the case that the supply developer comprises two component non-magnetic toner and two component magnetic carrier, it is preferable that the discharge opening is larger than a larger particle size, that is, the number average particle size of the two component magnetic carrier.

Specifically, in the case that the supply developer comprises two component non-magnetic toner having a volume average particle size of 5.5 μm and a two component magnetic carrier having a number average particle size of 40 μm, the diameter of the discharge opening 4*a* is preferably not less than 0.05 mm (0.002 $mm^2$ in the opening area).

If, however, the size of the discharge opening 4*a* is too close to the particle size of the developer, the energy required for discharging a desired amount from the developer supply container 1, that is, the energy required for operating the pump portion 3*a* is large. It may be the case that a restriction is imparted to the manufacturing of the developer supply container 1. In order to mold the discharge opening 4*a* in a resin material part using an injection molding method, a metal mold part for forming the discharge opening 4*a* is used, and the durability of the metal mold part will be a problem. From the foregoing, the diameter ϕ of the discharge opening 4*a* is preferably not less than 0.5 mm.

In this embodiment, the configuration of the discharge opening 4*a* is circular, but this is not inevitable.

However, a circular discharge opening has a minimum circumferential edge length among the configurations having the same opening area, the edge being contaminated by the deposition of the developer. Therefore, the amount of the developer dispersing with the opening and closing operation of the shutter 4*b* is small, and therefore, the contamination is decreased. In addition, with the circular discharge opening, a resistance during discharging is also small, and a discharging property is high. Therefore, the configuration of the discharge opening 4*a* is preferably circular which is excellent in the balance between the discharge amount and the contamination prevention.

In this embodiment, on the basis of the foregoing investigation, the discharge opening 4*a* is circular, and the diameter ϕ of the opening is 2 mm.

In this embodiment, the number of discharge openings 4*a* is one, but this is not inevitable, and a plurality of discharge openings 4*a*, if the respective opening areas satisfy the above-described range. For example, in place of one developer receiving port 13 having a diameter ϕ of 3 mm, two discharge openings 4*a* each having a diameter ϕ of 0.7 mm are employed. However, in this case, the discharge amount of the developer per unit time tends to decrease, and therefore, one discharge opening 4*a* having a diameter ϕ of 2 mm is preferable.

(Cylindrical Portion)

Referring to FIGS. 7 and 8, the cylindrical portion 2*k* functioning as the developer accommodating chamber will be described.

As soon in FIGS. 7 and 8, an inner surface of the cylindrical portion 2*k* is provided with a feeding portion 2*c* which is projected and extended helically, the feeding portion 2*c* functioning as a feeding means for feeding the developer accommodated in the developer accommodating portion 2 toward the discharging portion 4*c* (discharge opening 4*a*) functioning as the developer discharging chamber, with rotation of the cylindrical portion 2*k*.

The cylindrical portion 2*k* is formed by a blow molding method from an above-described resin material.

In order to increase a filling capacity by increasing the volume of the developer supply container 1, it would be considered that the height of the flange portion 4 as the developer accommodating portion 2 is increased to increase the volume thereof. However, with such a structure, the gravitation to the developer adjacent the discharge opening 4*a* increases due to the increased weight of the developer. As a result, the developer adjacent the discharge opening 3*a* tends to be compacted with the result of obstruction to the suction/discharging through the discharge opening 4*a*. In this case, in order to loosen the developer compacted by the suction through the discharge opening 4*a* or in order to discharge the developer by the discharging, the volume change of the pump portion 3*a* has to be increased. As a result, the driving force for driving the pump portion 3*a* has to be increased, and the load to the main assembly of the image forming apparatus 100 may be increased to an extreme extent.

In this embodiment, the cylindrical portion 2*k* extends in the horizontal direction from the flange portion 4, and therefore, the thickness of the developer layer on the discharge opening 4*a* in the developer supply container 1 can be made small as compared with the above-described high structure. By doing so, the developer does not tend to be compacted by the gravitation, and therefore, the developer can be discharged stably without large load to the main assembly of the image forming apparatus 100.

As shown in part (a) and part (b) of FIG. 10, the cylindrical portion 2*k* is fixed rotatably relative to the flange portion 4 with a flange seal 5*b* of a ring-like sealing member provided on the inner surface of the flange portion 4 being compressed.

By this, the cylindrical portion 2*k* rotates while sliding relative to the flange seal 5*b*, and therefore, the developer does not leak out during the rotation, and a hermetical property is provided. Thus, the air can be brought in and out through the discharge opening 4*a*, so that desired states of the volume change of the developer supply container 1 during the developer supply can be accomplished.

(Pump Portion)

Referring to FIGS. 9 and 10, the description will be made as to the pump portion (reciprocable pump) 2*b* in which the volume thereof changes with reciprocation. Part (a) of FIG. 10 is a perspective view of a section of the developer supply container, and part (b) of FIG. 10 is a partially sectional view in a state in which the pump portion is expanded to the maximum usable limit, and (c) is a partially sectional view in a state in which the pump portion is contracted to the maximum usable limit.

The pump portion 3*a* of this embodiment functions as a suction and discharging mechanism for repeating the sucking operation and the discharging operation alternately through the discharge opening 3*a*. In other words, the pump portion 3*a* functions as an air flow generating mechanism for generating repeatedly and alternately air flow into the developer supply container and air flow out of the developer supply container through the discharge opening 4*a*.

As shown in part (a) of FIG. 10, the pump portion 3*a* is provided at a position away from the discharging portion 4*c* in a direction X. Thus, the pump portion 3*a* does not rotate in the rotational direction of the cylindrical portion 2*k* together with the discharging portion 4*c*.

The pump portion 3*a* of this embodiment is capable of accommodating the developer therein. The developer accommodating space of the pump portion 3*a* plays an important function for the fluidization of the developer in the suction operation, as will be described hereinafter.

In this embodiment, the pump portion 3*a* is a displacement type pump (bellow-like pump) of resin material in which the volume thereof changes with the reciprocation. More particularly, as shown in FIGS. 9 and 10, the bellow-like pump includes crests and bottoms periodically and alternately. The pump portion 2*b* repeats the compression and the expansion alternately by the driving force received from the developer replenishing apparatus 201. In this embodiment, the volume change by the expansion and contraction is 5 cm^3 (cc). The length L3 (part (a) of FIG. 7 10 is approx. 29 mm, the length L4 (part (b) of FIG. 10) is approx. 24 mm. The outer diameter R2 of the pump 3*a* is approx. 45 mm.

Using the pump portion 3*a* of such a structure, the volume of the developer supply container 1 can be alternately changed repeatedly at predetermined intervals. As a result, the developer in the discharging portion 4*c* can be discharged efficiently through the small diameter discharge opening 4*a* (diameter of approx. 2 mm).

(Drive Receiving Mechanism)

The description will be made as to a drive receiving mechanism (drive receiving portion, driving force receiving portion) of the developer supply container 1 for receiving the rotational force for rotating feeding portion 2*c* from the developer replenishing apparatus 201.

As shown in part (a) of FIG. 8, the developer supply container 1 is provided with a gear portion 2*a* which functions as a drive receiving mechanism (drive receiving portion, driving force receiving portion) engageable (driving connection) with a driving gear 300 (functioning as driving mechanism) of the developer replenishing apparatus 201. The gear portion 2*d* and the cylindrical portion 2*k* are integrally rotatable.

Therefore, the rotational force inputted to the gear portion 2*d* from the driving gear 300 is transmitted to the pump 3*a* through a reciprocation member 3*b* shown in part (a) and (b) of FIG. 11, as will be described in detail hereinafter.

The bellow-like pump portion 3*a* of this embodiment is made of a resin material having a high property against torsion or twisting about the axis within a limit of not adversely affecting the expanding-and-contracting operation.

In this embodiment, the gear portion 2*d* is provided at one longitudinal end (developer feeding direction) of the cylindrical portion 2*k*, but this is not inevitable, and the gear portion 2*a* may be provided at the other longitudinal end side of the developer accommodating portion 2, that is, the trailing end portion. In such a case, the driving gear 300 is provided at a corresponding position.

In this embodiment, a gear mechanism is employed as the driving connection mechanism between the drive receiving portion of the developer supply container 1 and the driver of the developer replenishing apparatus 201, but this is not inevitable, and a known coupling mechanism, for example is usable. More particularly, in such a case, the structure may be such that a non-circular recess is provided as a drive receiving portion, and correspondingly, a projection having a configuration corresponding to the recess as a driver for the developer replenishing apparatus 201, so that they are in driving connection with each other.

(Drive Converting Mechanism)

A drive converting mechanism (drive converting portion) for the developer supply container 1 will be described. In this embodiment, a cam mechanism is taken as an example of the drive converting mechanism.

The developer supply container 1 is provided with the cam mechanism which functions as the drive converting mechanism (drive converting portion) for converting the rotational force for rotating the feeding portion 2*c* received by the gear portion 2*d* to a force in the reciprocating directions of the pump portion 3*a*.

In this embodiment, one drive receiving portion (gear portion 2*d*) receives the driving force for rotating the feeding portion 2*c* and for reciprocating the pump portion 3*a*, and the rotational force received by converting the rotational driving force received by the gear portion 2*d* to a reciprocation force in the developer supply container 1 side.

Because of this structure, the structure of the drive receiving mechanism for the developer supply container 1 is simplified as compared with the case of providing the developer supply container 1 with two separate drive receiving portions. In addition, the drive is received by a single driving gear of developer replenishing apparatus 201, and therefore, the driving mechanism of the developer replenishing apparatus 201 is also simplified.

Part (a) of FIG. 11 is a partial view in a state in which the pump portion is expanded to the maximum usable limit, (b) is a partial view in a state in which the pump portion is contracted to the maximum usable limit, and (c) is a partial view of the pump portion. As shown in part (a) of FIG. 11 and part (b) of FIG. 11, the used member for converting the rotational force to the reciprocation force for the pump portion 3*a* is the reciprocation member 3*b*. More specifically, it includes a rotatable cam groove 2*e* extended on the entire circumference of the portion integral with the driven receiving portion (gear portion 2*d*) for receiving the rotation from the driving gear 300. The cam groove 2*e* will be described hereinafter. The cam groove 2*e* is engaged with an reciprocation member engaging projection projected from the reciprocation member 3*b*. In this embodiment, as shown in part (c) of FIG. 11, the reciprocation member 3*b* is limited in the movement in the rotational moving direction of the cylindrical portion 2*k* by a protecting member rotation regulating portion 3*f* (play will be permitted) so that the reciprocation member 3*b* does not rotate in the rotational direction of the cylindrical portion 2*k*. By the movement in the rotational moving direction limited in this manner, it reciprocates along the groove of the cam groove 2*e* (in the direction of the arrow X shown in FIG. 10 or the opposite direction). A plurality of such reciprocation member engaging projections 3*c* are provided and are engaged with the cam groove 2*e*. More particularly, two reciprocation member engaging projections 3*c* are provided opposed to each other in the diametrical direction of the cylindrical portion 2*k* (approx. 180° opposing).

The number of the reciprocation member engaging projections 3*c* is satisfactory if it is not less than one. However, in consideration of the liability that a moment is produced by the drag force during the expansion and contraction of the pump portion 3*a* with the result of unsmooth reciprocation, the number is preferably plural as long as the proper relation is assured in relation to the configuration of the cam groove 2*e* which will be described hereinafter.

In this manner, by the rotation of the cam groove 2*e* by the rotational force received from the driving gear 300, the reciprocation member engaging projection 3*c* reciprocates in the arrow X direction and the opposite direction along the cam groove 2*e*, by which the pump portion 3*a* repeats the expanded state (part (a) of FIG. 11) and the contracted state (part (b) of FIG. 11) alternately, thus changing the volume of the developer supply container 1.

(Set Conditions of Drive Converting Mechanism)

In this embodiment, the drive converting mechanism effects the drive conversion such that an amount (per unit time) of developer feeding to the discharging portion 4*c* by the rotation of the cylindrical portion 2*k* is larger than a discharging amount (per unit time) to the developer replenishing apparatus 201 from the discharging portion 4*c* by the function of the pump portion.

This is because if the developer discharging power of the pump portion 2*b* is higher than the developer feeding power of the feeding portion 2*c* to the discharging portion 3*h*, the amount of the developer existing in the discharging portion 3*h* gradually decreases. In other words, it is avoided that the time period required for supplying the developer from the developer supply container 1 to the developer replenishing apparatus 201 is prolonged.

In addition, in the drive converting mechanism of this example, the drive conversion is such that the pump portion 3*a* reciprocates a plurality of times per one full rotation of the cylindrical portion 2*k*. This is for the following reasons.

In the case of the structure in which the cylindrical portion 2*k* is rotated inner the developer replenishing apparatus 201, it is preferable that the driving motor 500 is set at an output required to rotate the cylindrical portion 2*k* stably at all times. However, from the standpoint of reducing the energy consumption in the image forming apparatus 100 as much as possible, it is preferable to minimize the output of the driving motor 500. The output required by the driving motor 500 is calculated from the rotational torque and the rotational frequency of the cylindrical portion 2*k*, and therefore, in order to reduce the output of the driving motor 500, the rotational frequency of the cylindrical portion 2*k* is minimized.

However, in the case of this embodiment, if the rotational frequency of the cylindrical portion 2*k* is reduced, a number of operations of the pump portion 3*a* per unit time decreases, and therefore, the amount of the developer (per unit time) discharged from the developer supply container 1 decreases. In other words, there is a possibility that the developer amount discharged from the developer supply container 1 is insufficient to quickly meet the developer supply amount required by the main assembly of the image forming apparatus 100.

If the amount of the volume change of the pump portion 3*a* is increased, the developer discharging amount per unit cyclic period of the pump portion 3*a* can be increased, and therefore, the requirement of the main assembly of the image forming apparatus 100 can be met, but doing so gives rise to the following problem.

If the amount of the volume change of the pump portion 2*b* is increased, a peak value of the internal pressure (positive pressure) of the developer supply container 1 in the discharging step increases, and therefore, the load required for the reciprocation of the pump portion 2*b* increases.

For this reason, in this embodiment, the pump portion 3*a* operates a plurality of cyclic periods per one full rotation of the cylindrical portion 2*k*. By this, the developer discharge amount per unit time can be increased as compared with the case in which the pump portion 3*a* operates one cyclic period per one full rotation of the cylindrical portion 2*k*, without increasing the volume change amount of the pump portion 3*a*. Corresponding to the increase of the discharge amount of the developer, the rotational frequency of the cylindrical portion 2*k* can be reduced.

With the structure of this embodiment, the required output of the driving motor 500 may be low.

(Position of Drive Converting Mechanism)

As shown in FIG. 11, in this embodiment, the drive converting mechanism (cam mechanism constituted by the reciprocation member engaging projection 3*c* and cam groove 2*e*) is provided outside of developer accommodating portion 2. More particularly, the drive converting mechanism is disposed at a position separated from the inside spaces of the cylindrical portion 2*k*, the pump portion 3*a* and the flange portion 4, so that the drive converting mechanism does not contact the developer accommodated inside the cylindrical portion 2*k*, the pump portion 3 and the flange portion 4.

By this, a problem which may arise when the drive converting mechanism is provided in the inside space of the developer accommodating portion 2 can be avoided. More particularly, the problem is that by the developer entering portions of the drive converting mechanism where sliding motions occur, the particles of the developer are subjected to heat and pressure to soften and therefore, they agglomerate into masses (coarse particle), or they enter into a converting mechanism with the result of torque increase. The problem can be avoided.

(Developer Supplying Step)

Referring to FIGS. 11 and 12, a developer supplying step by the pump portion 3*a* will be described.

In this embodiment, as will be described hereinafter, the drive conversion of the rotational force is carries out by the drive converting mechanism so that the suction step by the pump operation (suction operation through discharge opening 4*a*), the discharging step (discharging operation through the discharge opening 4*a*) and the rest step by the non-operation of the pump portion (neither suction nor discharging is effected through the discharge opening 4*a*) are repeated alternately. The suction step, the discharging step and the rest step will be described.

(Suction Step)

First, the suction step (suction operation through discharge opening 4*a*) will be described.

As shown in FIG. 11, the suction operation is effected by the pump portion 3*a* being changed from the most contracted state (part (b) of FIG. 11) to the most expanded state (part (a) of FIG. 11) by the above-described drive converting mechanism (cam mechanism). More particularly, by the suction operation, a volume of a portion of the developer supply container 1 (pump portion 3*a*, cylindrical portion 2*k* and flange portion 4) which can accommodate the developer increases.

At this time, the developer supply container 1 is substantially hermetically sealed except for the discharge opening 4*a*, and the discharge opening 3*a* is plugged substantially by the developer T. Therefore, the internal pressure of the developer supply container 1 decreases with the increase of the volume of the portion of the developer supply container 1 capable of containing the developer T.

At this time, the internal pressure of the developer supply container 1 is lower than the ambient pressure (external air pressure). For this reason, the air outside the developer supply container 1 enters the developer supply container 1 through the discharge opening 4*a* by a pressure difference between the inside and the outside of the developer supply container 1.

At this time, the air is taken-in from the outside of the developer supply container 1, and therefore, the developer T in the neighborhood of the discharge opening 4*a* can be loosened (fluidized). More particularly, the air impregnated into the developer powder existing in the neighborhood of the discharge opening 4*a*, thus reducing the bulk density of the developer powder T and fluidizing.

Since the air is taken into the developer supply container 1 through the discharge opening 4*a*, the internal pressure of the developer supply container 1 changes in the neighborhood of the ambient pressure (external air pressure) despite the increase of the volume of the developer supply container 1.

In this manner, by the fluidization of the developer T, the developer T does not pack or clog in the discharge opening 4*a*, so that the developer can be smoothly discharged through the discharge opening 4*a* in the discharging operation which will be described hereinafter. Therefore, the amount of the developer T (per unit time) discharged through the discharge opening 4*a* can be maintained substantially at a constant level for a long term.

For effecting the sucking operation, it is not inevitable that the pump portion 3*a* changes from the most contracted state to the most expanded state, but the sucking operation is effected if the internal pressure of the developer supply container 1 changes even if the pump portion changes from the most contracted state halfway to the most expanded state. That is, the suction stroke corresponds to the state in which the reciprocation member engaging projection 3*c* is engaged with the cam groove (second operation portion) 2*h* shown in FIG. 12.

(Discharging Stroke)

The discharging step (discharging operation through the discharge opening 4*a*) will be described.

As shown in part (b) of FIG. 12, the discharging operation is effected by the pump portion 3*a* being changed from the most expanded state to the most contracted state. More particularly, by the discharging operation, a volume of a portion of the developer supply container 1 (pump portion 3*a*, cylindrical portion 2*k* and flange portion 4) which can accommodate the developer decreases. At this time, the developer supply container 1 is substantially hermetically sealed except for the discharge opening 4*a*, and the discharge opening 4*a* is plugged substantially by the developer T until the developer is discharged. Therefore, the internal pressure of the developer supply container 1 rises with the decrease of the volume of the portion of the developer supply container 1 capable of containing the developer T.

The internal pressure of the developer supply container 1 is higher than the ambient pressure (the external air pressure). Therefore, the developer T is pushed out by the pressure difference between the inside and the outside of the developer supply container 1. That is, the developer T is discharged from the developer supply container 1 into the developer replenishing apparatus 201.

Also air in the developer supply container 1 is also discharged with the developer T, and therefore, the internal pressure of the developer supply container 1 decreases.

As described in the foregoing, according to this embodiment, the discharging of the developer can be effected efficiently using one reciprocation type pump portion 3*a*, and therefore, the mechanism for the developer discharging can be simplified.

For effecting the discharging operation, it is not inevitable that the pump portion 3*a* changes from the most expanded state to the most contracted state, but the discharging operation is effected if the internal pressure of the developer supply container 1 changes even if the pump portion changes from the most expanded state halfway to the most contracted state. That is, the discharging stroke corresponds to the state in which the reciprocation member engaging projection 3*c* is engaged with the cam groove 2 *g* shown in FIG. 12.

(Rest Stroke)

The rest stroke in which the pump portion 3*a* does not to reciprocate will be described.

In this embodiment, as described hereinbefore, the operation of the driving motor 500 is controlled by the control device 600 on the basis of the results of the detection of the magnetometric sensor 800*c* and/or the developer sensor 10*d*. With such a structure, the amount of the developer discharged from the developer supply container 1 directly influences the toner content of the developer, and therefore, it is necessary to supply the amount of the developer required by the image forming apparatus from the developer supply container 1. At this time, in order to stabilize the amount of the developer discharged from the developer supply container 1, it is desirable that the amount of volume change at one time is constant.

If, for example, the cam groove 2*e* includes only the portions for the discharging stroke and the suction stroke, the motor actuation may stop at halfway of the discharging stroke or suction stroke. After the stop of the driving motor 500, the cylindrical portion 2*k* continues rotating by the inertia, by which the pump portion 3*a* continues reciprocating until the cylindrical portion 2*k* stops, during which the discharging stroke or the suction stroke continues. The distance through which the cylindrical portion 2*k* rotates by the inertia is dependent on the rotational speed of the cylindrical portion 2*k*. Further, the rotational speed of the cylindrical portion 2*k* is dependent on the torque applied to the driving motor 500. From this, the torque to the driving motor 500 changes depending on the amount of the developer in the developer supply container 1, and the speed of the cylindrical portion 2*k* may also change, and therefore, it is difficult to stop the pump portion 3*a* at the same position.

In order to stop the pump portion 3*a* at the same position, a region in which the pump portion 3*a* does not reciprocate even during the rotation of the cylindrical portion 2*k* is required to be provided in the cam groove 2*e*. In this embodiment, for the purpose of preventing the reciprocation of the pump portion 3*a*, there is provided a cam groove 2*i* (FIG. 12). The cam groove 2*i* extends in the rotational moving direction of the cylindrical portion 2*k*, and therefore, the reciprocation member 3*b* does not move despite the rotation (straight shape). That is, the rest stroke corresponds to the reciprocation member engaging projection 3*c* engaging with the cam groove 2*i*.

The non-reciprocation of the pump portion 3*a* means that the developer is not discharged through the discharge opening 4*a* (except for the developer falling through the discharge opening 4*a* due to the vibration or the like during the rotation of the cylindrical portion 2*k*). Thus, if the discharging stroke or suction stroke through the discharge opening 4*a* is not effected, the cam groove 2*i* may be inclined relative to the rotational moving direction toward the rotation axial direction. When the cam groove 2*i* is inclined, the reciprocation of the pump portion 3*a* corresponding to the inclination is permitted.

(Change of Internal Pressure of Developer Supply Container)

Verification experiments were carried out as to a change of the internal pressure of the developer supply container 1. The verification experiments will be described.

The developer is filled such that the developer accommodating space in the developer supply container 1 is filled with the developer; and the change of the internal pressure of the developer supply container 1 is measured when the pump portion 3*a* is expanded and contracted in a range of 5 $cm^3$ of volume change. The internal pressure of the developer supply container 1 is measured using a pressure gauge (AP-C40 available from Kabushiki Kaisha KEYENCE) connected with the developer supply container 1.

FIG. 13 shows a pressure change when the pump portion 3*a* is expanded and contracted in the state that the shutter 4*b* of the developer supply container 1 filled with the developer is open, and therefore, in the communicatable state with the outside air.

In FIG. 13, the abscissa represents the time, and the ordinate represents a relative pressure in the developer supply container 1 relative to the ambient pressure (reference (1 kPa) (+ is a positive pressure side, and – is a negative pressure side).

When the internal pressure of the developer supply container 1 becomes negative relative to the outside ambient pressure by the increase of the volume of the developer supply container 1, the air is taken in through the discharge opening 4*a* by the pressure difference. When the internal pressure of the developer supply container 1 becomes positive relative to the outside ambient pressure by the decrease of the volume of the developer supply container 1, a pressure is imparted to the inside developer. At this time, the inside pressure eases corresponding to the discharged developer and air.

By the verification experiments, it has been confirmed that by the increase of the volume of the developer supply container 1, the internal pressure of the developer supply container 1 becomes negative relative to the outside ambient pressure, and the air is taken in by the pressure difference. In addition, it has been confirmed that by the decrease of the volume of the developer supply container 1, the internal pressure of the developer supply container 1 becomes positive relative to the outside ambient pressure, and the pressure is imparted to the inside developer so that the developer is discharged. In the verification experiments, an absolute value of the negative pressure is approx. 1.2 kPa, and an absolute value of the positive pressure is approx. 0.5 kPa.

As described in the foregoing, with the structure of the developer supply container 1 of this embodiment, the internal pressure of the developer supply container 1 switches between the negative pressure and the positive pressure alternately by the suction operation and the discharging operation of the pump portion 3*a*, and the discharging of the developer is carried out properly.

As described in the foregoing, according to the embodiment, a simple and easy pump portion capable of effecting the suction operation and the discharging operation of the developer supply container 1 is provided, by which the discharging of the developer by the air can be carries out stably while providing the developer loosening effect by the air.

In other words, with the structure of the embodiment, even when the size of the discharge opening 4*a* is extremely small, a high discharging performance can be assured without imparting great stress to the developer since the developer can be passed through the discharge opening 4*a* in the state that the bulk density is small because of the fluidization.

In addition, in this embodiment, the inside of the displacement type pump portion 3*a* is utilized as a developer accommodating space, and therefore, when the internal pressure is reduced by increasing the volume of the pump portion 3*a*, a additional developer accommodating space can be formed. Therefore, even when the inside of the pump portion 3*a* is filled with the developer, the bulk density can be decreased (the developer can be fluidized) by impregnating the air in the developer powder. Therefore, the developer can be filled in the developer supply container 1 with a higher density than in the conventional art.

(Developer Loosening Effect in the Suction Step)

Verification of the developer loosening effect by the suction operation through the discharge opening 4*a* in the suction stroke has been made. When the developer loosening effect by the suction operation through the discharge opening 4*a* is strong, the developer discharging from the developer supply container 1 in the next discharging the stroke can be immediately started with a low discharging pressure (small pump volume change amount). Therefore, the verification will show that the developer loosening effect is remarkably enhanced by the structure of this embodiment. The description will be made in detail.

Part (a) of FIG. 14 and part (a) of FIG. 15 are block diagrams of a developer supplying system used in the verification experiment. Part (b) of FIG. 14 and part (b) of FIG. 15 are schematic views illustrating a phenomenon-in the developer supply container. FIG. 14 corresponds to the type similar to this embodiment, wherein a developer supply container C is provided with a developer accommodating portion C1 and a pump portion P. By the expanding-and-contracting operation of the pump portion P, a suction operation and a discharging operation are alternately carried out through the discharge opening (having a diameter of 2 mm) (unshown) of the developer supply container C, so that the developer is discharged into a hopper H. On the other hand, FIG. 15 corresponds to a type of a comparison example, in which the pump portion P is provided in the developer replenishing apparatus side, and by the expanding-and-contracting operation of the pump portion P, an air-supply operation to the developer accommodating portion C1 and a suction operation from the developer accommodating portion C1 are carried out alternately to discharge the developer into the hopper H. In FIGS. 14 and 15, the developer accommodating portions C1 have the same internal volume, the hoppers H have the same internal volume, and the pump portions P have the same internal volume (volume change amounts).

First, the developer supply container C is filled with 200 g of the developer.

Then, the developer supply container C is vibrated for 15 minutes, simulating the transportation of the developer supply container C, and thereafter, it is connected with the hopper H.

Subsequently, the pump portion P is operated, and a peak value of the internal pressure in the structures drum is measured as a parameter of the suction step required to immediately discharge developer in the discharging stroke. The position with which the volume of the developer accommodating portion C1 is 480 cm^3 in the case of FIG.

14 and the position with which the volume of the hopper H is 480 cm^3 of the operation start positions of the pump portions P.

The experiment with the FIG. 15 structure, the hopper H is filled with 200 g of the developer in order to equalize the air volume condition in FIGS. 14 and 15. The internal pressures of the developer accommodating portion C1 and the hopper H are measured by a pressure gauge (available from Kabushiki Kaisha KEYENCE, AP-C40).

As a result of the verification test, with the type of FIG. 14 which is similar to this embodiment, the developer can be immediately discharged in the next discharging the drum, if the absolute value of the peak value (negative pressure) of the internal pressure in the suction operation is higher than 1.0 kPa. On the other hand, with the comparison example type shown in FIG. 15, the peak value (positive pressure) of the internal pressure in the air-supply operation has to be at least 1.7 kPa to immediately discharge the developer in the next discharging step.

From this, it has been confirmed that with the type of FIG. 14 similar to this embodiment, the developer loosening effect is remarkably high because the suction is carried out with the volume increase of the pump portion P, and therefore, the internal pressure of the developer accommodating portion C1 can be negative pressure which is lower than the ambient pressure (the pressure outside the container). This is because, as shown in part (b) of FIG. 14, by the increase of the volume of the developer accommodating portion C1 with the elongation of the pump portion P, the pressure in the air layer R in the upper portion of the developer layer T is lower than an ambient pressure. Therefore, the decompression functions to expand the volume of the developer layer T (wave line arrow), and therefore, the developer layer can be effectively loosened. With the type of FIG. 14, the air is taken into the developer accommodating portion C1 from the outside by the decompression (white arrow), and also when the air reaches the air layer R, the developer layer T is loosened, and therefore, this type is very preferred.

On the other hand, with the comparison example type shown in FIG. 15, the internal pressure of the developer accommodating portion C1 rises with the air-supply operation into the developer accommodating portion C1 with the result of the positive pressure higher than the ambient pressure, and therefore, the developer tends to agglomerate, and therefore, no developer loosening effect is obtained. This is because, as shown in part (b) of FIG. 15, the air is forced into the developer accommodating portion C1 from the outside, and therefore, the pressure in the air layer R in the upper portion of the developer layer T is higher than the ambient pressure. For this reason, by the pressing function, the volume of the developer layer T tends to contract (wave line arrow), thus compacting the developer layer T. Therefore, with the type of FIG. 15, because of the compacting of the developer layer T, the subsequent developer discharging step is very likely to be improper.

In a attempt to prevent the compacting of the developer layer T resulting from the pressing of the air layer R, it would be considered an air vent filter or the like is provided at the position opposing to the air layer R, thus reducing the pressure rise. However, the air resistance of the filter or the like may result in pressure rise of the air layer R. Even if the pressure rise were eliminated, the above-described loosening effect by the pressure reduction state of the air layer R could not be provided.

From the foregoing, the role of the suction operation through the discharge opening resulting from the volume increase of the pump portion is significant, as in this embodiment in which the direction of the initial operation of the pump portion P after the mounting of the developer supply kit is such a direction that the internal pressure of the developer accommodating portion C1 becomes lower than the ambient pressure.

(Modified Examples of Set Condition of Cam Groove)

Referring to FIG. 12, modified examples of the set condition of the cam groove 2*e* constituting the drive converting portion will be described. FIG. 12 is a developed view of the above described cam groove 2*e*. Referring to the developed view of the drive converting mechanism portion of FIG. 12, the description will be made as to the influence to the operational condition of the pump portion 3*a* when the configuration of the cam groove 3*e* is changed.

Here, in FIG. 12, an arrow A indicates a rotational moving direction of the cylindrical portion 2*k* (moving direction of the cam groove 2*e*); an arrow B indicates the expansion direction of the pump portion 3*a*; and an arrow C indicates a compression direction of the pump portion 3*a*.

In addition, the cam groove 2*e* includes the cam groove 2*g* used when the pump portion 3*a* is compressed, the cam groove 2*h* used when the pump portion 3*a* is expanded, and the pump rest portion 2*i* not reciprocating the pump portion 3*a*.

Furthermore, a angle formed between the cam groove 3 *g* and the rotational moving direction A of the cylindrical portion 2*k* is a; a angle formed between the cam groove 2*h* and the rotational moving direction A is β; and a amplitude (expansion and contraction length of the pump portion 3*a*), in the expansion and contracting directions B, C of the pump 3*a*, of the cam groove is K1 as described above.

First, the description will be made as to the expansion and contraction length K1 of the pump portion 2*b*.

When the expansion and contraction length K1 is shortened, the volume change amount of the pump portion 3*a* decreases, and therefore, the pressure difference from the external air pressure is reduced. Then, the pressure imparted to the developer in the developer supply container 1 decreases, with the result that the amount of the developer discharged from the developer supply container 1 per one cyclic period (one reciprocation, that is, one expansion and contracting operation of the pump portion 3*a*) decreases.

From this consideration, as shown in FIG. 16, the amount of the developer discharged when the pump portion 3*a* is reciprocated once, can be decreased as compared with the structure of FIG. 12, if an amplitude K2 is selected so as to satisfy K2<K1 under the condition that the angles α and β are constant. On the contrary, if K2>K1, the developer discharge amount can be increased.

As regards the angles α and β of the cam groove, when the angles are increased, for example, the movement distance of the reciprocation member engaging projection 3*c* when the developer accommodating portion 2 rotates for a constant time increases if the rotational speed of the cylindrical portion 2*k* is constant, and therefore, as a result, the expansion-and-contraction speed of the pump portion 3*a* increases.

On the other hand, when the reciprocation engaging projection 3*c* moves in the cam grooves 2 *g* and 2*h*, the resistance received from the cam grooves 2 *g* and 2*h* is large, and therefore, a torque required for rotating the cylindrical portion 2*k* increases as a result.

For this reason, as shown in FIG. 17, if the angle α' of the cam groove 2 *g* and the angle β' of the cam groove 2*h* are selected so as to satisfy α'>α and β'>β without changing the expansion and contraction length K1, the expansion-and-contraction speed of the pump portion 3*a* can be increased as compared with the structure of the FIG. 12. As a result, the number of expansion and contracting operations of the pump portion 3*a* per one rotation of the cylindrical portion 2*k* can be increased. Furthermore, since a flow speed of the air entering the developer supply container 1 through the discharge opening 4*a* increases, the loosening effect to the developer existing in the neighborhood of the discharge opening 4*a* is enhanced.

On the contrary, if the selection satisfies $\alpha'<\alpha$ and $\beta'<\beta$, the rotational torque of the cylindrical portion 2*k* can be decreased. When a developer having a high flowability is used, for example, the expansion of the pump portion 3*a* tends to cause the air entered through the discharge opening 4*a* to blow out the developer existing in the neighborhood of the discharge opening 4*a*. As a result, there is a possibility that the developer cannot be accumulated sufficiently in the discharging portion 4*c*, and therefore, the developer discharge amount decreases. In this case, by decreasing the expanding speed of the pump portion 3*a* in accordance with this selection, the blowing-out of the developer can be suppressed, and therefore, the discharging power can be improved.

If, as shown in FIG. 18, the angle of the cam groove 2*e* is selected so as to satisfy $\alpha<\beta$, the expanding speed of the pump portion 3*a* can be increased as compared with a compressing speed. On the contrary, if the angle $\alpha>$the angle $\beta$, the expanding speed of the pump portion 3*a* can be reduced as compared with the compressing speed.

By doing so, when the developer is in a highly packed state, for example, the operation force of the pump portion 3*a* is larger in a compression stroke of the pump portion 3*a* than in a expansion stroke thereof, with the result that the rotational torque for the cylindrical portion 2*k* tends to be higher in the compression stroke of the pump portion 3*a*. However, in this case, if the cam groove 2*e* is constructed as shown in FIG. 18, the developer loosening effect in the expansion stroke of the pump portion 3*a* can be enhanced as compared with the structure of FIG. 12. In addition, the resistance received by the reciprocation member engaging projection 3*c* from the cam groove 2*e* in the compression stroke of the pump portion 3*a* is small, and therefore, the increase of the rotational torque in the compression of the pump portion 3*a* can be suppressed.

As shown in FIG. 18, the cam groove 2*e* may be provided so that the reciprocation member engaging projection 3*c* passes the cam groove 2 *g* immediately after passing the cam groove 2*h*. In such a case, immediately after the sucking operation of the pump portion 3*a*, the discharging operation starts. The stroke of operation stop in the state of the pump portion 3*a* expanding, as shown in FIG. 12 is omitted, and therefore, the pressure reduced state in the developer supply container 1 is not kept during the omitted stopping operation, and therefore, the loosening effect of the developer is decreased. However, the omission of the stopping step increases the discharged amount of the developer T, because the suction and discharging strokes are effected more during one rotation of the cylindrical portion 2*k*.

As shown in FIG. 20, the operation rest stroke (cam groove 2*i*) may be provided halfway in the discharging stroke and the suction stroke other than the most contracted the state of the pump portion 3*a* and the most expanded state of the pump portion 3*a*. By doing so, necessary volume change amount can be selected, and the pressure in the developer supply container 1 can be adjusted.

By changing the configuration of the cam groove 2*e* as shown in FIGS. 12, 16-20, the discharging power of the developer supply container 1 can be ejected, and therefore, the device of this embodiment can meet the developer amount required by the developer supplying apparatus 201 and/or the property of the used developer or the like.

As described in the foregoing, in this embodiment, the driving force for rotating the feeding portion (helical projection 2*c*) and the driving force for reciprocating the pump portion 3*a* are received by a single drive receiving portion (gear portion 2*a*). Therefore, the structure of the drive inputting mechanism of the developer supply container 1 can be simplified. In addition, by the single driving mechanism (driving gear 300) provided in the developer replenishing apparatus 201, the driving force is applied to the developer supply container, and therefore, the driving mechanism for the developer replenishing apparatus 201 can be simplified.

With the structure of the embodiment, the rotational force for rotating the feeding portion received from the developer replenishing apparatus is converted by the drive converting mechanism of the developer supply container, by which the pump portion can be reciprocated properly.

(Physical Properties of Developer)

Next, physical properties of the developer accommodated in the developer supply container will be described.

<Total Energy>

By using the developer supply kit in this embodiment, the developer accommodated in the developer supply container can be properly fed and can be properly discharged.

In this embodiment, by using an index called total energy, it become possible to infer a state of the developer accommodated in the developer supply container from analogy with high accuracy. Incidentally, the total energy is the sum of a rotational torque and a vertical load when a propeller blade is caused to enter a powder layer while being rotated.

Specifically, when the total energy of the developer is small, the developer is dropped when the developer is scooped up by the partition wall 6, so that there is a possibility that the feeding property of the developer in the developer supply container lowers. Further, there is an increasing possibility that member contamination is caused by toner scattering during development. Further, when the total energy of the developer is large, there is a possibility that loosening of the developer by the air in the developer supply container in this embodiment cannot be sufficiently effected and the total energy has the influence on feeding uniformity.

In the developer supply container in this embodiment, the inside developer is loosened by the air. For that reason, values of the total energy in a state in which the developer is not loosened by the air and in a state in which the developer is loosened by the air satisfy the following formulas, so that the feeding property and the discharging property of the developer can be improved and the member contamination by the toner scattering can be suppressed.

$$10 \leq E\ (\mathrm{mJ}) \leq 80 \qquad \text{formula (1)}$$

$$0.4 \leq Ea\ (\mathrm{mJ}) \leq 2.0 \qquad \text{formula (2)}$$

Here, E represents the total energy in a state in which the air is removed from the developer layer, and Ea represents the total energy in a state in which the air is contained in the developer layer to fluidize the developer.

Physical property values of the supply developer used in this embodiment are shown in Table 1.

TABLE 1

| Developer | Constitution | E | Ea |
|---|---|---|---|
| A | TCM*1 | 25 [mJ] | 1.0 [mJ] |
| B | TCM*1 | 22 [mJ] | 0.9 [mJ] |
| C | OCMT*2 | 55 [mJ] | 1.2 [mJ] |
| D | OCMT*2 | 83 [mJ] | 2.2 [mJ] |
| E | OCMT*2 | 8 [mJ] | 0.3 [mJ] |

*1"TCM" is a two-component mixture of a non-magnetic toner and a carrier.

*2"OCMT" is a one-component magnetic toner.

E (mJ) and Ea (mJ) in this embodiment were measured using a powder flowability (flowing property) analyzing equipment "Powder Rheometer FT-4", manufactured by Freeman Technology Corp. (hereinafter abbreviated as "FT-4" in some cases).

Specifically, measurement is made by the following operation.

In all of operations, as the propeller blade, a blade of 23.5 mm in diameter exclusively for FT-4 is used.

As a measuring container, a 25 ml-split container of 25 mm in diameter which is provided exclusively for FT-4 and with which a bottom plate for aeration measurement is connected is used.

Incidentally, the developer left standing for 3 days in an environment of 23° C. in temperature and 60% RH in humidity is filled in the measuring container until the developer reaches an upper surface (about 20 g), so that a developer power layer is formed.

(1) Conditioning Operation (a) The propeller blade is rotated clockwise (in a direction in which the powder layer is loosened by the rotation of the blade) relative to the powder layer surface so that a peripheral speed of the blade at an outermost edge portion is 100 mm/sec. This blade is caused to enter the developer powder layer from the developer layer surface to a position of 5 mm from a bottom of the developer layer at an entering speed at which an angle formed between a locus drawn by the outermost edge portion of the blade during movement and the powder layer surface (hereinafter, abbreviated as a formed angle in some cases) is 5°. Thereafter, a change is made so that the formed angle is 2° and the peripheral speed of the outermost edge portion of the blade is 40 mm/sec, and the blade is caused to enter the developer powder layer to a position of 2 mm from the bottom of the developer powder layer while clockwise rotating the blade relative to the powder layer surface. Further, while clockwise rotating the blade relative to the powder layer surface at the speed at which the formed angle of 5° so that the peripheral speed of the blade at the outermost edge portion is 40 mm/sec, the blade is moved to a position of 55 mm from the bottom of the developer powder layer, and then pulling-out of the blade is made. When the pulling-out of the blade is completed, the blade is alternately rotated clockwise and counterclockwise in a small degree, whereby the developer deposited on the blade is shaken off.

(b) The operation of (1)-(a) is repeated five times, so that the air taken in the developer powder layer is removed.

(2) Split Operation

At a split portion of the above-described container exclusively for FT-4, the developer powder layer is leveled off, so that the developer at an upper portion of the powder layer is removed. By this operation, a volume of the developer powder layer can be made equal every measurement.

(3) Measuring Operation (i) Measurement of E (mJ)

(a): An operation similar to the above (1)-(a) is performed once.

(b): Next, at the blade rotational speed of 100 (mm/sec) and at the speed at which the formed angle of 5° as the blade entering speed into the power layer with respect to a perpendicular direction, the blade is caused to enter the powder layer to the position of 5 mm from the bottom of the toner powder layer in the rotational direction counterclockwise (in a direction in which the developer is subjected to resistance from the powder layer by the rotation of the blade) relative to the powder layer surface.

Thereafter, an operation for causing the blade to enter the position of 2 mm from the bottom of the powder layer in the clockwise direction relative to the powder layer surface at the blade rotational speed of 40 (mm/sec) and at the speed at which the formed angle is 2° as the blade entering speed into the powder layer with respect to the perpendicular direction is performed.

Thereafter, the pulling-out of the blade to the position of 55 mm from the bottom of the powder layer in the clockwise direction relative to the powder layer surface at the blade rotational speed of (mm/sec) and at the speed at which the formed angle is 5° as the blade pulling-out speed from the powder layer with respect to the perpendicular direction is performed. When the pulling-out of the blade is completed, the blade is alternately rotated clockwise and counterclockwise in a small degree, whereby the developer deposited on the blade is shaken off.

(c) The series of operations of the above (b) is repeated seven times.

In the operation of the above (c), the sum of the rotational torque and the vertical load which are obtained when the blade is caused to enter from a position of 100 mm to a position of 10 mm each from the bottom of the developer powder layer when the blade rotational speed in the seventh operation is 100 (mm/sec) is E (mJ).

(ii) Measurement of Ea (mJ)

(a): The developer powder for which the measurement of E (mJ) is ended is placed in an aeration container, and first, the above operation of (1)-(a) is performed once.

(b): Next, the developer powder gradually aerated with dry air through a porous plate provided at a container bottom so that a flow rate is 0.20 (mm/sec). At this time, an aeration unit exclusively for FT-4 measurement is used.

(c): In a state in which the dry air is compatible with the developer, the above operation of (1)-(b) is performed once.

(d): After the operation of the above (c), the sum of the rotational torque and the vertical load which are obtained when the blade is caused to enter from a position of 100 mm to a position of 10 mm each from the bottom of the developer powder layer in a state in which the developer is aerated with the dry air at the flow rate of 0.20 (mm/sec) and when the blade rotational speed in the seventh operation is 100 (mm/sec) is Ea (mJ).

The total energy (mJ) measured by the above FT-4 when the air is not contained and the total energy Ea (mJ) measured by the above FT-4 when the air is contained can indicate ease of loosening of the developer in the developer supply container in this embodiment. In this embodiment, when the developer satisfies $10 \leq E$ (mJ)$\leq 80$ and 0.4 Ea (mJ)$\leq 2.0$, it is possible to ensure flowability of the developer in the developer supply container in this embodiment, so that the feeding property and the discharging property are remarkably improved.

Specifically, values of the total energy of developers A, B, C shown in Table 1 fall under the above ranges. Of these, the developers A, B have the values of both of E and Ea which are lower than those of the developer C. For that reason, the developers A, B obtain a loosening effect by the air more easily than the developer C, and therefore the supplied developer can be maintained in a uniform state. Particularly, in such a system in which there is no hopper 10*a* as shown in FIG. 7, an image density fluctuation can be suppressed by uniform developer supply. Further, the developer C is higher in E and Ea than the developers A, B. For that reason, the developer C has a feeding effect by the partition wall 6 higher than the developers A, B, and therefore even in the case where an amount of consumption of the developer is larger, it is easy to supply the developer in an amount necessary for the image forming apparatus.

In the case where the E measured by the FT-4 is smaller than 10 mJ, when the developer at the time of containing no air is scooped up by the partition wall 6, the developer is dropped from the partition wall 6, so that the developer feeding property becomes worse in some cases. Of the other hand, in the case where the E is larger than 80 mJ, the supplied developer cannot be maintained in the uniform state in some cases, and particularly in the case where the developer is subjected to printing at a low density or the like and thus is used for a long term, the density lowers or the like and thus an image quality cannot be maintained in some cases. Further, the developer is not readily loosened during actuation of the pump after being left standing for the long term in some cases.

In the case where the Ea measured by the FT-4 is smaller than 0.4 mJ, when the developer is discharged from the supply container, the developer scatters and contaminates the neighborhood thereof in some cases. On the other hand, in the case where the Ea is larger than 2.0 mJ, during air suction, the developer in the container cannot be sufficiently loosened, and for that reason, the discharge of the developer becomes difficult in some cases.

Specifically, when the developer D shown in Table 1 is accommodated in the developer supply container in this embodiment, the developer in the container cannot be sufficiently loosened, so that the case where the discharge of the developer became difficult was observed. When the developer E was accommodated in the developer supply container in this embodiment, a lowering in discharge accuracy due to worsening of the developer feeding property and the toner scattering into a peripheral portion during the discharge were observed.

That is, into the developer supply container in this embodiment, by supplying the developer for which E and Ea fall in the suitable ranges, the feeding property and the discharging property of the developer in the developer supply container are remarkably improved.

(Developer Manufacturing Method)

Next, examples of a manufacturing method of the supply developer used in this embodiment are shown below.

<Preparation of Carrier Core>

Magnetite fine particles (number-average particle size: 220 nm, strength of magnetization: 65 $Am^2/kg$) and a silane coupling agent (3-(2-aminoethylaminopropyl)trimethoxysilane (in an amount of 3.0 weight % per a weight of the magnetite fine particles) were introduced in a container. Then, in the container, the mixture was mixed and stirred at high speed, so that the magnetite fine particles were surface-treated.

Then, the following materials:

| | |
|---|---|
| Phenol | 10 weight parts |
| Formaldehylde (36 wt. %-aqueous solution of formaldehyde) | 16 weight parts |
| Surface-treated magnetite fine particles | 86 weight parts |

were placed in a 5000 L (liter)-reaction vessel (magnetite fine particles: 600 kg), and were warmed to 40° C. and then were well mixed. Thereafter, the mixture was heated to a temperature of 85° C. at an average temperature rise rate of 1° C./min. while being stirred, and then 5 weight parts of 25 wt. %-ammonia water and 25 weight parts of water were added into the reaction vessel. The mixture was maintained at the temperature of 85° C. and was subjected to polymerization for 3 hours to be cured. At this time, the peripheral speed of a stirring blade was 3.0 m/sec, and pressure of the reaction vessel was 1500 hPa.

After the polymerization reaction, the temperature was cooled to 40° C. and then water was added. A supernatant liquid was removed, and a resultant precipitate was washed with water and then was air-dried. The resultant air-dried product was dried at a temperature of 60° C. under reduced pressure (5 hPa or less), so that a carrier core of 36.2 μm in average particle size in which a magnetic material was dispersed was obtained.

<Preparation of Magnetic Carrier>

| | |
|---|---|
| Toluene | 110 weight parts |
| The following coated resin material | 12 weight parts |
| Carbon black (manufactured by Tokai Carbon Co., Ltd.: #4400) | 0.6 weight part |
| Melamine particles (manufactured by Nippon Shokubai Co., Ltd.: EPOSTAR S) | 0.6 weight part |

The coated resin material is a graft copolymer of 35 weight parts of methyl methacrylate macromer of 5,000 in weight-average molecular weight and 65 weight parts of cyclohexyl methacrylate monomer including cyclohexyl as a unit and including an ester site, and was 66,000 in weight-average molecular weight and 90° C. in Tg.

The above ingredients were subjected to a stirring and dispersing process for 120 min by using a circulating media mill, so that a resin material-coated layer forming solution 1 was prepared.

For formation of the resin material-coated layer, the resin material-coated layer forming solution 1 and the carrier core were placed in Nauta Mixer (manufactured by Hosokawa Micron Corp.: NX-10 modified so as to be pressure-controllable and be capable of increasing a motor speed, and the carrier core was coated at a stirring speed of 15 m/min, and the coated carrier core was passed through a sieve of 75 μm in aperture, so that a magnetic carrier was prepared. A surface roughness Ra of the magnetic carrier was 22.0 nm.

[Manufacturing Method Embodiment of Supply Developer A]

<Manufacturing Embodiment of Resin Material a (Hybrid Resin Material)>

As source material monomers for polyester-based resin material, 2452 weight parts (7.0 mol) of polyoxypropylene (2,2)-2,2-bis(4-hydroxyphenyl)propane, 977 weight parts (3.0 mol) of polyoxyethylene (2,2)-2,2-bis(4-hydroxyphenyl)propane, 1167 weight parts (7.0 mol) of terephthalic acid, 384 weight parts (2.0 mol) of trimellitic anhydride, and 6.0 weight parts of tin hexanoate were placed in a glass-made 5-litter four-necked flask, and a thermometer, a stirring rod, a condenser and a nitrogen-introducing pipe were mounted, and then the flask was placed in a heating mantle. Then, the inside of the flask was replaced with nitrogen gas, and thereafter the mixture was gradually increased in temperature while being stirred, followed by stirring at 145° C. in temperature.

As materials for a vinyl polymer, 603 weight parts (2.9 mol) of styrene, 335 weight parts (0.91 mol) of 2-ethylhexyl acrylate, 35 weight parts (0.15 mol) of fumaric acid, 14 weight parts (0.03 mol) of a dimer of α-methylstyrene, and 46 weight parts of dicumyl peroxide as a polymerization initiator were placed in a dropping funnel, and were added dropwise into the four-necked flask in 5 hours. Then, temperature rise made for 3.5 hours, so that a hybrid resin material (Resin A) was obtained. A result of molecular weight measurement by GPC (gel permeation chromatography) is shown in Table 2. Incidentally, in Table 2, Mw is a weight-average molecular weight, and Mp is a peak molecular weight.

<Manufacturing Embodiment of Resin Material B (Hybrid Resin Material)>

As source material monomers for polyester-based resin material, 2452 weight parts (7.0 mol) of polyoxypropylene (2,2)-2,2-bis(4-hydroxyphenyl)propane, 977 weight parts (3.0 mol) of polyoxyethylene (2,2)-2,2-bis(4-hydroxyphenyl)propane, 997 weight parts (6.0 mol) of terephthalic acid, 634 weight parts (3.3 mol) of trimellitic anhydride, and 6.0 weight parts of tin hexanoate were placed in a glass-made 5-litter four-necked flask, and a thermometer, a stirring rod, a condenser and a nitrogen-introducing pipe were mounted, and then the flask was placed in a heating mantle. Then, the inside of the flask was replaced with nitrogen gas, and thereafter the mixture was gradually increased in temperature while being stirred, followed by stirring at 145° C. in temperature.

As materials for a vinyl polymer, 702 weight parts (4.5 mol) of styrene, 335 weight parts (1.21 mol) of 2-ethylhexyl acrylate, 26 weight parts (0.15 mol) of fumaric acid, 10.1 weight parts (0.03 mol) of a dimer of α-methylstyrene, and 46 weight parts of dicumyl peroxide as a polymerization initiator were placed in a dropping funnel, and were added dropwise into the four-necked flask in 5 hours. Then, temperature rise made for 4.5 hours, so that a hybrid resin material (Resin B) was obtained. A result of molecular weight measurement by GPC (gel permeation chromatography) is shown in Table 2.

TABLE 2

| | Mw | Mn | Mp |
|---|---|---|---|
| Resin A | 9500 | 1800 | 4200 |
| Resin B | 520000 | 3800 | 9900 |

<Manufacturing Embodiment of Toner A>

| | |
|---|---|
| Resin A | 60 weight parts |
| Cyan Pigment (Pigment Blue 15:3) | 40 weight part |

In the above formulation, melt-kneading was made by a kneader mixer, so that a cyan master batch was prepared.

| | |
|---|---|
| Resin A | 36.2 weight parts |
| Resin B | 44.6 weight parts |
| Paraffin wax (maximum heat-absorption peak: 70° C., M2 = 450, Mn = 320) | 5 weight parts |
| The above cyan master batch (colorant component: 40 wt. %) | 14 weight parts |
| 3,5-di-tert-butyl salicylic acid aluminum compound | 0.2 weight part |

In the above formulation, the ingredients were premixed sufficiently by Henschel mixer and then were melt-kneaded by a biaxial extruding kneader so that a kneaded product temperature is 140° C. After cooling, the kneaded product was roughly pulverized to about 1-2 mm in size by using a hammer mill. Then, using a turbo-mill (RS rotator/SNB liner) manufactured by Freund-Turbo Corp., a finely pulverized product of about 7 μm size was made. Using a surface-modifying processing device 90, spheronization was made simultaneously with a classification, so that cyan particles (toner particles A) were obtained.

With 100 weight parts of the toner particles A, 1.5 weight parts of silica (BET specific surface area: 75 $m^2$) hydrophobized with hexamethylene disilazane (treating amount: 10 weight parts per 100 weight parts of silica fine particles) and dimethyl silicone oil (treating amount: 16 weight parts per 100 weight parts of silica fine particles, and 0.2 weight part of rutile-type titanium oxide fine powder (average primary particle size: 30 nm) hydrophobized with isobutyltrimethyoxysilane (treating amount: 10 weight parts per 100 weight parts of titanium oxide fine particles) were dry-mixed at 66.7 $s^{-1}$ for 5 min. by using the Henschel mixer ("FM10C", manufactured by Nippon Coke & Engineering Co., Ltd., upper blade: Type Y1/lower blade: type So), so that toner A used in this embodiment was obtained.

<Manufacturing Embodiment of Supply Developer A>

100 weight parts of the toner A and 10 weight parts of the magnetic carrier C described in the above Manufacturing Embodiment were mixed using a V-shaped mixer, and were passed through a sieve of 250 μm in aperture, so that a supply developer A used in this embodiment was prepared.

[Manufacturing Method Embodiment of Supply Developer B]

<Manufacturing Embodiment of Toner B>

For 100 weight parts of styrene monomer, 16.5 weight parts of cyan pigment (Pigment Blue 15:3) and 3.0 weight parts of 3,5-di-tert-butyl salicylic acid aluminum compound were prepared. These were introduced in an attritor (manufactured by Nippon Coke & Engineering Co., Ltd.) and were stirred at 3.3 $s^{-1}$ and 25° C. for 180 min. by using zirconia beads (140 weight parts) of 1.25 mm in radius, so that a master batch dispersion liquid was prepared.

On the other hand, 450 weight parts of 0.1M-$Na_3PO_4$ aqueous solution was added to 710 weight parts of ion-exchanged water, and the mixture was warmed to 60° C., and thereafter 67.7 weight parts of 1.0M-$CaCl_2$ aqueous solution was gradually added to the mixture, so that an aqueous medium containing a calcium phosphate compound was obtained.

| | |
|---|---|
| Master batch dispersion liquid | 40 weight parts |
| Styrene monomer | 52 weight parts |
| n-Butylacrylate monomer | 19 weight parts |
| Low-molecular weight polystyrene (Mw = 3,000, Mn = 1,050, Tg = 55° C.) | 15 weight parts |
| Hydrocarbon wax (Fischer-Trapsch wax, maximum heat-absorption peak = 78° C., Mw = 750) | 9 weight parts |
| Polyester resin (acid value = 13 mg KOH/g, hydroxyl value = 20 mgKOH/g, Tg = 70.0° C., Mw = 8,000, Mn = 3,500) | 5 weight parts |

The above ingredients were warmed to 63° C., and were uniformly dissolved and dispersed at 83.3 $s^{-1}$ by using TK-homomixer (manufactured by Tokushu Kika Kogyo K.K.). In this (dispersion), 7.0 weight parts of 70%-toluene solution of 1,1,3,3-tetramethylbutyl-peroxy 2-ethylhexanoate as the polymerization initiator was dissolved, so that a polymerizable monomer composition was prepared.

The above polymerizable monomer composition was added into the aqueous solution described above, and was formed into particles by being stirred at 200 $s^{-1}$ for 10 min. for the TK-homomixer at a temperature of 65° C. and in $N_2$ atmosphere, and thereafter when the temperature thereof was increased to 67° C. while stirring the composition by a paddle stirring blade and a degree of polymerization conversion of the polymerizable monomer composition reached 90%, a 0.1 mol/litter-sodium hydroxide aqueous solution was added, so that pH of the aqueous dispersion medium was adjusted to 9. Further, the temperature was increased to 85° C. at a temperature rising ratio of 40° C./h, followed by reaction for 4 hours. After polymerization reaction was ended, a remaining monomer of the toner particles was distilled off under reduced pressure. After the aqueous medium was cooled, hydrochloric acid was added, so that pH was changed to 1.4, followed by stirring for 6 hours to dissolve the calcium phosphate salt. The toner particles were filtered and washed with water and thereafter was dried at 40° C. for 48 hours, so that toner particles B having cyan color were obtained.

With 100 weight parts of the toner particles B, 1.5 weight parts of silica (BET specific surface area: 75 $m^2$) hydrophobized with dimethyl silicone oil (treating amount: 16 weight parts per 100 weight parts of silica fine particles, and 0.2 weight part of rutile-type titanium oxide fine powder (average primary particle size: 30 nm) hydrophobized with dimethyl silicone oil (treating amount: 7 weight parts per 100 weight parts of silica fine particles) were dry-mixed at 66.7 $s^{-1}$ for 5 min. by using the Henschel mixer ("FM10C", manufactured by Nippon Coke & Engineering Co., Ltd., upper blade: Type Y1/lower blade: type So), so that toner B used in this embodiment was obtained.

[Manufacturing Embodiment Method of Supply Developer C]

<Manufacturing Embodiment of Resin Material C-1>

71.3 weight parts (0.155 mol) of polyoxypropylene (2,2)-2,2-bis(4-hydroxyphenyl)propane, 24.1 weight parts (0.145 mol) of terephthalic acid, and 0.6 weight part of titanium tetrabutoxide were placed in a glass-made 5-liter four-necked flask, and a thermometer, a stirring rod, a condenser and a nitrogen-introducing pipe were mounted, and then the flask was placed in a heating mantle. Then, the inside of the flask was replaced with nitrogen gas, and thereafter the mixture was gradually increased in temperature while being stirred, followed by reaction for 2 hours while stirring the mixture at 200° C. in temperature (first reaction step). Thereafter, 5.8 weight parts (0.030 mol) of trimellitic anhydride was added, followed by reaction at 220° C. for 12 hours (second reaction step), so that a binder resin material C-1 was obtained.

An acid value of this binder resin material C-1 is 15 mgKOH/g, and a hydroxyl value of this binder resin material C-1 is 7 mgKOH/g. Further, a molecular weight by GPC was 200,000 in weight-average molecular weight (Mw), 5,000 in number-average molecular weight. (Mn), 10,000 in peak molecular weight (Mp), and a softening point was 150° C.

<Manufacturing Embodiment of Resin Material C-2>

76.9 weight parts (0.167 mol) of polyoxypropylene (2,2)-2,2-bis(4-hydroxyphenyl)propane, 24.1 weight parts (0.145 mol) of terephthalic acid, and 0.6 weight part of titanium tetrabutoxide were placed in a glass-made 5-liter four-necked flask, and a thermometer, a stirring rod, a condenser and a nitrogen-introducing pipe were mounted, and then the flask was placed in a heating mantle. Then, the inside of the flask was replaced with nitrogen gas, and thereafter the mixture was gradually increased in temperature while being stirred, followed by reaction for 4 hours while stirring the mixture at 200° C. in temperature (first reaction step). Thereafter, 2.0 weight parts (0.010 mol) of trimellitic anhydride was added, followed by reaction at 180° C. for 1 hour (second reaction step), so that a binder resin material 1 was obtained.

An acid value of this binder resin material C-2 is 10 mgKOH/g, and a hydroxyl value of this binder resin material C-2 was 65 mgKOH/g. Further, a molecular weight by GPC was 8,000 in weight-average molecular weight (Mw), 3,500 in number-average molecular weight (Mn), 5,700 in peak molecular weight (Mp), and a softening point was 90° C.

<Manufacturing Method Embodiment of Binder Resin Material D-1>

50 weight parts of the binder resin material C-1 and 50 weight parts of the binder resin material C-2 were mixed by the Henschel mixer, so that a binder resin material D-1 was prepared.

<Manufacturing Embodiment of Toner C (Supply Developer) C>

| | |
|---|---|
| Binder resin material D-1 | 100 weight parts |
| Magnetic iron oxide particles (average particle size: 0.15 μm, Hc = 11.5 kA/m, σs = 90 $Am^2$/kg, σr = 16 $Am^2$/kg) | 90 weight parts |
| Fischer-Tropsch wax (maxi8mum heat-absorption peak = 105° C., Mn = 1500, Mw = 2500) | 2 weight parts |
| Paraffin wax (maximum heat-absorption peak = 75° C., Mn = 800, Mw = 1100) | 2 weight parts |
| 3,5-di-tert-butylsalicylic acid aluminum compound | 2 weight parts |

The above ingredients were pre-mixed by the Henschel mixer, and thereafter was melt-kneaded by the biaxial kneading extruding machine. At this time, a residence time was controlled so that the temperature of the kneaded resin material was 150° C.

The resultant kneaded product was cooled and was roughly pulverized by the hammer mill, and thereafter was finely pulverized using a finely pulverizing machine using jet stream, and the resultant finely pulverized powder was classified using a multi-division classifying machine using Coanda effect, so that toner particles C of 6.9 μm in weight-average particle size (D4) were obtained.

With 100 weight parts of the toner particles C, 1.5 weight parts of silica (BET specific surface area: 75 $m^2$) hydrophobized with hexamethylene disilazane (treating amount: 10 weight parts per 100 weight parts of silica fine particles) and dimethyl silicone oil (treating amount: 16 weight parts per 100 weight parts of silica fine particles was dry-mixed at 66.7 $s^{-1}$ for 5 min. by using the Henschel mixer ("FM10C", manufactured by Nippon Coke & Engineering Co., Ltd., upper blade: Type Y1/lower blade: type So), so that toner C used in this embodiment was obtained.

[Manufacturing Method Embodiment of Supply Developer D]

<Manufacturing Embodiment of Toner D>

Toner D used in this embodiment was obtained by changing the dry-mixing time by the Henschel mixer ("FM 10C", manufactured by Nippon Coke & Engineering Co., Ltd., upper blade: Type Y1/lower blade: type So) during the manufacturing of the toner C to 20 min.

[Manufacturing Method Embodiment of Supply Developer E]

<Manufacturing Embodiment of Toner E>

Toner E used in this embodiment was obtained by changing the dry-mixing time by the Henschel mixer ("FM 10C", manufactured by Nippon Coke & Engineering Co., Ltd., upper blade: Type Y1/lower blade: type So) during the manufacturing of the toner C to 1 min.

(Toner Manufacturing Apparatus)

Here, the surface modifying processing device 90 preferably used for manufacturing the toner A used in this embodiment will be described specifically. As shown in FIGS. 22 and 23, the surface modifying processing device is constituted by the following members.

The device 90 is constituted by:

a casing 70, a dispersing rotor 76 which includes a jacket (not shown) in which cooling water or antifreeze can be passed and includes, as a surface modifying means, a plurality of rectangular disks or cylindrical pins 80 mounted on an upper surface of a center rotation shaft in the casing 70 and which is a disk-shaped rotatable member which can rotate at high speed, a liner 74 provided at its surface with many grooves disposed at an outer peripheral portion of the dispersing rotor 76 with certain intervals (Incidentally, the grooves on the liner surface may also be not provided), a classifying rotor 71 which is a means for classifying a surface-modified source material into predetermined particle size portions, and a cooling air introducing opening 75 for introducing cooling air, a source material supplying opening 73 for introducing the source material to be treated, a discharging valve 78 provided operably so that a surface modifying time is freely adjustable, a powder discharge opening 77 for discharging the powder after treatment, a first space 81 in front of a space, to be introduced into a classifying means, between the classifying rotor 71 which is the classifying means, and the dispersing rotor 76 and the liner 74 which are surface modifying means, and a cylindrical guide ring 79 which is a guiding means for partitioning the inside of the casing 70 to form a second space 82 for guiding particles from which fine powder is classified and removed by the classifying means to the surface treating means.

Incidentally, a gap portion between the dispersing rotor 76 and the liner 74 is a surface modifying zone, and the classifying rotor 71 and a rotor peripheral portion are a classifying zone.

In the surface modifying device constituted as described above, when the finely pulverized product is charged through a source material supply opening 73 in a state that a discharging valve 78 is closed, the charged finely pulverized product is first sucked by a blower (not shown), and then is classified by the classifying rotor 71. At that time, classified fine powder of not more than a predetermined particle size is continuously discharged and removed by an outside of the device, and coarse powder of not more than the predetermined particle size is guided to the surface modifying zone by moving into a circulating stream generated by the dispersing rotor 76 along an inner peripheral portion (second space 62) of the guide ring 79 by centrifugal force. The source material guided to the surface modifying zone is subjected to a mechanical impact force between the dispersing rotor 76 and the liner 74, and thus is subjected to a surface modifying process. The surface-modified particle is subjected to the surface modification move into a cooling air passing through the inside of the device, and are guided to the classifying zone along an outer peripheral portion (first space 81) of the guide ring 79, and the fine powder is discharged again to the outside of the device by the classifying rotor 71. Then, the coarse powder moves into the circulating stream and is returned again to the surface modifying zone and is repetitively subjected to the surface modifying action. After a lapse of a certain time, the discharging valve 78 is closed, and the surface-modified particles are collected through the discharge opening 77.

Second Embodiment

Next, a constitution of Second Embodiment will be described with reference to FIG. 24 to FIG. 30. FIG. 24 is a perspective sectional view of the developer supply container in Second Embodiment, and FIG. 25 is a partially sectional view when the pump is expanded to the possible extent. FIG. 26(*a*) is a perspective view of an entirety of the partition wall 6 mounted in the container in Second Embodiment, FIG. 26(*b*) is a side view of the partition wall 6, and each of FIG. 27 to FIG. 30 is a sectional view in which a state of the inside of the container during a supplying operation is seen from the pump portion 3*a* side in FIG. 25.

In this embodiment, with respect to constitutions similar to those in First Embodiment described above, the same reference numerals or symbols are added and will be omitted from detailed description.

In the constitution in this embodiment, a metering portion 4*d* capable of accommodating the developer in a certain amount is provided above the discharge opening 4*a*. In the pump portion 3*a* side of the partition wall 6, an enclosing portion 7 rotating together with the partition wall 6 when the partition wall 6 rotates in interrelation with the cylindrical portion 2*k* is provided. Other constitutions are almost similar to those in First Embodiment.

As shown in FIG. 26(*a*), the enclosing portion 7 is constituted by two sector plate-like members 7*a*, a connecting wall 7*e* and a level-off portion 7*d* positioned downstream of the connecting wall 7*e* with respect to the rotational direction. Further, a communication hole 7*b* is provided in the neighborhood of a rotational axis center of the sector plate-like member 7*a* positioned in the pump 3*a* side. As shown in FIG. 26(*b*), between the two sector plate-like members 7*a*, a space 7*c* having a width S is provided, and the space 7*c* communicates with a space in the pump portion 3*a* side in the developer supply container through the communication hole 7*b*. In this embodiment, setting is made s that a center angle of the sector is 90°, a radius of the communication hole 7*b* is 5 mm, and a width S is 5 mm.

A discharging operation in this embodiment will be described using FIG. 27 to FIG. 30.

In FIG. 27, the developer supply container 1 is in an operation stop step in which the pump portion 3*a* is not in operation.

At this time, the developer T is fed to the discharging portion 4*c* by the partition wall 6. In this state, the metering portion 4*fd* is in a state (developer in flow permitting state) in which the metering portion 4*d* is not covered with the sector plate-like members 7*a* at all, and therefore the developer T flows into also the inside of the metering portion 4*d* provided below the discharging portion 4*c*. Accordingly, in FIG. 27, such a state that the inside of the metering portion 4 is filled with the developer T and the developer T exists also at the discharging portion 4*c* is formed.

From this state, by rotation of the partition wall 6, a state of FIG. 28 is formed.

In FIG. 28, the pump portion 3*a* is in a halfway state in which the state of the pump portion 3*a* is changed from a most contracted state toward a most expanded (elongated) state, i.e., in an air-suction step.

At this time, the sector plate-like members 7*a* are in a state in which the members 7*a* do not cover at all or cover only a part of the metering portion 4*d*. In this state, an inner portion and an upper portion of the metering portion 4*d* are in a state filled with the developer. From this state, the pump portion 3*a* expands (elongates), so that the air is taken into the developer T developed at the inner portion of the metering portion 4*d* and a peripheral portion thereof.

From this state, by further rotation of the partition wall 6, a state of FIG. 29 is formed.

In FIG. 29, the pump portion 3*a* in a halfway state in which the state of the pump portion 3*a* is changed from the most expanded state toward the most contracted state, i.e., in an air-discharging step.

At this time, the developer T at the upper portion of the metering portion 4*d* is pushed away toward the downstream side with respect to the rotational direction by the level-off portion 7*d*. Further, the metering portion 4*d* is in a state (developer in flow suppression state) in which at least a part thereof is covered with the sector plate-like members 7*a*. In this state, the developer T outside the metering portion 4*d* is in a state in which the inflow of the developer T into the metering portion 4*d* is suppressed. For that reason, from this state, the pump portion 3*a* is contracted, so that when an internal pressure of the developer supply container 1 increases, most of the developer T to be discharged through the discharge opening 4*a* exists inside the metering portion 4*d*.

FIG. 30 is a state after the developer in the metering portion 4*d* is discharged. At this time, except for a portion deposited on the wall surface, there is no developer T in the metering portion 4*d*. From this state, by further rotation of the partition wall 6, the state returns to the state of FIG. 27, so that the developer is fed into the metering portion 4*d*.

In this embodiment, in this way, the steps of FIG. 27 to FIG. 30 are repeated, so that most of the developer T to be discharged can be constituted by the developer existing inside the metering portion 4*d*. Accordingly, compared with First Embodiment in which the developer in various states flows from the peripheral portion into the discharging opening 4*a*, it becomes possible to improve a quantitative property of the developer T discharged through the discharge opening 4*a* in this embodiment in which only the developer T in a certain space is discharged.

(Total Energy)

Also in the constitution in this embodiment, the feeding property and the discharging property of the developer in the developer supply container can be remarkably improved by combining the constitution with the developer having the physical properties in First Embodiment.

Specifically, when the developers A, B, C shown in Table 1 are accommodated in the developer supply container in this embodiment, it is possible to obtain very high discharge accuracy. Further, similarly as in First Embodiment, the developers A, B easily obtain the loosening effect by the air more than the developer C, and therefore by combining the developers A, B with the developer supply container in this embodiment, the supplied developer can be maintained in a uniform state more than that in First Embodiment. Particularly, in such a system that there is no hopper 10*a* as shown in FIG. 7, the effect is conspicuous, so that the image density fluctuation can be remarkably suppressed. Further, the developer C is higher in feeding effect by the partition wall 6 than the developers A, B, and therefore even in the case where the amount of the consumption of the developer is larger, it is easy to supply the developer in an amount necessary for the image forming apparatus.

In the air-suction step, the air is taken into the developer supply container 1 through the discharging opening 4*a*, so that the developer T in the metering portion 4*d* is in a state in which the air is contained. For that reason, the developer T to be discharged thereafter in the air-discharging step becomes the developer containing the air. At this time, in the case where this total energy Ea when the air is contained in the developer T is smaller than 0.4 mJ, there is a possibility that the developer scatters when the developer is discharged, and contaminates the peripheral portion. In the case where Ea is larger than 2.0 mJ, in the air-suction step, there is a possibility that the case where the developer T cannot be sufficiently loosened occurs, and there is a possibility that the discharge of the developer T becomes difficult.

When the total energy E when the air is not contained in the developer T is smaller than 10 mJ, in the air-discharging step, the developer T enters, from the gap between the sector plate-like members 7*a* and the discharging portion 4*c*, the inside of the metering portion 4*d*. For that reason, there is a liability that during the discharge, not only the developer T in the metering portion 4*d* but also the developer existing in a large amount at the peripheral portion thereof are discharged together. Accordingly, there is an increasing possibility that a variation generates in amount of the developer T discharged through the discharging opening 4*a*. In the case where E is larger than 80 mJ, the developer T is liable to stagnate in the gap between the sector plate-like members 7*a* and the discharging portion 4*c*, so that a degree of a liability that the developer T is subjected to stress by relative rotation between the sector plate-like members 7*a* and the discharging portion 4*c* and then agglomerates increases.

Specifically, when the developer D shown in Table 1 is accommodated in the developer supply container in this embodiment, the developer in the container cannot be sufficiently loosened, so that the case where the discharge of the developer became difficult and the case where the developer agglomerated between the sector plate-like members 7*a* and the discharging portion 4*c* were observed. When the developer E was accommodated in the developer supply container in this embodiment, a lowering in discharge accuracy of the developer and the toner scattering into a peripheral portion during the discharge were observed.

Accordingly, into the developer supply container in this embodiment, by supplying the developer for which E and Ea fall in the suitable ranges, it is possible to properly loosen the developer and to maintain the developer amount in the metering portion at a constant level, so that the discharge amount of the developer from the developer supply container can be controlled with high accuracy. Further, the degree of the liability that the developer stagnates and agglomerates at a place where the developer is liable to be subjected to stress can be further reduced.

Third Embodiment

Next, other physical properties of the developer accommodated in the developer supply container will be described. In this embodiment, constitution, such as the developer supply container and the like for example, other than the physical properties of the developer are the same as those in First Embodiment described above, and therefore will be omitted from redundant description.

The developer in this embodiment is constituted so that a depositing force Ftb between developers (developer particles) at 25° C. in 20 g or more and 100 g or less and a mobility index is 0.5 or more and 25.0 or less. This developer is accommodated in the developer supply container having the above-described constitution, whereby the feeding property and the discharging property of the developer is further improved.

As a species of the developer supplied from the developer supply container in this embodiment, in the case where a one-component developing device is used, a one-component non-magnetic toner or a one-component magnetic toner is to be supplied. In the case where a two-component developing device is used, a two-component developer in which the non-magnetic toner and a magnetic carrier are mixed is supplied. That is, as the developer used in this embodiment, the developer is selected depending on the constitution of the developing device, but may species of the developer may be used if the developer has physical properties falling with the above-described developer physical properties.

The physical properties of the supply developers used in this embodiment are shown in Table 3.

TABLE 3

| Developer | DFBD*[1] | Mobility Index |
|---|---|---|
| A | 35 (g) | 60 |
| B | 30 (g) | 3.5 |
| C | 65 (g) | 10.0 |
| D | 18 (g) | 0.4 |
| E | 102 (g) | 26.0 |

*[1]"DFBD" is a depositing force between developers (developer particles).

(Depositing Force Between Developers: Ftb)

The depositing force Ftb between developers (developer particles) is a value showing a depositing property between particles obtained by being measured using a measuring device of compressive and tentile characteristics of powder layers, "Aggrobot" (manufactured by Hosokawa Micron Corp.).

Specifically, in the following condition, powder in a certain amount is charged in a cylindrical cell vertically divided into upper and lower cells and is held under application of a load of 8 kg, and thereafter the upper cell is raised, and Ftb can be calculated from a strength, a height (distance) during compression and a volume when the powder layer is broken.

[Measuring Condition]

Sample amount: 7.0 g,
Ambient temperature: 25° C.,
Humidity: 42%,
Cell inner diameter: 25 mm,
Cell temperature: 25° C.,
Spring wire diameter: 1.0 mm,
Compression speed: 0.10 mm/sec,
Compression force: 8 kgf,
Compression retention time: 300 sec,
Tension speed: 0.40 mm/sec.

The depositing force Ftb between developers shows a depositing force between developers (developer particles) during compression, so that it is possible to evaluation an agglomeration property and a flowability (flowing property) between the developers after the compression. In the developer supply container, mutual compression between the developers during actuation of the pump, particularly the compression in the neighborhood of the discharging opening has the influence on the feeding property and the discharging property, but when the depositing force Ftb between developers is 20 g or more and 100 g or less, the feeding property and the discharging property of the developer in the developer supply container is remarkably improved.

From a result of study in this embodiment, in the case where the depositing force Ftb between developers is smaller than 20 g, the depositing force is excessively small and there is a liability that the developer scatters. Particularly, in the case of such a constitution that the developer is loosened by the air using the pump and then is discharged as in this embodiment, in the case where the depositing force is excessively low, the particles are not readily deposited on each other, and therefore there is a tendency that the toner is liable to scatter into the peripheral portion by the pressure of the air. For that reason, there is a possibility that a degree of the contamination with the toner becomes worse.

On the other hand, in the case where the depositing force Ftb is between developers is larger than 100 g, conversely, the mutual agglomeration property between the developers is excessively high, so that there is a possibility that the flowability of the developer in the developer supply container is not uniform and the developer is liable to agglomerate in the neighborhood of the discharge opening to lower the discharging performance. Further, due to a strong depositing force, in the case where the developer is stored for a long time in a high-temperature and high-humidity environment, also blocking such as mutual agglomeration between the toners (toner particles) is liable to occur. Particularly, as in this embodiment, in the case where a diameter of the discharge opening 4*a* is very small, there is a possibility that such a phenomenon as the agglomeration or blocking of the developer has the influence on the discharging property, and therefore the phenomenon is a very significant problem.

(Mobility Index)

The mobility index which is the other physical index in this embodiment will be described.

The mobility index is measured by a parts feeder (manufactured by Konica Minolta, Inc.) shown in FIG. 21, and a moving property (mobility) of the toner in a state in which certain vibration is applied to the toner is indexed. This mobility index is different from the flowability evaluated by a static bulk density and an angle of repose at the time of rest of the toner, and is an index showing dynamic flowability between the toner in the rotating supply container and the supply container.

A specific measuring method will be described based on FIG. 21. A parts feeder is constituted by a driving source 40 for generating specific vibration, and a cylindrical bowl 41 supported above this driving source 40. In the bowl 41, along its inner peripheral wall surface, a helical slope 42 for establishing communication between its bottom and upper end edge is formed. Here, the slope 42 is provided in such a manner that its upper and portion 43 projects from a side wall of the bowl 41 toward an outside with respect to a radial direction at the same level position with the upper end edge of the bowl 41. In FIG. 21, 44 is a center shaft of the bowl 41, 45 is a saucer provided below the upper end portion 43 of the slope 42, and 46 is a metering means connected with the saucer.

In this parts feeder, rotational power supplied by the driving source 40 is transmitted to the bowl 41, whereby the rotational power is converted into vibration motion for vibrating the bowl 41 as a whole, so that a returning position of an up-and-down motion is changed by the action of a spring provided with an angle. By this, the toner positioned in the bowl 41 is carried upward along the slope 42 and is dropped on the saucer 45 from the upper end portion 43 of the slope 42.

Thus, measurement of the mobility index of the toner in this embodiment is made in the following manner.

First, 1 g of the toner is charged at a periphery of the center shaft inside the bowl 41, and the driving source 40 is driven under a condition of a frequency of 134.0 to 136.0 Hz and an amplitude of 0.59 to 0.61 mm.

Then, the toner is moved upward along the slope 42 to be caused to reach the saucer, and a time from start of the drive of the driving source 40 when an amount of the toner which reached the saucer and which is measured by the metering means 46 is 300 mg to 700 mg is measured, so that the mobility index can be calculated using the following general formula.

$$(\text{Mobility index})=(700-300)\text{mg}/(T700-T300)\text{sec}$$

In the above general formula, T300 shows a time required for carrying 300 mg of the toner to the saucer, and T700 shows a time required for carrying 700 mg of the toner to the saucer.

The mobility index is obtained by indexation of mobility of the toner in a state in which certain vibration is applied. In this embodiment, this mobility index can evaluate the flowability of the developer during actuation of the pump for the developer supply container, and it is known that when the mobility index is 0.5 or more and 25.0 or less, the developer feeding property in the developer supply container is remarkably improved. In the case where the mobility index is smaller than 0.5, it means that the flowability of the developer is excessively high, and in such a case, there is a possibility that the toner scattering becomes worse as described above with respect to the depositing force Ftb between developers. On the other hand, in the case where the mobility index is larger than 25.0, the mutual agglomeration property between developers is excessively large and the flowability of the developer in the supply container is not uniform, and therefore there is a possibility that the developer to be supplied is not maintained in a uniform state.

(Discharge Result by Respective Toner Physical Properties)

When the developers A, B, C shown in Table 3 were accommodated and the toner was supplied while effecting normal image formation, there were no problems such as the toner scattering and clogging of the toner, and the toner supply was able to be made while maintaining a stable supply amount from an initial stage to the end.

Further, in such a system that there is no hopper 10*a* as shown in FIG. 7, it is possible to suppress the image density fluctuation by uniform developer supply.

Next, when the developer D shown in Table 3 was evaluated, the supply of the developer was able to be made with no toner clogging from the initial stage, but the flowability of the developer was excessively high and the toner scattering became worse, so that a degree of contamination with the toner at the periphery of a shutter opening portion was bad.

Next, when the developer E shown in Table 3 was evaluated, both of the depositing force Ftb between developers and the mobility index were high and the developer flowability was remarkably bad, and therefore the case where the developer in the container was not able to be sufficiently collapsed from the initial stage of the discharge and thus the discharge became difficult was observed.

As described above, for the developer supply container in this embodiment, the developer having both of the depositing force Ftb between developers and the mobility index which fall within suitable ranges as shown below is provided, so that the feeding property and the discharging property of the developer in the developer supply container are remarkably improved. As a result, the developer in the developer supply container is maintained in a uniform state, so that discharge accuracy is remarkably improved. Specifically, it shows that the developer depositing force Ftb and the mobility index fall within the following ranges.

Depositing force between developers: 20 g or more, 10 g or less

Mobility index: 0.5 or more, 25.0 or less

The developer supply container in this embodiment has a very characteristic constitution in which a pump cable of expansion and contraction for itself is provided, and by using air suction and air discharging steps with use of the pump, the developer can be properly supplied even when the discharge opening has a very small diameter. The small discharge opening diameter has a very excellent advantage against the problems such as the toner scattering and the contamination which generated in the conventional container. On the other hand, in the case where if the toner in the container causes blocking or the like case, a risk against the supplying property is high, but as in this embodiment, by suppressing the above-described physical properties of the developer within proper ranges, it becomes possible to always maintain a stable supplying performance from the initial stage of the discharge. For that reason, the pump is a very important and effective means in the developer supply container having the characteristic constitution as in this embodiment.

Incidentally, the developer manufacturing method used in this embodiment is the same as the constitution described in First Embodiment.

(Developer Supply Container Including Metering Portion)

The developer in this embodiment can be suitably used even in the developer supply container including the metering portion 4*d* capable of accommodating the developer in a certain amount above the portion 4*a* described in Second Embodiment.

Specifically, when the developers A, B, C shown in Table 3 are accommodated in the developer supply container in this embodiment, it was possible to obtain very high discharge accuracy. Further, the developers A, B, C easily obtain the loosening effect by the air, and therefore by combining the developers A, B, C with the developer supply container in this embodiment, the supplied developer can be maintained in a uniform state. Particularly, in such a system that there is no hopper 10*a* as shown in FIG. 7, the effect is conspicuous, so that the image density fluctuation can be remarkably suppressed.

In the air-suction step, the air is taken into the developer supply container 1 through the discharging opening 4*a*, so that the developer T in the metering portion 4*d* is in a state in which the air is contained. For that reason, the developer T to be discharged thereafter in the air-discharging step becomes the developer containing the air. At this time, in the case where mobility index when the air is contained in the developer T is smaller than 0.5 mJ, there is a possibility that the developer scatters when the developer is discharged, and contaminates the peripheral portion. In the case where the mobility index is larger than 25.0, in the air-suction step, there is a possibility that the case where the developer T cannot be sufficiently loosened occurs, and there is a possibility that the discharge of the developer T becomes difficult.

When the depositing force Ftb between developers when the air is not contained in the developer T is smaller than 20 g, in the air-discharging step, the developer T enters, from the gap between the sector plate-like members 7*a* and the discharging portion 4*c*, the inside of the metering portion 4*d*. For that reason, there is a liability that during the discharge, not only the developer T in the metering portion 4*d* but also the developer existing in a large amount at the peripheral portion thereof are discharged together. Accordingly, there is an increasing possibility that a variation generates in amount of the developer T discharged through the discharging opening 4*a*. In the case where the depositing force Ftb between developers is larger than 100 g, the developer T is liable to stagnate in the gap between the sector plate-like members 7*a* and the discharging portion 4*c*, so that a degree of a liability that the developer T is subjected to stress by relative rotation between the sector plate-like members 7*a* and the discharging portion 4*c* and then agglomerates increases.

Specifically, when the developer E shown in Table 3 is accommodated in the developer supply container in this embodiment, the developer in the container cannot be sufficiently loosened, so that the case where the discharge of the developer became difficult and the case where the developer agglomerated between the sector plate-like members 7*a* and the discharging portion 4*c* were observed. When the developer D was accommodated in the developer supply container in this embodiment, a lowering in discharge accuracy of the developer and the toner scattering into a peripheral portion during the discharge were observed.

Accordingly, into the developer supply container in this embodiment, by supplying the developer for which the depositing force Ftb between developers and the mobility index fall in the suitable ranges, it is possible to properly loosen the developer and to maintain the developer amount in the metering portion at a constant level. By this, the discharge amount of the developer from the developer supply container can be controlled with high accuracy. Further, the degree of the liability that the developer stagnates and agglomerates at a place where the developer is liable to be subjected to stress can be further reduced.

Fourth Embodiment

Next, other physical properties of the developer accommodated in the developer supply container will be described. In this embodiment, constitution, such as the developer supply container and the like for example, other than the physical properties of the developer are the same as those in First Embodiment described above, and therefore will be omitted from redundant description.

In this embodiment, as physical properties of the developer, indices such as maximum consolidation stress, uniaxial collapse stress and loosened apparent density are used, whereby it becomes possible to infer a state of the developer accommodated in the developer supply container 1 with high accuracy.

In this embodiment, in addition to the developers A, B, C described in First Embodiment described above, the following developers F and G were prepared.

[Manufacturing Method Embodiment of Supply Developer F]

50 weight parts of the toner A and 50 weight parts of the magnetic carrier C described in the above-described Manufacturing Embodiment were mixed using a V-type mixer and were passed through a sieve of 250 μm aperture, whereby a supply developer F used in this embodiment was prepared.

[Manufacturing Method Embodiment of Supply Developer G]

100 weight parts of the toner A and zero weight parts of the magnetic carrier C described in the above-described Manufacturing Embodiment were mixed using a V-type mixer and were passed through a sieve of 250 μm aperture, whereby a supply developer F used in this embodiment was prepared.

Incidentally, the surface modifying processing device 90 preferably used in manufacturing of the toner A used in this embodiment is the same as that described in the above-described embodiment.

(Uniaxial Collapse Stress and Loosened Apparent Density)

In this embodiment, by using the indices such as the maximum consolidation stress, the uniaxial collapse stress and the loosened apparent density, it becomes possible to infer the state of the developer accommodated in the developer supply container 1 with high accuracy.

The maximum consolidation stress is a vertical load required for changing powder aggregate into a powder layer. The uniaxial collapse stress is shearing stress required for breaking the powder layer formed by the maximum consolidation stress to start flow. Further, the loosened apparent density is a bulk density in a state in which the power is caused to free-falls.

Specifically, when the developer is large in uniaxial collapse stress when the maximum consolidation stress is zero and is also large in loosened apparent density, there is a possibility that the loosening of the developer by the air in the developer supply container in this embodiment cannot be sufficiently effected and feeding uniformity is influenced. Further, when the uniaxial collapse stress is smaller when the maximum consolidation stress is zero and the loosened apparent density is small, there is a liability that a possibility of generation of the member contamination due to the toner scattering during the development increases.

In the developer supply container 1 used in this embodiment, the inside developer is loosened by the air. For that reason, the feeding property and the discharging property of the developer can be further improved and the member contamination due to the toner scattering can be suppressed by satisfaction of the following condition by the uniaxial collapse stress and the loosened apparent density when the maximum consolidation stress is zero in the state that the developer is loosened by the air.

$$(U \text{ when } X=0) \leq 2.0 \text{ and } 250 \leq \rho \leq 1000$$

X: maximum consolidation stress (Kpa)

U: uniaxial collapse stress (kPa)

σ: loosened apparent density (kg/m$^3$)

As a species of the developer supplied from the developer supply container 1 in this embodiment, in the case where a one-component developing device is used, a one-component non-magnetic toner or a one-component magnetic toner is to be supplied. In the case where a two-component developing device is used, a two-component developer in which the non-magnetic toner and a magnetic carrier are mixed is supplied. That is, as the developer used in this embodiment, the developer is selected depending on the constitution of the developing device, but may species of the developer may be used if the developer has physical properties falling with the above-described developer physical properties.

The physical properties of the supply developers used in this embodiment are shown in Table 4.

TABLE 4

| Developer | Uniaxial Collapse Stress | Loosened Apparent Density σ |
|---|---|---|
| A | 1.0 [kPa] | 470 [kg/m$^3$] |
| B | 0.9 [kPa] | 475 [kg/m$^3$] |
| C | 0.6 [kPa] | 540 [kg/m$^3$] |
| F | 2.1 [kPa] | 1050 [kg/m$^3$] |
| G | 0.1 [kPa] | 200 [kg/m$^3$] |

The maximum consolidation stress (X) and the uniaxial collapse stress (U) of the supply developer in this embodiment are those measured by "Shear Scan" (manufactured by Sci-Tec Inc.). The Shear Scan carries out measurement based on a principle by Mohr-Coulomb model described in "CHARACTERISING POWDER FLOWABILITY (published on Jan. 24, 2012) written by Prof. Virendra M. Puri.

Specifically, a rotatable cell (cylindrical, inner diameter: 110 mm, volume: 200 ml) capable of linearly adding a shearing force was used and the measurement was carried out in a room temperature environment (23° C., 60% RH). In this case, the developer is placed, and the vertical load is applied so as to be 2.5 kPa, and then a consolidated powder layer is prepared so as to be in a closest packed state under this vertical load. The measurement by the Shear Scan is preferred in this embodiment in that this closest packed state can be formed by automatically detecting the pressure with no individual variation. Similarly, consolidated powder layers for which the vertical load is 5.0 kPa and 10.0 kPa are formed. Then, a test in which a shearing force is gradually applied while continuously applying the flowability applied when the consolidated powder layer is formed as a sample formed under each of the vertical loads and then a fluctuation in shearing stress at that time is measured is conducted, so that a stationary point is determined. In discrimination that the consolidated powder layer reaches the stationary point, in the above test, the consolidated powder layer is discriminated as reaching the stationary point when displacement of the shearing stress and displacement of a load applying means for applying the vertical load in vertical direction become small and both of the displacements show stable values. Then, the vertical load is removed gradually from the consolidated powder layer which reached the stationary point, and a yield locus (a plot of vertical load stress vs shearing stress) at each of the loads is prepared, so that they intersect and a slope are obtained. In analysis by the Mohr-Coulomb model, the uniaxial collapse stress and the maximum consolidation stress are expressed by the following formulas, and the above y intersect is a "cohesive force", and the slope is an "internal frictional angle".

$$\text{Uniaxial collapse stress } (U)=2c(1+\sin\phi)/\cos\phi)$$

$$\text{Maximum consolidation stress } (X)=((A-(A^2\sin^2\phi)-\tau_{ssp}{}^2\cos^2\phi)^{0.5})/(\cos^2\phi)\times(1+\sin\phi))-(c/\tan\phi)$$

($A=\sigma_{ssp}+(c/\tan\phi)$, c=cohesive force, $\phi$=internal frictional angle, $\tau_{ssp}=c+\sigma_{ssp}\times\tan\phi$), $\sigma_{ssp}$=vertical load at stationary point)

The uniaxial collapse stress and the maximum consolidation stress calculated at each of the loads are plotted (Flow Function Plot), and a rectilinear line is drawn based on the plot. From this rectilinear line, the uniaxial collapse stress when the maximum consolidation stress is zero is obtained.

The supply developer used in this embodiment may preferably have the uniaxial collapse stress of 2.0 kPa or less when the maximum consolidation stress of the developer is zero. This shows that when the pump is actuated after being left standing for a long time during a normal state (a state in which the developer in the developer supply container 1 is not particularly consolidated), the developer in the developer supply container 1 is loosened with reliability by taking the air therein at an internal pump pressure of about 2.0 kPa and the developer in the container can be caused to exhibit a good flowability instantaneously.

When the uniaxial collapse stress when the maximum consolidation stress is zero is larger than 2.0 kPa, at the time of actuation of the pump after the pump is left standing for a long time, there is a possibility that it takes much time until the developer in the container is loosened with reliability and the good flowability can be ensured.

The loosened apparent density (ρ) of the supply developer in this embodiment was measured using a powder tester PT-R (manufactured by Hosokawa Micron Corp.). The measurement was carried out in a measuring environment of 23° C., 50% RH. For measurement, a sieve of 75 μm in aperture was used, and the developer was collected in a 100 ml-volume metal cap while vibrating the sieve at an amplitude of 1 mm and was leveled off so as to be just 100 ml in volume. Then, from the weight of the developer collected in the metal cap, the loosened apparent density (kg/m$^3$) was calculated.

That is, the loosened apparent density shows a degree of ease of consolidation of the developer, and in this embodiment, when the loosened apparent density ρ of the developer is 250 kg/m$^3$ or more and 1000 kg/m$^3$ or less, the feeding property and the discharging property of the developer in the developer supply container 1 are remarkably improved.

In the case where the loosened apparent density is smaller than 250 kg/m$^3$, it means that the developer becomes excessively bulky and the flowability is excessively high, so that the developer is dropped from the partition wall 6 when the developer is scooped up by the partition wall 6, and there is a possibility that the feeding property of the developer becomes worse.

On the other hand, in the case where the loosened apparent density is larger than 1000 kg/m$^3$, there is a possibility that the flowability of the developer in the developer supply container 1 cannot be ensured and the supplied developer cannot be maintained in the uniform state. Further, there is a possibility that the developer is not readily loosened at the time of actuation of the pump after the pump is left standing for a long time. That is, in the developer supply container 1 in this embodiment, the developer for which the uniaxial collapse stress when the maximum consolidation stress is zero and the loosened apparent density are in proper ranges is supplied, so that the feeding property and the discharging property of the developer in the developer supply container 1 is remarkably improved.

From the above, the developer (A, B, C) for which the uniaxial collapse stress and the loosened apparent density are in proper ranges is combined with the developer supply container in this embodiment, remarkable improvement in feeding property and discharging property of the developer in the developer supply container is shown.

Further, as described above, uniform supply of the developer is possible, and therefore even in the case where particularly a constitution in which the hopper 10*a* as shown in FIG. 7 is omitted is used, the discharging property is stable and therefore it is possible to suppress the image density fluctuation.

On the other hand, when the above-described developer F is accommodated in the developer supply container in this embodiment, the developer in the container cannot be loosened sufficiently, so that the discharge becomes difficult.

Further, when the developer G is accommodated in the developer supply container in this embodiment, the lowering in discharge accuracy due to worsening of the developer feeding property and the toner scattering to the periphery during the discharge are observed and therefore is not preferred.

(Developer Supply Container Including Metering Portion)

Also the developer in this embodiment can be suitably used even in the developer supply container including the metering portion 4*d* capable of accommodating the developer in a certain amount above the portion 4*a* described in Second Embodiment.

That is, in the air-suction step, the air is taken into the developer supply container 1 through the discharging opening 4*a*, so that the developer T in the metering portion 4*d* is in a state in which the air is contained. At this time, in the case where the loosened apparent density p is smaller than 250 kg/m$^3$, the developer becomes excessively bulky and the flowability becomes excessively high. Therefore, the developer T acts violently in the metering portion 4*d* to cause variation, so that there is a possibility that an amount of the developer discharged through the discharge opening 4*a* cannot be maintained at a constant value. On the other hand, in the case where the loosened apparent density p is larger than 1000 kg/m$^3$, the developer is not readily loosened and becomes non-uniform. Therefore, there is a possibility that the developer in a predetermined amount cannot be ensured in the metering portion 4*d* and the supplied developer cannot be maintained at a constant level. In the case where the uniaxial collapse stress U is larger than 2.0 kPa, there is a possibility that the case where the developer T cannot be properly loosened occurs, and therefore there is a liability that a stable discharging property cannot be obtained.

In the air-discharging step, when the loosened apparent density ρ when the air is not contained in the developer T is smaller than 250 kg/m$^3$, the developer T enters, from the gap between the sector plate-like members 7*a* and the discharging portion 4*c*, the inside of the metering portion 4*d*. For that reason, there is a liability that during the discharge, not only the developer T in the metering portion 4*d* but also the developer existing in a large amount at the peripheral portion thereof are discharged together. Accordingly, there is an increasing possibility that a variation generates in amount of the developer T discharged through the discharging opening 4*a*. In the case where the loosened apparent density p is larger than 1000 kg/m$^3$, the developer T is liable to stagnate in the gap between the sector plate-like members 7*a* and the discharging portion 4*c*, so that a degree of a liability that the developer T is subjected to stress by relative rotation between the sector plate-like members 7*a* and the discharging portion 4*c* and then agglomerates increases.

Accordingly, into the developer supply container 1 in this embodiment, by supplying the developer (A, B, C) for which the uniaxial collapse stress when the maximum consolidation stress is zero and the loosened apparent density fall in the suitable ranges, it is possible to properly loosen the developer and to maintain the developer amount in the metering portion at a constant level. By this, the discharge amount of the developer from the developer supply container can be controlled with high accuracy. Further, the degree of the liability that the developer stagnates and agglomerates at a place where the developer is liable to be subjected to stress can be further reduced.

Accordingly, as in the developer supply container shown in this embodiment, even in the case where a constitution in which there is a liability that the shear is further applied to the developer by the feeding member is used, by supplying the developer for which the uniaxial collapse stress and the loosened apparent density are in the proper ranges, it is possible to properly loosen the developer and to maintain the developer amount in the metering portion at a constant value, so that the discharge amount of the developer from the developer supply container can be controlled with high accuracy. Further, the degree of the liability that the developer stagnates and agglomerates at a place where the developer is liable to be subjected to stress can be further reduced.

Fifth Embodiment

Next, other physical properties of the developer accommodated in the developer supply container will be described. In this embodiment, constitution, such as the developer supply container and the like for example, other than the physical properties of the developer are the same as those in First Embodiment described above, and therefore will be omitted from redundant description.

(Physical Properties of Developer)

The developer accommodated in the developer supply container in this embodiment includes toner particles containing a binder resin material and a colorant and a toner including inorganic fine powder, and the toner is $1.0\times10^{-9}$ N or more and $1.0\times10^{-6}$ N or less in depositing force Fp between two particles, and is 40 number % or less in liberation rate of the inorganic fine powder. By this, the feeding property and the discharging property of the developer are further improved.

As a species of the developer supplied from the developer supply container in this embodiment, in the case where a one-component developing device is used, a one-component non-magnetic toner or a one-component magnetic toner is to be supplied. In the case where a two-component developing device is used, a two-component developer in which the non-magnetic toner and a magnetic carrier are mixed is supplied. That is, as the developer used in this embodiment, the developer is selected depending on the constitution of the developing device, but may species of the developer may be used if the developer has physical properties falling with the above-described developer physical properties.

The physical properties of the toners used in this embodiment are shown in Table 5.

TABLE 5

| Toner | DFBTP*1 | Fp | IFPLR*2 |
|---|---|---|---|
| A | $2.5\times10^{-8}$ | [N] | 25 [Number %] |
| B | $2.2\times10^{-8}$ | [N] | 10 [Number %] |
| C | $7.0\times10^{-8}$ | [N] | 15 [Number %] |
| H | $1.0\times10^{-10}$ | [N] | 35 [Number %] |
| I | $1.0\times10^{-5}$ | [N] | 55 [Number %] |

*1"DFBTP" is a depositing force between two particles.
*2"IFPLR" is an inorganic fine powder liberation rate.

(Depositing Force Between Two Particles)

The depositing force Fp between two is a value showing a depositing property between particles obtained by being measured using a measuring device of compressive and tentile characteristics of powder layers, "Aggrobot" (manufactured by Hosokawa Micron Corp.).

Specifically, in the following measuring condition, powder in a certain amount is charged in a cylindrical cell vertically divided into upper and lower cells and is held under application of a load of 8 kg, and thereafter the upper cell is raised, a maximum tensile breaking force is obtained from a difference in tensile force between before and after breakage of the powder layer, and by this, a maximum tensile breaking strength is calculated. The maximum tensile breaking strength is converted from the maximum tensile breaking force by the following formula.

$$\sigma_t = F_{tb} \times 9.80665 \times 10^{-3} / (\Pi \times (d/2 \times 10^{-3})^2)$$

$\sigma_t$: maximum tensile breaking strength (Pa), $F_{tb}$: maximum tensile breaking force (gf), D: cell inner diameter (mm).

Further, using the Rumpf's equation which is most popular in particulate media mechanics, the depositing force Fp between two particles is calculated from the maximum tensile breaking strength.

$$Fp = \beta_v \times Vf \times D_{vs}^2 / (1 - Vf)$$

Fp: depositing force between two particles (N), $\sigma_t$: maximum tensile breaking strength (Pa), Vf: porosity (−), $D_{vs}$: body area-average diameter of powder (m).

[Measuring Condition]

Sample amount: 7.0 g,
Ambient temperature: 24° C.,
Humidity: 42%,
Cell inner diameter: 25 mm,
Cell temperature: 25° C.,
Spring wire diameter: 1.0 mm,
Compression speed: 0.10 mm/sec,
Compression force: 8 kgf,
Compression retention time: 300 sec,
Tension speed: 0.40 mm/sec.

The depositing force Fp between two particles shows a depositing force during compression, so that it is possible to evaluation an agglomeration property and a flowability (flowing property) of the toner after the compression. In the developer supply container, mutual compression between the developers during actuation of the pump, particularly the compression in the neighborhood of the discharging opening has the influence on the feeding property and the discharging property. At this time, when the depositing force Fp between two particles of the toner is $1.0 \times 10^{-9}$ N or more and $1.0 \times 10^{-6}$ N or less, the feeding property and the discharging property of the toner in the developer supply container are remarkably improved.

In the case where the depositing force Fp between two particles of the toner is smaller than $1.0 \times 10^{-9}$ N, the developer is dropped when the developer is scooped up by the partition wall 6, so that there is a possibility that the developer feeding property in the developer supply container in this embodiment lowers, and there is a liability that a possibility of generation of the member contamination due to the toner scattering during the development increases.

On the other hand, in the case where the depositing force Fp is between two particles is larger than $1.0 \times 10^{-6}$ N, the mutual agglomeration property between the toners is excessively high, so that there is a possibility that the flowability of the toner in the developer supply container is not uniform and the toner is liable to agglomerate in the neighborhood of the discharge opening to lower the discharging performance.

(Liberation Rate (Percentage))

The liberation rate (percentage) of the inorganic fine powder in this embodiment is defined as the sum of liberation rates obtained for respective inorganic elements.

The liberation rate of the inorganic fine powder, e.g., silica can be measured from emission spectrum at the time when the toner is introduced into plasma. In this case, the liberation rate is a value defined by the following formula from simultaneity of light emission of carbon atom and silicon atom which are constituent elements of the binder resin material.

Liberation rate (%)={(Times of light emission of only silicon atom)/(Times of light emission of silicon atom simultaneous with carbon atom)+(Times of light emission of only silicon atom)}$^2$×100

Here, "light emission (of silicon atom) simultaneous with" refers to simultaneous light emission which is light emission of inorganic element (silicon atom in the case of silica) generated within 2.6 msec from the light emission of carbon atom, and subsequent light emission and later of the inorganic element refers to light emission of only the inorganic element.

In this embodiment, the simultaneous light emission of carbon atom and the inorganic element means that the toner particles contain the inorganic fine powder, and the light emission of only the inorganic element can also be said in another way to mean that the inorganic fine powder is liberated from the toner particles.

The above liberation rate of the inorganic fine powder can be measured on the basis of a principle described on pages 65-68 of Collected Papers of Japan Hardcopy 97. In the case of carrying out such a measurement, for example, a particle analyzer ("PT 1000: manufactured by Yokogawa Electric Corp.) is used preferably. Specifically, in the device, fine particles such as the toner (particles) are introduced into plasma one by one, and from emission spectrum, it is possible to know an element, the number of particles and a particle size of the particles.

A specific measuring method using the above-described measuring device will be described below with respect to silica. The measurement is made using helium gas containing 0.1% of oxygen in an environment of 23° C. and a humidity of 60%, and a toner sample which was left standing for a night in the same environment and humidity-controlled is used for the measurement. Further, carbon atom (measurement wavelength: 247.860 mm, K factor: recommendation value is used) is measured in channel 1 and silicon atom (measurement wavelength: 288.160 nm, K factor: recommendation value is used) is measured in channel 2, and sampling is made so that the number of light-emission carbon atoms is 1000-1400 particles per (one) scan and the scan is repeated until the number of light-emission carbon atoms reaches 10000 particles or more in total, so that the number of light-emitted carbon atoms is integrated. At this time, the sampling is made so that in a distribution in which the number of light emission carbon atoms is taken as the ordinate and a cube root voltage of carbon atom is taken as the abscissa, the distribution has one maximum and no valley, and then the measurement is carried out. Then, based on this data, a noise cut level for all the elements is set at 1.50 V, the liberation rate of silicon atom, i.e., silica is calculated using the above-described calculation formula.

In this embodiment, the liberation rate of the inorganic fine powder can be changed depending on an external addition strength and a species and amount of an external additive. That is, when the external strength is made high or the amount of the external additive is decreased, the liberation rate can be lowered.

In this embodiment, the liberation rate of the inorganic fine powder of the toner may preferably be 40 number % or less. The discharge opening of the supply container in this embodiment is a small opening, and therefore the toner passing through the discharge opening is liable to be subjected to stress, so that the inorganic fine powder is in a state in which the inorganic fine powder is liable to liberate. Therefore, by using the toner in which the liberation rate of the inorganic fine powder is 40 number % or less, the liberation of the inorganic fine powder when the toner is discharged from the supply container can be remarkably suppressed to a small amount, so that the member contamination with the liberated inorganic fine powder can be suppressed and thus good durability can be maintained.

From the above, into the developer supply container in this embodiment, by supplying the toner for which the depositing force Fp between two particles of the toner and the liberation rate of the inorganic fine powder are in the proper ranges, the feeding property and the discharging property of the toner in the developer supply container are remarkably improved. Further, by remarkably supplying the liberation of the inorganic fine powder during the discharge, the supplied toner is maintained in a uniform state.

Further, in the develops A, B, C shown in Table 5, the developers A, B are lower in discharging property Fp between two particles than the developer C. For that reason, the developers A, B obtain the (developer) loosening effect by the air easier than the developer C, and therefore, the supplied developer can be maintained in a uniform state. Particularly, in such a system that there is no hopper 10*a* as shown in FIG. 7, by the supply of the uniform developer, the image density fluctuation can be suppressed. Further, the developer C is higher in depositing force Fp between two particles, than the developer A, B. For that reason, the developer C has the feeding effect by the partition wall 6 than the developer A, B, and therefore even in the case where the amount of consumption of the developer is larger, it is possible to easily supply the developer in an amount necessary for the image forming apparatus. On the other hand, when the developer I shown in Table 5 is accommodated in the developer supply container in this embodiment, the developer in the container cannot be loosened sufficiently, so that the case where the discharge becomes difficult was observed. Further, when the developer H is accommodated in the developer supply container in this embodiment, a lowering in discharge accuracy due to worsening of the developer feeding property and toner scattering into the periphery during the discharge were observed.

Further, the developers B, C are lower in liberation rate than the developer A, and even in the case where the developer is caused to pass through the small opening by the force of the air as in the constitution in this embodiment, it is possible to further suppress the liberation of the inorganic fine powder, so that a degree of the member contamination was slighter. On the other hand, the developer I is high in liberation rate, so that the member contamination with the inorganic fine powder was observed.

Incidentally, in this embodiment, in addition to the developers A, B, C described in First Embodiment described above, the following developer H, I were prepared.

[Manufacturing Method Embodiment of Supply Developer H]

Toner H used in this embodiment was obtained by changing the amount of silica particles (BET specific surface area: 85 $m^2/g$) to 0.45 weight part and changing the dry-mixing time by the Henschel mixer ("FM 10C", manufactured by Nippon Coke & Engineering Co., Ltd., upper blade: Type Y1/lower blade: type So) to 1 min. during the manufacturing of the toner C. [Manufacturing Method Embodiment of supply developer I]

Toner I used in this embodiment was obtained by changing the amount of silica particles (BET specific surface area: 85 $m^2/g$) to 4.5 weight part and changing the dry-mixing time by the Henschel mixer ("FM 10C", manufactured by Nippon Coke & Engineering Co., Ltd., upper blade: Type Y1/lower blade: type So) to 1 min. during the manufacturing of the toner C.

(Developer Supply Container Including Metering Portion)

Also the developer in this embodiment can be suitably used even in the developer supply container including the metering portion 4*d* capable of accommodating the developer in a certain amount above the portion 4*a* described in Second Embodiment.

With respect to the developer in this embodiment, in the air-suction step, the air is taken into the developer supply container 1 through the discharging opening 4*a*, so that the developer T in the metering portion 4*d* is in a state in which the air is contained. At this time, in the case where the depositing force Fp between two particles of the toner when containing the air is smaller than $1.0\times10^{-9}$ N, the flowability of the toner is excessively high and therefore when the air is taken in the developer T by air-suction, there is a liability that the toner overflows to the outside of the metering portion 4*d*. In that case, the developer T causes variation in amount in the metering portion 4*d* in the air-discharging step, so that there is a possibility that an amount of the developer discharged through the discharge opening 4*a* cannot be maintained at a constant value. In the case where the Fp is larger than $1.0\times10^{-6}$ N, there is a possibility that the case where the developer T cannot be properly loosened occurs, and therefore there is a liability that a stable discharging property cannot be obtained.

In the air-discharging step, when the Fp when the air is not contained in the developer T is smaller than $1.0\times10^{-9}$ N, the developer T enters, from the gap between the sector plate-like members 7*a* and the discharging portion 4*c*, the inside of the metering portion 4*d*. For that reason, there is a liability that during the discharge, not only the developer T in the metering portion 4*d* but also the developer existing in a large amount at the peripheral portion thereof are discharged together. Accordingly, there is an increasing possibility that a variation generates in amount of the developer T discharged through the discharging opening 4*a*. In the case where the Fp is larger than $1.0\times10^{-6}$ N, the developer T is liable to stagnate in the gap between the sector plate-like members 7*a* and the discharging portion 4*c*, so that a degree of a liability that the developer T is subjected to stress by relative rotation between the sector plate-like members 7*a* and the discharging portion 4*c* and then agglomerates increases.

Further, also in this embodiment, the liberation rate of the inorganic fine powder of the toner may preferably be 40 number % or less. Also the discharge opening of the developer supply container in this embodiment is a small opening and the metering portion 4*d* and the sector plate-like members 7*a* are provided in this embodiment, and therefore the toner passing through the discharge opening is liable to be subjected to stress, so that the inorganic fine powder is in a state in which the inorganic fine powder is liable to liberate. Therefore, by using the toner in which the liberation rate of the inorganic fine powder is 40 number % or less, the liberation of the inorganic fine powder when the toner is discharged from the developer supply container can be remarkably suppressed to a small amount.

Further, when the develops A, B, C shown in Table 5 are accommodated in the developer supply container in this embodiment, very high discharge accuracy can be obtained. Further, the developers A, B obtain the (developer) loosening effect by the air easier than the developer C, and therefore, by combining the developers A, B with the developer supply container in this embodiment, the supplied developer can be maintained in a uniform state. Particularly, in such a system that there is no hopper 10*a* as shown in FIG. 7, the effect is conspicuous, so that the image density fluctuation can be remarkably suppressed. Further, the developer C has the feeding effect by the partition wall 6 than the developer A, B, and therefore even in the case where the amount of consumption of the developer is larger, it is possible to easily supply the developer in an amount necessary for the image forming apparatus. On the other hand, when the developer I shown in Table 5 is accommodated in the developer supply container in this embodiment, the developer in the container cannot be loosened sufficiently, so that the case where the discharge becomes difficult and the case where the developer agglomerates between the sector plate-like members 7*a* and the discharging portion 4*c* were observed. Further, when the developer H is accommodated in the developer supply container in this embodiment, a lowering in discharge accuracy and toner scattering into the periphery during the discharge were observed.

Further, the developers B, C are lower in liberation rate than the developer A, and even in the case where the discharge is made using a constitution in which there is a liability that shear is more applied to the developer as in the discharge constitution in this embodiment, it is possible to suppress the liberation of the inorganic fine powder, so that it was possible to suppress the member contamination to a slight level. On the other hand, the developer I is high in liberation rate, and as in the discharge constitution in this embodiment, the developer I is liable to be liberated in the constitution in which there is a liability that shear is more applied to the developer, and therefore the member contamination with the inorganic fine powder was observed in a larger degree than First Embodiment.

Accordingly, into the developer supply container in this embodiment, by supplying the developer for which the depositing force Fp between two particles and the liberation rate fall in the suitable ranges, it is possible to properly loosen the developer and to maintain the developer amount in the metering portion at a constant level, so that the discharge amount of the developer from the developer supply container can be controlled with high accuracy. Further, the degree of the liability that the developer stagnates and agglomerates at a place where the developer is liable to be subjected to stress can be further reduced.

INDUSTRIAL APPLICABILITY

According to the present invention, the developer can be discharged from the developer supply container with the precision, and an image density variation can be suppressed even when an great number of prints are produced with high printing ratio.

The invention claimed is:

1. A developer supply kit comprising a developer supply container and developer accommodated therein, wherein said developer supply container includes:

a developer accommodating portion accommodating said developer, a discharge opening configured to discharge said developer accommodated in said developer accommodating portion, a drive receiving portion configured to receive a driving force, and a pump portion operable so that an internal pressure of said developer accommodating portion alternately and repetitively changes between a pressure lower than an ambient pressure and a pressure higher than the ambient pressure by the driving force received by said drive receiving portion, wherein said developer accommodated in said developer supply container includes toner containing binder resin material and a coloring material, and said developer satisfies:

$$10 \leq E \text{ (mJ)} \leq 80,$$

$$0.4 \leq Ea \text{ (mJ)} \leq 2.0,$$

where E is total energy when it is not aerated, and Ea is total energy when it is aerated.

2. A developer supply kit according to claim 1, wherein said developer accommodating portion is provided therein with a feeding portion configured to feed said developer from said developer accommodating portion toward said discharge opening, and said feeding portion includes a partition wall for scooping up said developer in said developer accommodating portion, and an inclined projection for feeding the scooped developer toward said discharge opening.

3. A developer supply kit according to claim 2, further comprising a storing portion configured to store said developer above said discharge opening, wherein said feeding portion is provided with an enclosing portion capable of taking a flow suppressing state for suppressing flow of said developer into said storing portion and a flow permitting state for permitting flow of said developer into said storing portion, and wherein, when said enclosing portion takes the flow suppressing state, the internal pressure of said developer accommodating portion is made higher than the ambient pressure by said pump portion.

4. A developer supplying apparatus to which a developer supply kit is mountable to receive a developer, said apparatus comprising:

a mounting portion to which said developer supply kit according to claim 1 is detachably mountable, a driving mechanism for rotating at least a part of said developer supply kit which is mounted.

* * * * *